US012129099B1

(12) United States Patent
Hughes et al.

(10) Patent No.: US 12,129,099 B1
(45) Date of Patent: Oct. 29, 2024

(54) INSULATED CONTAINER WITH A DRAWER

(71) Applicant: SharkNinja Operating LLC, Needham, MA (US)

(72) Inventors: Simon Hughes, London (GB); Able Chen, Suzhou (CN); Haien Zhou, Suzhou (CN); Thomas Sharp, London (GB)

(73) Assignee: SharkNinja Operating LLC, Needham, MA (US)

( * ) Notice: Subject to any disclaimer, the term of this patent is extended or adjusted under 35 U.S.C. 154(b) by 0 days.

(21) Appl. No.: 18/603,998

(22) Filed: Mar. 13, 2024

(51) Int. Cl.
*B65D 81/38* (2006.01)
*B65D 25/04* (2006.01)
*B65D 81/02* (2006.01)

(52) U.S. Cl.
CPC ..... *B65D 81/3825* (2013.01); *B65D 25/04* (2013.01); *B65D 65/44* (2013.01)

(58) Field of Classification Search
CPC ..... F25D 23/06; F25D 23/062; F25D 23/067; F25D 23/069; F25D 2303/0821; F25D 3/045; F25D 3/06; F25D 3/08; B65D 65/44; B65D 81/3825; B65D 81/383
See application file for complete search history.

(56) References Cited

U.S. PATENT DOCUMENTS 4,194,647 A 3/1980 Spurrier
4,577,475 A * 3/1986 Herrera ..... A45C 11/20 62/464
5,107,649 A 4/1992 Benson et al.
5,157,893 A 10/1992 Benson et al.
5,175,975 A 1/1993 Benson et al.
5,254,798 A * 10/1993 Zoback ..... B32B 21/08 588/259
5,318,108 A 6/1994 Benson et al.
5,477,676 A 12/1995 Benson et al.
5,562,154 A 10/1996 Benson et al.
(Continued)

FOREIGN PATENT DOCUMENTS

CA 2147114 C 6/2000
CA 3070624 A1 1/2019
(Continued)

OTHER PUBLICATIONS

U.S. Appl. No. 18/490,108, filed Oct. 19, 2023, Insulated Container With a Drawer.
(Continued)

*Primary Examiner* — Hung Q Nguyen
(74) *Attorney, Agent, or Firm* — Mintz, Levin, Cohn, Ferris, Glovsky and Popeo, P.C.

(57) ABSTRACT

Various systems, devices, and methods for insulated containers with a drawer are provided. In general, an insulated container, such as a portable cooler, includes a drawer. The insulated container includes a main chamber and includes a drawer chamber that is separate from the main chamber and is configured to movably receive the drawer therein. The main chamber is configured to hold a cooling agent that is configured to cool any items in the main chamber and also any items in the drawer. The insulated container can be manufactured using injection molding.

20 Claims, 45 Drawing Sheets

(56) References Cited

U.S. PATENT DOCUMENTS 5,605,056 A * 2/1997 Brown ..... A01K 97/04 62/529
5,643,485 A 7/1997 Potter et al.
5,813,454 A 9/1998 Potter
5,816,432 A 10/1998 Hammen et al.
5,816,433 A * 10/1998 Higgins ..... F25D 3/08 220/503
5,864,981 A 2/1999 Zeman
5,890,613 A 4/1999 Williams
5,979,175 A 11/1999 Ellison
6,065,303 A 5/2000 Harris
6,109,059 A 8/2000 Lebrun
6,193,097 B1 * 2/2001 Martin Perianes ..... B65D 81/3823 220/501
6,244,064 B1 6/2001 Powell et al.
6,357,252 B1 3/2002 Rand
6,497,424 B2 12/2002 Gartner et al.
6,782,711 B2 8/2004 Abfalter
6,895,778 B1 5/2005 Ackerman
6,925,834 B2 8/2005 Fuchs
6,974,598 B2 12/2005 Scullion et al.
7,095,026 B2 8/2006 Devitt et al.
7,128,369 B2 10/2006 Boggs et al.
7,168,263 B1 1/2007 Zenner
7,240,513 B1 7/2007 Conforti
7,241,464 B2 7/2007 Scullion et al.
7,244,458 B1 7/2007 Scullion et al.
7,263,855 B2 9/2007 Meyer et al.
7,415,794 B1 8/2008 Thompson
7,444,830 B2 11/2008 Moran et al.
7,461,477 B2 12/2008 Allen
7,475,889 B2 1/2009 Marmah et al.
7,478,583 B2 1/2009 Scullion et al.
7,481,065 B2 1/2009 Krieger
7,677,580 B2 3/2010 Vanderberg et al.
D613,560 S 4/2010 Robichaud et al.
7,730,739 B2 6/2010 Fuchs
7,785,641 B2 8/2010 Scullion et al.
7,918,362 B2 4/2011 Schmitt
7,950,249 B1 5/2011 White et al.
7,963,694 B2 6/2011 Leute et al.
7,984,997 B1 7/2011 Sandberg
7,993,723 B2 8/2011 Jung et al.
8,177,827 B2 5/2012 Shapiro
8,181,811 B1 5/2012 Blake
8,191,747 B2 6/2012 Pruchnicki
8,191,907 B2 6/2012 Watson
D667,697 S 9/2012 Shah
8,256,156 B1 9/2012 Burgoyne, Jr.
8,430,265 B2 4/2013 Vanderberg et al.
8,448,813 B2 5/2013 Vanderberg et al.
8,530,720 B2 9/2013 Freer et al.
8,567,211 B2 10/2013 Al-Rasheed
8,573,402 B2 11/2013 Cimino
8,622,235 B2 1/2014 Suchecki
8,640,487 B2 2/2014 Chapa
8,640,937 B2 2/2014 Pruchnicki
8,668,223 B2 3/2014 Vanderberg et al.
8,733,577 B2 5/2014 Patterson
8,826,686 B2 9/2014 Takasugi
8,870,018 B2 10/2014 Cook et al.
8,931,910 B1 1/2015 Brown
8,986,483 B2 3/2015 Cur et al.
8,986,805 B2 3/2015 Yoon et al.
9,022,395 B1 5/2015 Vanderberg
9,027,722 B1 5/2015 Parker
9,052,135 B2 6/2015 Trulaske, Sr.
9,057,552 B2 6/2015 Vanderberg et al.
9,097,454 B2 8/2015 Leclear et al.
9,115,924 B2 8/2015 Leclear et al.
9,146,051 B2 9/2015 Kamin et al.
9,175,896 B2 11/2015 Choi
9,211,901 B2 12/2015 Vanderberg et al.
9,211,902 B2 12/2015 Vanderberg et al.
9,227,643 B1 1/2016 Bonilla et al.
9,232,290 B2 1/2016 Besay
9,260,129 B2 2/2016 Thompson
9,266,642 B2 2/2016 Prakash et al.
9,271,875 B2 3/2016 Freer et al.
9,278,704 B2 3/2016 Cates
9,296,555 B2 3/2016 Kawka et al.
9,302,845 B2 4/2016 Kawka et al.
9,310,118 B2 4/2016 Zavitsanos
9,316,428 B2 4/2016 Mech
9,340,224 B2 5/2016 Yoder et al.
9,353,982 B2 5/2016 Sassman
9,353,989 B2 5/2016 Furr et al.
9,382,052 B2 7/2016 Cecchi et al.
9,448,000 B2 9/2016 Patsis et al.
9,476,638 B1 10/2016 Tyler
9,523,459 B2 12/2016 Min et al.
9,550,508 B1 1/2017 Parra
9,574,819 B2 2/2017 Kang et al.
9,623,890 B1 4/2017 Horowitz
9,643,637 B1 5/2017 Allen
9,682,803 B2 6/2017 Fallat et al.
9,714,788 B2 7/2017 Rigoli
9,731,779 B2 8/2017 Lamb
9,732,550 B2 8/2017 Lubotta
9,738,296 B2 8/2017 Mcbeth
D797,519 S 9/2017 Devenny
9,834,240 B2 12/2017 Vanderberg et al.
9,834,335 B1 12/2017 Summers
9,835,367 B2 12/2017 Vanderberg et al.
9,849,901 B2 12/2017 Jackman
9,890,993 B1 2/2018 Sandberg
9,920,977 B1 3/2018 Avila
D815,920 S 4/2018 Moffett et al.
D815,921 S 4/2018 Moffett et al.
D815,922 S 4/2018 Moffett et al.
9,950,836 B2 4/2018 Jang et al.
9,970,610 B1 5/2018 Sandberg
9,976,789 B2 5/2018 Grepper
9,989,299 B1 6/2018 Ballard
10,006,760 B2 6/2018 Cousaert et al.
10,018,350 B2 7/2018 Brown
10,029,842 B2 7/2018 Seiders et al.
10,046,784 B2 8/2018 Rackleff et al.
10,054,354 B1 8/2018 Kennedy et al.
10,065,848 B2 9/2018 Volin
10,088,147 B2 10/2018 Brown
10,112,766 B1 10/2018 Wu
10,139,153 B2 11/2018 Furr
10,143,282 B2 12/2018 Seiders et al.
10,151,520 B2 12/2018 Christensen
10,167,130 B2 1/2019 Pruitt et al.
10,197,322 B2 2/2019 Lagasse
10,221,005 B2 3/2019 James, Jr.
10,231,904 B1 3/2019 Cowley et al.
10,234,192 B2 3/2019 Tang
10,272,934 B2 4/2019 Defrancia
10,274,247 B2 4/2019 Jeong et al.
10,279,980 B2 5/2019 James, Jr.
10,288,341 B2 5/2019 Chae et al.
10,316,574 B2 6/2019 Lubotta
10,337,787 B2 7/2019 Kal et al.
10,345,026 B2 7/2019 Fire
10,351,330 B2 7/2019 Smith et al.
10,352,609 B2 7/2019 Kriesel
10,371,430 B2 8/2019 Kim et al.
10,384,855 B2 8/2019 Seiders et al.
10,392,043 B2 8/2019 Guerdrum et al.
10,392,180 B1 8/2019 Smith et al.
10,401,075 B2 9/2019 Bond
10,415,868 B2 9/2019 Grepper
10,429,117 B2 10/2019 Poirier
10,442,568 B1 10/2019 Summers
10,442,599 B2 10/2019 Seiders et al.
10,443,918 B2 10/2019 Li et al.
10,451,335 B2 10/2019 Owens et al.
10,457,309 B2 10/2019 Devarona
10,486,726 B1 11/2019 Logan
10,506,895 B2 12/2019 Mogil et al.

(56) References Cited

U.S. PATENT DOCUMENTS 10,517,755 B2 12/2019 D'ambrosio et al.
10,556,725 B2 2/2020 Breyburg
10,575,681 B1 3/2020 Womack
10,588,388 B2 3/2020 Kabalin
10,602,819 B2 3/2020 Tan
10,625,762 B2 4/2020 Chapus
10,633,009 B2 4/2020 Webber et al.
10,669,090 B2 6/2020 Conway
10,676,267 B2 6/2020 Seiders et al.
10,689,156 B2 6/2020 Sawachi
10,739,035 B2 8/2020 Herweck et al.
10,775,100 B2 9/2020 Signorino et al.
10,781,028 B2 9/2020 Munie et al.
10,782,061 B2 9/2020 Arai et al.
D899,866 S 10/2020 Bullock et al.
10,816,256 B2 10/2020 Knight et al.
D908,443 S 1/2021 Bell et al.
10,906,723 B2 2/2021 Guerdrum et al.
10,906,794 B2 2/2021 Fire
10,953,907 B2 3/2021 Wilkins
10,967,896 B2 4/2021 Kravchenko
10,969,154 B1 4/2021 Massler
10,981,716 B2 4/2021 Seiders et al.
11,008,030 B2 5/2021 Cohen et al.
11,034,123 B2 6/2021 De Bruin et al.
11,046,347 B2 6/2021 Merka et al.
11,067,456 B2 7/2021 Diehn et al.
11,072,484 B1 7/2021 Silva
D927,939 S 8/2021 Ellison et al.
11,098,947 B2 8/2021 Jeong et al.
11,118,827 B2 9/2021 Alexander et al.
11,125,474 B2 9/2021 Ahmad et al.
11,162,716 B2 11/2021 Alexander et al.
11,186,422 B2 11/2021 Seiders et al.
11,199,353 B2 12/2021 Kehr
11,203,473 B1 12/2021 Mcgowan
11,230,425 B1 1/2022 Block et al.
11,235,791 B2 2/2022 Mize, Jr.
11,235,794 B1 2/2022 Ciccarelli
11,242,175 B2 2/2022 Barfoot et al.
11,242,189 B2 2/2022 Rogers et al.
11,248,830 B2 2/2022 Goldstein et al.
11,267,637 B2 3/2022 Barfoot et al.
11,267,639 B2 3/2022 Guerdrum et al.
D948,954 S 4/2022 Seiders et al.
11,313,605 B2 4/2022 Kieling et al.
11,313,610 B2 4/2022 Godbole
11,318,973 B2 5/2022 Kelly et al.
D955,822 S 6/2022 Huang et al.
D955,823 S 6/2022 Huang et al.
11,365,926 B2 6/2022 Alexander et al.
11,401,099 B2 8/2022 Stephens et al.
11,414,238 B2 8/2022 Ahlström et al.
11,414,256 B2 8/2022 Fabela
11,421,930 B1 8/2022 Whitney et al.
11,434,052 B2 9/2022 Stephens et al.
11,454,439 B2 9/2022 Spain et al.
D965,409 S 10/2022 Bullock et al.
11,465,823 B2 10/2022 Seiders et al.
11,466,920 B2 10/2022 Hanna
11,466,921 B2 10/2022 Sonntag et al.
11,473,827 B2 10/2022 Aaron et al.
D968,547 S 11/2022 Cooper
11,505,224 B2 11/2022 Kravchenko
D972,372 S 12/2022 Munie et al.
11,518,972 B2 12/2022 Liu et al.
11,525,616 B2 12/2022 Wilkerson et al.
11,535,425 B2 12/2022 Ahlström et al.
11,542,088 B2 1/2023 Barfoot et al.
11,549,745 B2 1/2023 Owens et al.
11,565,872 B2 1/2023 Rogers et al.
11,589,659 B2 2/2023 Parikh
11,608,221 B2 3/2023 Lee et al.
11,613,292 B2 3/2023 Ruiz et al.
11,614,266 B1 3/2023 Sutton
D982,699 S 4/2023 Cooper
D984,219 S 4/2023 Sherwin et al.
11,619,378 B2 4/2023 Brown
11,623,793 B2 4/2023 Duong et al.
11,623,796 B2 4/2023 Bullock et al.
11,628,683 B2 4/2023 Pearson
11,666,179 B2 6/2023 Mogil et al.
11,668,508 B2 6/2023 Alexander et al.
11,673,344 B2 6/2023 Chen
11,685,480 B2 6/2023 Cooper
11,685,589 B2 6/2023 Munie et al.
11,718,332 B2 8/2023 Trnovec
2003/0161932 A1 8/2003 Anderson et al.
2003/0161933 A1 8/2003 Anderson et al.
2003/0211219 A1 11/2003 Scullion et al.
2006/0144841 A1 7/2006 Sener
2006/0147601 A1 7/2006 Scullion et al.
2006/0247967 A1 11/2006 Prusik et al.
2006/0283205 A1 12/2006 Carriere
2006/0288730 A1 12/2006 Shill
2008/0245095 A1 10/2008 Schlipman et al.
2010/0037630 A1 2/2010 Gadson
2010/0059199 A1 3/2010 Court
2010/0064720 A1 3/2010 Fuchs
2010/0275642 A1 11/2010 Klettner
2011/0077527 A1 3/2011 Yang et al.
2011/0214357 A1 9/2011 Ewing
2011/0214358 A1 9/2011 Ewing et al.
2011/0226003 A1 9/2011 Chaney et al.
2013/0026171 A1 1/2013 James, Jr.
2014/0069935 A1 3/2014 James, Jr.
2014/0221896 A1 8/2014 Freer et al.
2014/0352929 A1 12/2014 Wu et al.
2015/0369529 A1 12/2015 Monroe
2016/0161177 A1 6/2016 Bond
2017/0023289 A1 1/2017 Anderson
2017/0115045 A1 4/2017 Alken
2018/0149400 A1 5/2018 Valencia
2018/0335241 A1* 11/2018 Li ..... B65D 25/06
2019/0049167 A1 2/2019 Willis
2019/0219321 A1 7/2019 Fryer-Biggs et al.
2019/0248397 A1 8/2019 Defrancia
2019/0285329 A1* 9/2019 Kehr ..... F25D 3/08
2019/0293340 A1 9/2019 Choi
2019/0313818 A1 10/2019 Bessho et al.
2020/0163829 A1 5/2020 Nathanson
2020/0323322 A1 10/2020 Washington
2021/0137235 A1 5/2021 Humphrey Felix
2021/0285710 A1 9/2021 Barros et al.
2021/0348836 A1 11/2021 Lauchnor
2022/0024675 A1 1/2022 Zawistowski et al.
2022/0026132 A1 1/2022 Gransden
2022/0049889 A1 2/2022 Katzman
2022/0099245 A1 3/2022 Cooper
2022/0170683 A1 6/2022 Jacob
2022/0258840 A1 8/2022 Cooper et al.
2022/0267056 A1 8/2022 Morris et al.
2022/0273106 A1 9/2022 Cooper et al.
2022/0274737 A1 9/2022 Richardson et al.
2022/0279982 A1 9/2022 Scheen et al.
2022/0289462 A1 9/2022 Papera
2022/0325935 A1 10/2022 Badie, Jr.
2022/0354230 A1 11/2022 Doricent
2022/0400878 A1 12/2022 Cooper
2022/0411166 A1 12/2022 Mudd
2022/0412633 A1 12/2022 Ardoin
2023/0031592 A1 2/2023 Cooper
2023/0078019 A1 3/2023 Munger et al.
2023/0112280 A1 4/2023 Banal et al.
2023/0114227 A1 4/2023 Hofer et al.
2023/0126486 A1 4/2023 Smith et al.
2023/0166901 A1 6/2023 Harrison, Jr. et al.
2023/0192248 A1 6/2023 May
2023/0213264 A1 7/2023 Jacob
2023/0257185 A1 8/2023 Goellner et al.

(56) References Cited

U.S. PATENT DOCUMENTS

FOREIGN PATENT DOCUMENTS

| | | | | |
|---|---|---|---|---|
| CA | 194302 | S | 2/2022 | |
| CA | 3111777 | A1 | 9/2022 | |
| CN | 101611676 | B | 10/2013 | |
| CN | 101786524 | B | 12/2013 | |
| CN | 103542669 | A | 1/2014 | |
| CN | 102735004 | B | 10/2014 | |
| CN | 104583692 | A | 4/2015 | |
| CN | 103479023 | B | 10/2015 | |
| CN | 103950645 | B | 1/2016 | |
| CN | 106240991 | A | 12/2016 | |
| CN | 104534774 | B | 1/2017 | |
| CN | 205919590 | U | 2/2017 | |
| CN | 105857936 | B | 6/2018 | |
| CN | 108515995 | A | 9/2018 | |
| CN | 109520196 | A | 3/2019 | |
| CN | 106979646 | B | 11/2019 | |
| CN | 110411091 | A | 11/2019 | |
| CN | 110513940 | A | 11/2019 | |
| CN | 107117397 | B | 6/2020 | |
| CN | 106766603 | B | 7/2020 | |
| CN | 113915872 | A | 1/2022 | |
| CN | 216962822 | U | 7/2022 | |
| CN | 112284022 | B | 8/2022 | |
| CN | 115571514 | A | 1/2023 | |
| CN | 115868723 | A | 3/2023 | |
| CN | 114932934 | B | 4/2023 | |
| EP | 2048088 | B1 | 1/2010 | |
| EP | 1773684 | B1 | 8/2015 | |
| EP | 3227503 | A1 | 10/2017 | |
| EP | 2945874 | B1 | 9/2018 | |
| EP | 3507550 | B1 | 11/2020 | |
| EP | 3903627 | A4 | 1/2022 | |
| EP | 3346226 | B1 | 2/2022 | |
| EP | 1625338 | B2 | 4/2023 | |
| GB | 9810309 | | 7/1998 | |
| GB | 9828317 | | 2/1999 | |
| GB | 9828321 | | 2/1999 | |
| GB | 9901018 | | 3/1999 | |
| GB | 2353349 | B | 11/2001 | |
| GB | 2353350 | B | 4/2002 | |
| GB | 2367611 | B | 6/2002 | |
| GB | 2368114 | B | 12/2002 | |
| GB | 2592713 | B | 6/2022 | |
| JP | 2010035952 | A | 2/2010 | |
| WO | 8909860 | A1 | 10/1989 | |
| WO | 9717582 | A1 | 5/1997 | |
| WO | 9850521 | A1 | 11/1998 | |
| WO | 0035152 | A1 | 6/2000 | |
| WO | 0136582 | A1 | 5/2001 | |
| WO | WO-03023296 | A2 * | 3/2003 | ..... F25D 3/08 |
| WO | 2005114071 | A1 | 12/2005 | |
| WO | 2013019372 | A9 | 6/2013 | |
| WO | 2017197230 | A1 | 11/2017 | |
| WO | 2018041496 | A1 | 3/2018 | |
| WO | 2019126056 | A1 | 6/2019 | |
| WO | 2021108890 | A1 | 6/2021 | |
| WO | 2022080653 | A1 | 4/2022 | |
| WO | 2022104318 | A1 | 5/2022 | |
| WO | 2022150242 | A1 | 7/2022 | |
| WO | 2022173298 | A1 | 8/2022 | |
| WO | 2023096816 | A1 | 6/2023 | |

OTHER PUBLICATIONS

U.S. Appl. No. 18/490,122, filed Oct. 19. 2023, Method of Manufacturing an Insulated Container.

U.S. Appl. No. 18/423,994, filed Jan. 26, 2024, Insulated Container With a Drawer.

U.S. Appl. No. 18/604,003, filed Mar. 13, 2024, Insulated Container With a Drawer.

U.S. Appl. No. 29/912,295, filed Sep. 15, 2023, Cooler.

International Search Report and Written Opinion received for PCT Application No. PCT/CN2024/075101, mailed on May 20, 2024, 10 pages.

International Search Report and Written Opinion received for PCT Patent Application No. PCT/CN2023/119079, mailed on Jun. 6, 2024, 8 pages.

* cited by examiner

INSULATED CONTAINER WITH A DRAWER

CROSS REFERENCE TO RELATED APPLICATIONS

The present application claims priority and is a continuation of PCT Patent Application No. PCT/CN2024/075101 filed Jan. 31, 2024, which claims priority to PCT Patent Application No. PCT/CN2023/119079 filed Sep. 15, 2023, the entire contents of which are hereby incorporated herein by reference in their entireties.

FIELD

The present disclosure generally relates to insulated containers with a drawer.

BACKGROUND

Portable insulated containers such as coolers allow items such as beverages and foods to be kept cold while outdoors, in a vehicle, or otherwise outside a refrigerator or freezer. Portable coolers typically have an insulated internal cavity in which a cooling agent, such as ice or reusable cooler packs, is placed to help cool the items in the cooler. As the cooling agent defrosts or melts, the cooling agent itself and/or condensation from the cooling agent can cause items in the cooler to become wet. An item becoming wet may cause one or more unwelcome effects, such as making items undesirably damp, making items difficult and/or messy to handle unless cleaned with a towel or other material, damaging paper packaging of items, etc.

SUMMARY

In general, systems, devices, and methods for insulated containers with a drawer are provided.

In one aspect, an insulated container is provided that in one embodiment includes an upper housing and a lower housing. The upper and lower housings are separated by a horizontal divider wall formed of a material having a thermal conductivity of about 0.3 W/m K or less. The horizontal divider wall is integrally formed with the upper housing. The horizontal divider wall has a plurality of ribs along a bottom surface of the horizontal divider wall, a thickness between about 7 mm and about 11 mm, and maximum deformation factor of 5 or less when the horizontal divider wall is subjected to a force of between about 1 kPa and about 2 kPa. The deformation factor is determined by dividing a maximum deformation of the horizontal divider wall by the thickness.

The insulated container can vary in any number of ways. For example, the horizontal divider wall can have a total surface area between about 0.1 square meters and about 0.2 square meters, such as about 0.15 square meters. The horizontal divider wall can be formed of polypropylene.

In another example, the insulated container can include a vertical divider wall positioned within the lower housing and arranged to support a central portion of the horizontal divider wall. The vertical divider wall can support between about 0.25 and about 0.75 of a width of the horizontal divider wall in a first configuration. The deformation factor can be 1 or less in the first configuration. The vertical divider wall can support an entire width of the horizontal divider wall in a second configuration. The deformation factor can be 1 or less in the second configuration.

In another aspect, an insulated container is provided that in one embodiment includes an upper housing and a lower housing. The upper and lower housings are separated by a horizontal divider wall formed of a material having a thermal conductivity of about 0.3 W/m K or less. The horizontal divider wall is integrally formed with the upper housing. The horizontal divider wall has a plurality of hexagonal ribs arranged in a honeycomb pattern along a bottom surface of the divider wall, a total surface area between about 0.1 square meters and about 0.2 square meters, and a maximum plastic strain value of 190% or less when the horizontal divider wall is subjected to a dynamic force of between about 1 kPa and about 2 kPa.

The insulated container can vary in any number of ways. For example, the maximum plastic strain can be less than an elongation at failure value. The elongation at failure value can be a strain of about 200%. The horizontal divider wall can be formed of polypropylene.

In another example, the insulated container can include a vertical divider wall positioned within the lower housing and arranged to support a central portion of the horizontal divider wall. The vertical divider wall can support between about 0.25 and about 0.75 of a width of the horizontal divider wall in a first configuration. The vertical divider wall can support an entire width of the horizontal divider wall in a second configuration.

In still another example, the upper and lower housings can be separable from one another. The upper housing can have a first plurality of walls that defines a main chamber arranged to receive a cooling agent therein. The lower housing can have a second plurality of walls that defines a drawer chamber arranged to receive a drawer therein.

In another aspect, an insulated container is provided that in one embodiment includes a housing having a substantially rigid polypropylene horizontal divider, the horizontal divider including a top non-porous surface that can be substantially smooth and a bottom surface having a plurality of ribs defining pores there between, the ribs being arranged in a honeycomb pattern to inhibit vertical deformation of the horizontal divider. In some aspects, the horizontal divider has a first vertical distance as measured between the top surface and the bottom surface within the pores and a second vertical distance as measured between the top surface and the bottom surface at the ribs.

The insulated container can vary in any number of ways. For example, in some aspects, the second distance varies along a length of the horizontal divider and the first distance remains constant along a length of the horizontal divider. In some aspects, the second distance can be between about 7 mm and about 11 mm. In some aspects, the first distance is between about 2.5 mm and 3 mm.

In another example, each rib of the plurality of ribs has a cross-sectional shape selected from the group consisting of a pentagon, a hexagon, and an octagon. In some aspects, at least one rib of the plurality of ribs can be truncated. In another example, the top surface defines a bottom of an upper housing of the insulated container and the bottom surface defines a top of a lower housing of the insulated container. In some aspects, the horizontal divider has a width and a length, the length being greater than the width. In some aspects, the top surface can be slanted horizontally to direct fluid flow towards a drain in the insulated container.

In another aspect, an insulated container is provided that in one embodiment includes a housing having a polypropylene horizontal divider wall, the divider wall having a non-porous upper layer and a porous lower layer. The porous lower layer has at least two pores each having a hexagonal cross-sectional shape. In some aspects, a thickness of the non-porous upper layer can be constant, a thickness of the porous lower layer varies along a length thereof, and the thickness of the porous lower layer can be greater than the thickness of the non-porous upper layer.

In one example, the porous lower layer can be parallel to a bottom wall of the housing. In another example, the non-porous upper layer can be sloped relative a bottom wall of the housing and can be arranged to direct a liquid towards a drain of the housing.

In some aspects, the thickness of the non-porous upper layer can be between about 2.5 mm and 3 mm. In some aspects, the thickness of the porous lower layer ranges from about 4 mm to about 8 mm. In another example, the non-porous upper layer defines a bottom of an upper housing of the insulated container and the porous lower layer defines a top of a lower housing of the insulated container. In yet another example, the horizontal divider wall has a width and a length, the length being greater than the width. In some aspects, the at least two pores can inhibit deformation of the horizontal divider wall.

BRIEF DESCRIPTION OF DRAWINGS

This disclosure will be more fully understood from the following detailed description taken in conjunction with the accompanying drawings, in which:

FIG. 34C is another bottom perspective view of the upper housing of FIG. 34A;

DETAILED DESCRIPTION

Figure 1:
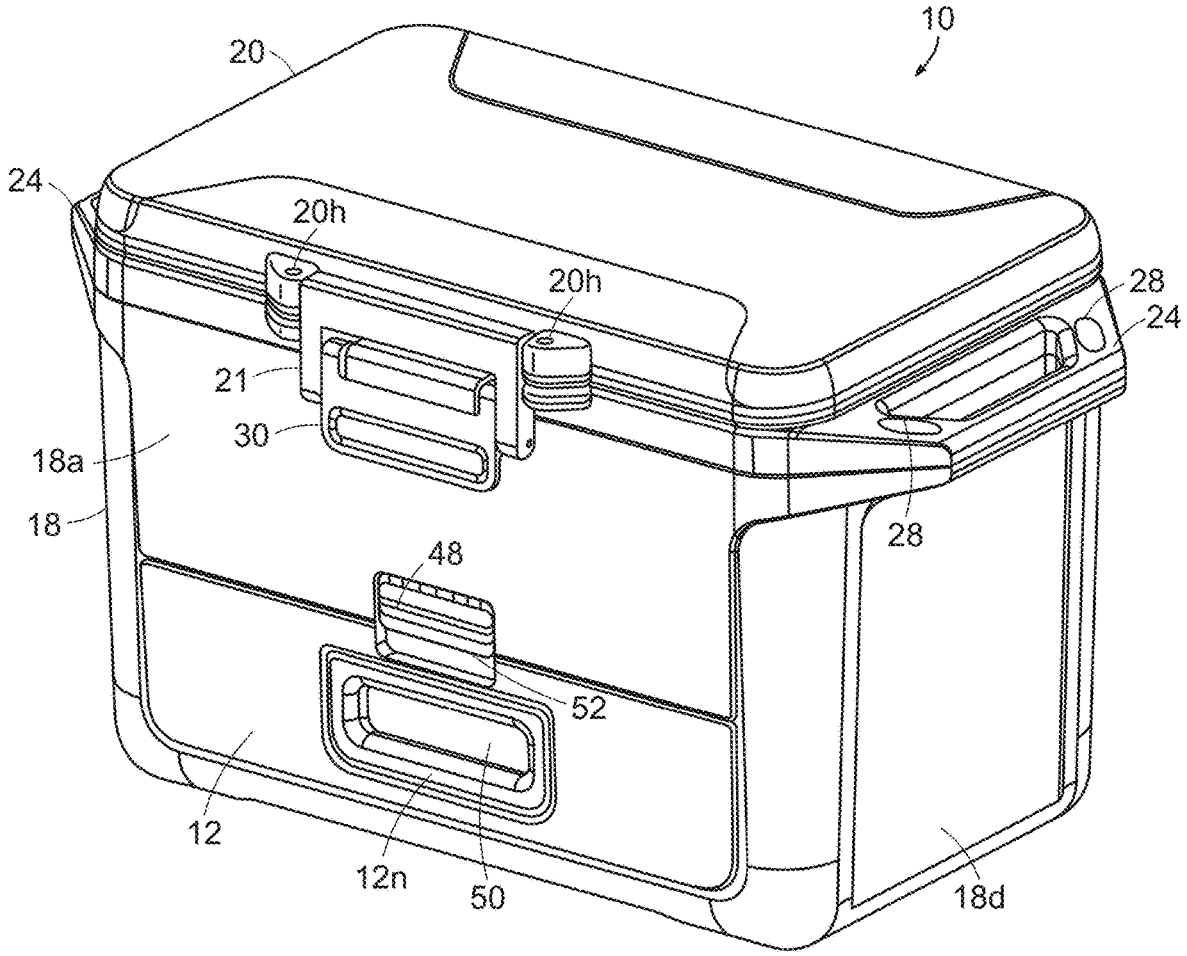
FIG. 1 is a perspective view of one embodiment of an insulated container.

Certain embodiments will now be described to provide an overall understanding of the principles of the structure, function, manufacture, and use of the devices, systems, and methods disclosed herein. One or more examples of these embodiments are illustrated in the accompanying drawings. Those skilled in the art will understand that the devices, systems, and methods specifically described herein and illustrated in the accompanying drawings are non-limiting embodiments and that the scope of the present invention is defined solely by the claims. The features illustrated or described in connection with one exemplary embodiment can be combined with the features of other embodiments. Such modifications and variations are intended to be included within the scope of the present invention.

Further, in the present disclosure, like-named components of the embodiments generally have similar features, and thus within a particular embodiment each feature of each like-named component is not necessarily fully elaborated upon. Additionally, to the extent that linear or circular dimensions are used in the description of the disclosed systems, devices, and methods, such dimensions are not intended to limit the types of shapes that can be used in conjunction with such systems, devices, and methods. A person skilled in the art will recognize that an equivalent to such linear and circular dimensions can easily be determined for any geometric shape.

Various systems, devices, and methods for insulated containers with a drawer are provided. In general, an insulated container, such as a portable cooler, includes a drawer. The insulated container includes a main chamber and includes a drawer chamber that is separate from the main chamber and is configured to movably receive the drawer therein. The main chamber is configured to hold a cooling agent that is configured to cool any items in the main chamber and also any items in the drawer. The item(s) in the drawer may thus be separated from the cooling agent and not become wet from moisture in the main chamber, e.g., from the cooling agent melting or defrosting. Additionally, the main and drawer chambers being separate from one another allows one of the main and drawer chambers to be opened, e.g., to access item(s) contained therein, without breaking a seal of the unopened one of the drawer and main chambers. A temperature within the unopened one of the drawer and main chambers may thus be prevented from decreasing so as to help maintain effective cooling of the item(s) contained therein.

In an exemplary embodiment, an insulated container is manufactured using injection molding. Using injection molding to manufacture the insulated container may allow for finer details and tolerance control than other manufacturing methods, such as rotomolding. Using injection molding to manufacture the insulated container may allow for individual components of the insulated container to be formed separately. Forming components separately may improve overall structural integrity of each individual component and thus overall structural integrity of the fully assembled insulated container. Forming components separately may improve cooling performance since a singular member does not have seams, joints, or other connection areas that would exist if the singular member was instead formed of two or more parts connected together. Forming components separately may help prevent leaks since a singular member does not have seams, joints, or other connection areas where leaks are most likely to develop.

FIGS. 1-15 illustrate one embodiment of an insulated container 10 that includes a drawer 12. The insulated container 10 in this illustrated embodiment is a portable cooler. The insulated container 10 is configured to hold therein a cooling agent, such as ice or one or more reusable cooler packs, configured to cool one or more items, such as food, beverages, and medicine, also held in the insulated container 10.

Figure 13:
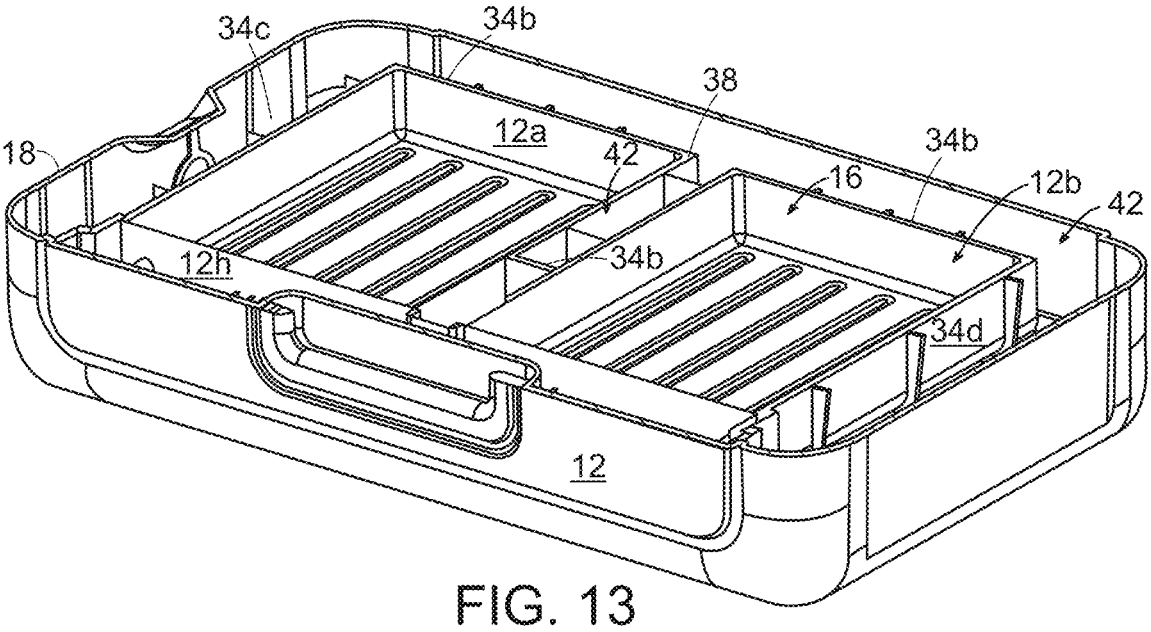
FIG. 13 is another perspective cross-sectional view of the insulated container of FIG. 1.

As discussed further below, the insulated container 10 includes a main chamber 14 (scc for example FIG. 8) configured to hold the cooling agent therein and includes a drawer chamber 16 that is configured to movably receive the drawer 12 therein (see for example FIG. 13). The drawer chamber 16 is isolated from the main chamber 14 such that the drawer 12 received in the drawer chamber 16 is also isolated from the main chamber 14. Thus, as the cooling agent defrosts or melts, the cooling agent itself and/or condensation from the cooling agent cannot wet the item(s) in the drawer 12. Similarly, a beverage or other item that accidentally spills or leaks in the main chamber 14 cannot wet or otherwise damage any items in the drawer 12, and vice versa with a beverage or other item that accidentally spills or leaks in the drawer 12 cannot wet or otherwise damage any items in the main chamber 12.

The drawer chamber 16, and thus the drawer 12 received therein, is located vertically below the main chamber 14, e.g., the drawer chamber 16 and the drawer 12 received therein are closer to a bottom of the insulated container 10 than the main chamber 14. Because gravity tends to draw the cooling agent in the main chamber 14 vertically down, the cooling agent is urged to settle as close as possible to the drawer chamber 16, and thus the drawer 12 received therein.

Opening one of the main chamber 14 and the drawer chamber 16 causes a temperature inside the open chamber to increase due to ambient outside temperature and thus may reduce effectiveness of the cooling agent's cooling of item (s) contained in the open chamber. The drawer chamber 16 and the main chamber 14 being isolated from each other allows one of the main chamber 14 and the drawer chamber 16 to be opened, e.g., to access item(s) contained therein, without breaking a seal of the unopened one of the drawer chamber 16 and the main chamber 14. A temperature within the unopened one of the drawer chamber 16 and the main chamber 14 may thus be prevented from decreasing so as to help maintain effective cooling of the item(s) contained therein. Further, if the drawer chamber 16 is the one of the main and drawer chambers 14, 16 that is opened, the cooling agent in the main chamber 14 will not be exposed to ambient outside air such that the cooling agent's melting or defrosting is not accelerated due to exposure to ambient outside temperature. In other words, opening the drawer 12 to access item(s) therein will not encourage melting or defrosting of the cooling agent in the main chamber 14 like opening of the main chamber 14 does and may therefore prolong effective cooling provided by the cooling agent.

A user may choose to place a cooling agent in the drawer 12 in addition to or instead of in the main chamber 14. However, a cooling agent does not need to be placed in the drawer 12 to cool any items in the drawer 12 because the insulated container 10 is configured to allow the cooling agent in the main chamber 14 to cool the item(s) in the drawer 12, as discussed further below.

The insulated container 10 includes an outer housing 18 and a lid 20 movably coupled to the outer housing 18. The lid 20, e.g., a bottom outer surface of the lid 20, defines a top wall of the main chamber 14 (see for example FIG. 4-7). The lid 20 is configured to move between a closed configuration, in which the main chamber 14 is sealed closed, and an open configuration, in which the main chamber 14 is not sealed closed and the cooling agent and any item(s) removably contained in the main chamber 14 are accessible to a user. In other words, with the lid 20 in the open configuration, a top of the main chamber 14 is open and the main chamber 14 is exposed to ambient outside air. The lid 20 is shown in the closed configuration in FIGS. 1-7 and 15.

Figure 3:
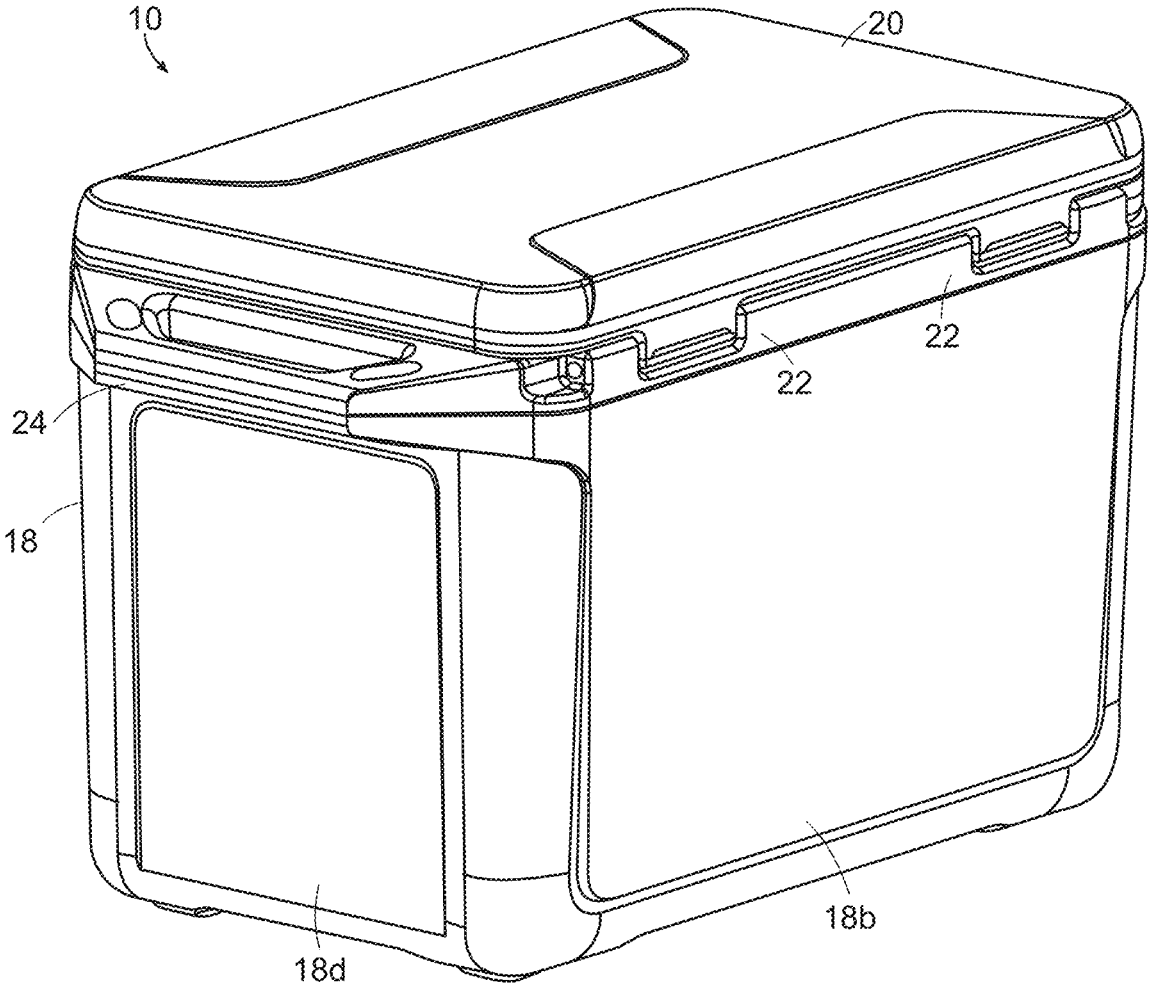
FIG. 3 is yet another perspective view of the insulated container of FIG. 1.

The lid 20 is hingedly and non-removably coupled to the outer housing 18 via a hinge 22, as shown in FIG. 3 in which the hinge 22 includes two hinges, although another number of hinges (e.g., one, three, etc.) can be used. The hinge 22 is configured to prevent the lid 20 from being fully removed from the outer housing 18, which may help prevent loss of the lid 20, may help shield the open main chamber 14 from direct sunlight or other direct heat, and/or may help remind a user to replace the lid 20 when access to the main chamber 14 is no longer needed. In other embodiments, the lid 20 can be non-removably coupled to the lid 20 using another attachment mechanism, such as a flexible tether. In still other embodiments, the lid 20 can be removably attached to the outer housing 18 so as to allow the lid 20 to be fully removed from the outer housing 18.

Figure 2:
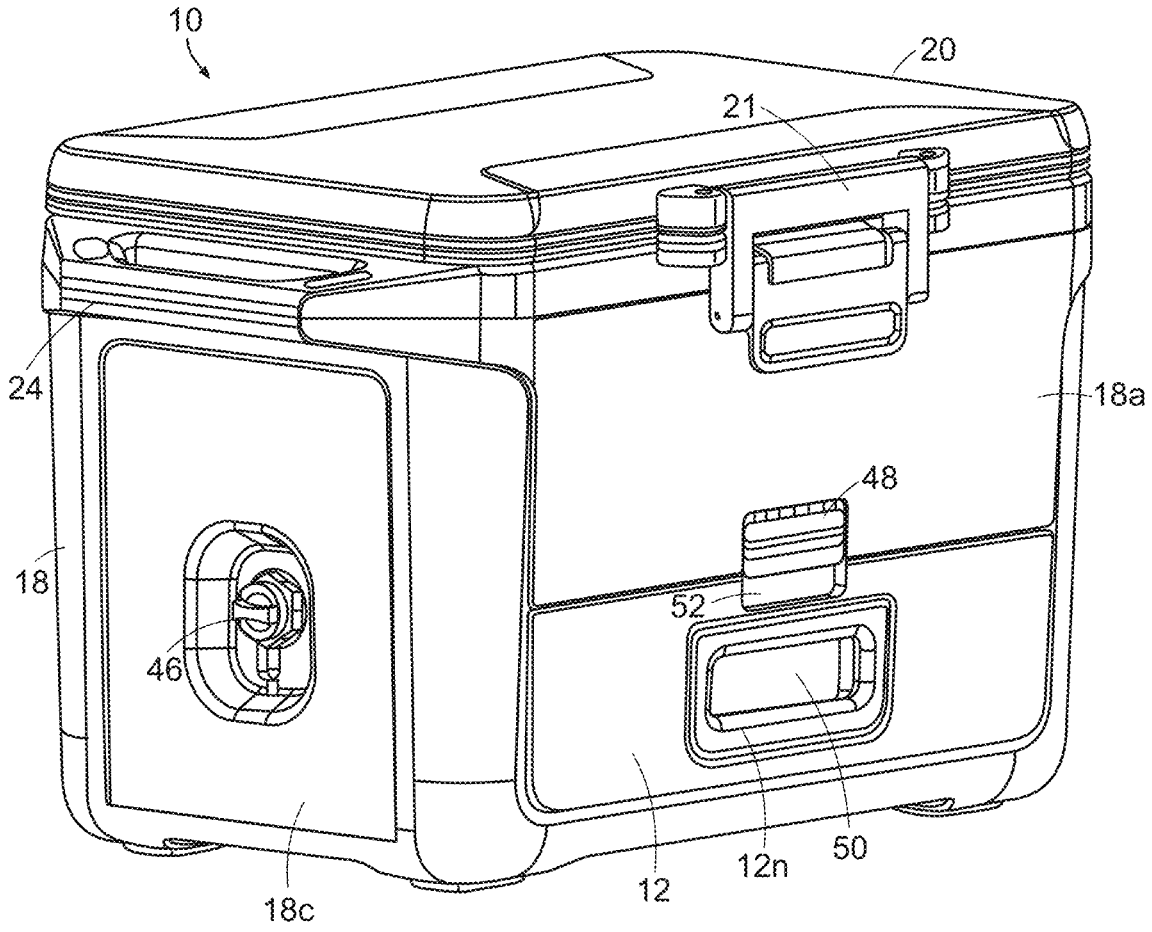
FIG. 2 is another perspective view of the insulated container of FIG. 1.
Figure 6:
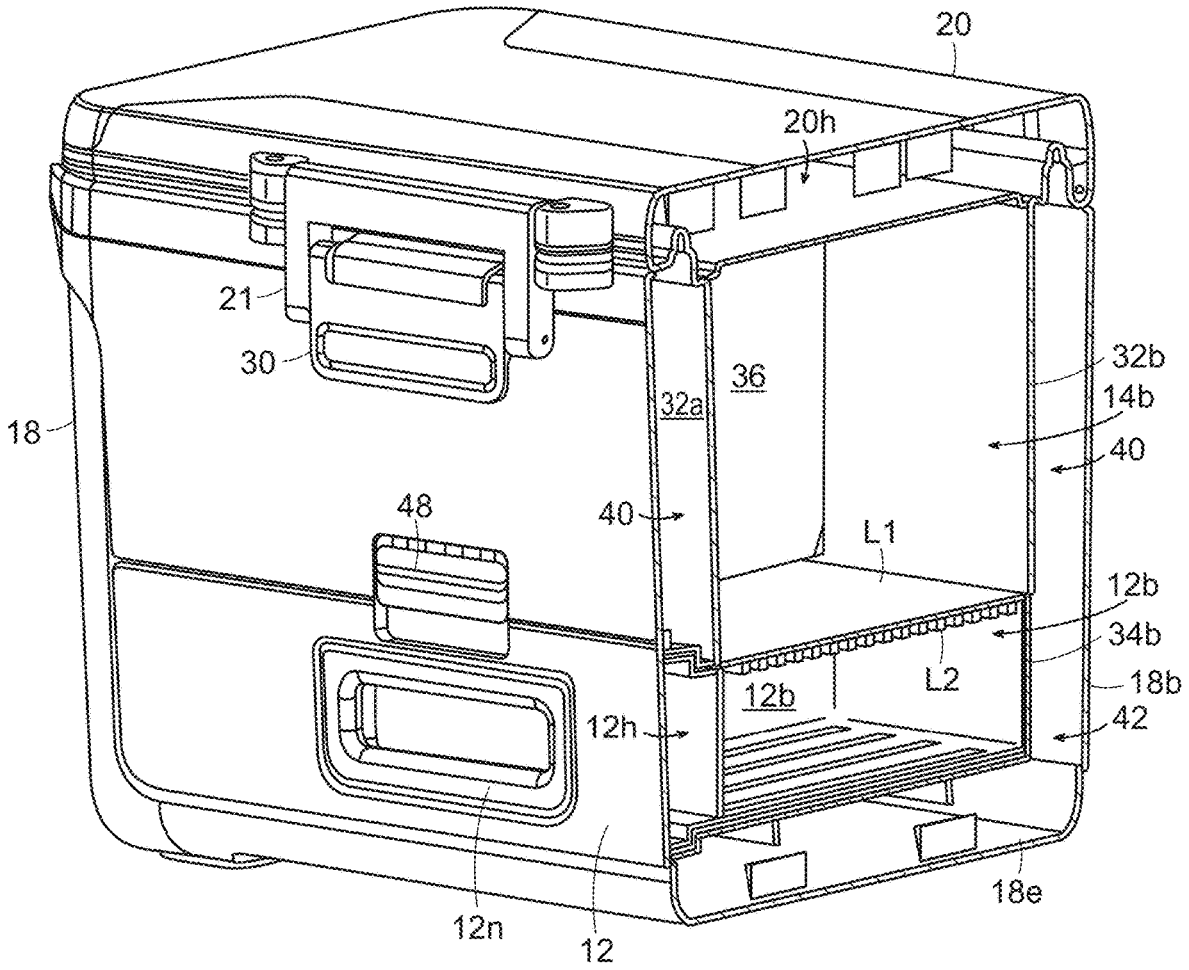
FIG. 6 is another perspective cross-sectional view of the insulated container of FIG. 1.

The insulated container 10 includes a lid lock 21 configured to lock the lid 20 in the closed configuration. The lid lock 21 is configured to move between, e.g., be manually moved by a user between, a locked configuration, in which the lid 20 is locked in the closed configuration, and an unlocked configuration, in which the lid 20 is allowed to be moved, e.g., be manually moved by a user, from the closed configuration to the open configuration. The lid 20 can thus be prevented from opening accidentally, which may help prevent any contents of the main chamber 14 from spilling out (e.g., during transit of the insulated container 10, if the insulated container 10 is dropped accidentally, etc.) and may help prevent the main chamber 14 from accidentally being unsealed and thus increasing in temperature. FIGS. 1, 2, and 6 show the lid lock 21 in the locked configuration.

The lid lock 21 in this illustrated embodiment includes a movable latch but can have other configurations. A bottom of the lid lock 21 in this illustrated embodiment is pivotally attached to the outer housing 18. The lid lock 21 is configured to move between the locked and unlocked configurations by pivoting relative to the outer housing 18 and to the lid 20. A top of the lid lock 21 is configured to releasably engage the lid 20. In the locked configuration, the top of the lid lock 21 engages the lid 20. In the unlocked configuration, the top of the lid lock 21 does not engage the lid 20.

The lid 20 in this illustrated embodiment includes a pair of lock holes **20*h* corresponding to a pair of lock holes formed in the outer housing 208 (the outer housing's lock holes are obscured in the figures). With the lid 20 closed, the lid's lock holes 20*h* are configured to align with the outer housing's lock holes. The aligned lid lock holes 20*h* and outer housing lock holes are configured to receive therethrough a padlock or other locking mechanism (e.g., a zip tie, a rope, etc.) to provide a backup lock of the lid 20 in the closed configuration. The lid 20 and the outer housing 18** each include two lock holes in this illustrated embodiment but can include another number (e.g., one, three, etc.) of lock holes.

The outer housing 18 defines opposed side handles 24 of the insulated container 10. The opposed side handles 24 are configured to be held to facilitate portability of the insulated container 10. The insulated container 10 can include another number of side handles 24 and/or have handle(s) at other locations to facilitate portability of the insulated container 10. The opposed side handles 24 are integrally formed with the outer housing 18 in this illustrated embodiment. In other embodiments the opposed side handles 24 can be separate members attached to the outer housing 18.

Figure 15:
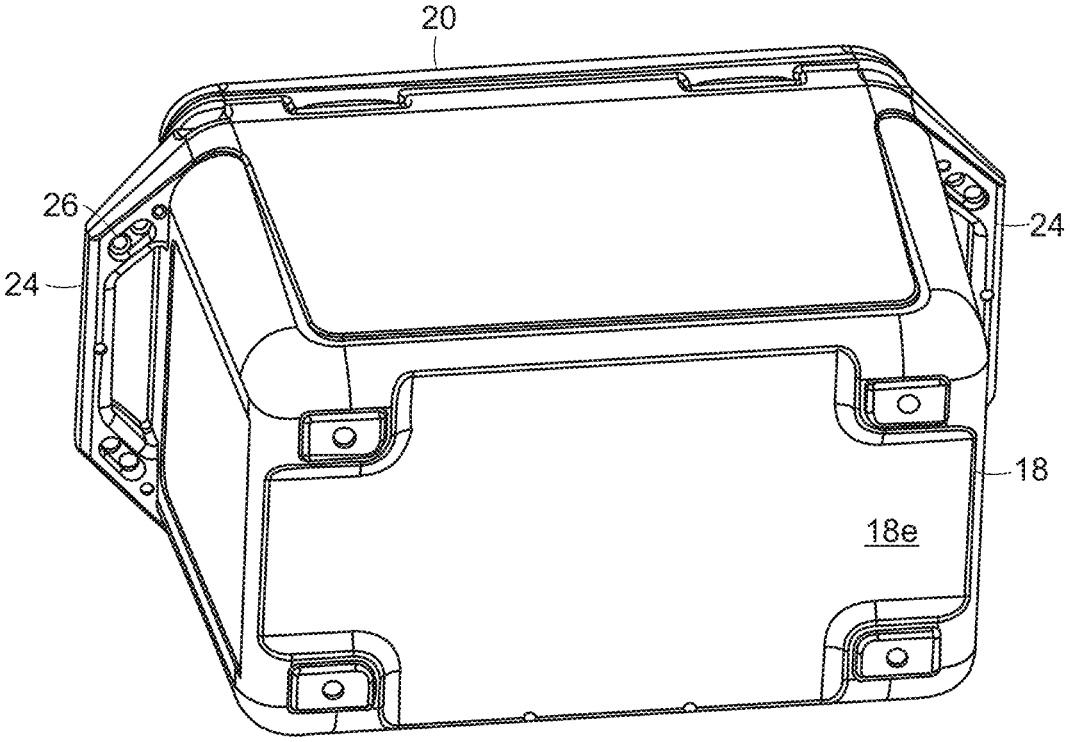
FIG. 15 is another perspective view of the insulated container of FIG. 1.

The opposed side handles 24 in this illustrated embodiment each include one or more holes 26 formed therein, as shown in FIG. 15. Each of the handles 24 includes four openings 26 in this illustrated embodiment but can include another number of openings (e.g., one, two, etc.). In other embodiments, the openings 26 are omitted. The openings 26 are configured to receive a strap, rope, or other member therein configured to facilitate user movement of the insulated container 10, e.g., by carrying, pulling, etc. The strap, rope, or other member can be non-removably or removably received in the openings 26. In some embodiments, the insulated container 10 can include at least one wheel, e.g., two wheels at a bottom of the insulated container 10 on either the left or right side thereof, four wheels at a bottom of the insulated container 10 in four corners thereof, etc., configured to allow for rolling movement of the insulated container 10. A strap, rope, or other member in the openings 26 may help a user achieve such rolling movement. In this illustrated embodiment, the openings 26 are each closed with a cover 28 (see FIG. 1) releasably coupled to the handles 24. In some embodiments, the cover 28 is omitted.

The insulated container 10 in this illustrated embodiment includes a front handle 30. The front handle 30 is configured to facilitate portability of the insulated container 10, e.g., by carrying, pulling, etc. The front handle 30 in this illustrated embodiment is pivotally attached to the outer housing 18, which allows the front handle 30 to be positioned flush and unobtrusively against the outer housing 18 when not in use, as shown in FIGS. 1, 2, and 6. The insulated container 10 can include another number of front handles 30 and/or have handle(s) at other locations to facilitate portability of the insulated container 10. The front handle 30 is a separate member from the outer housing 18, but in some embodiments, the front handle 30 is formed integrally with the outer housing 18 similar to the opposed side handles 24 shown in FIGS. 1-5 and 15.

The outer housing 18 has a front wall 18*a*, a back wall 18*b*, a left side wall 18*c*, a right side wall 18*d*, and a bottom wall 18*e*, as shown in FIGS. 1-4. The front wall 18*a*, the back wall 18*b*, the left side wall 18*c*, the right side wall 18*d*, and the bottom wall 18*e* define an interior cavity of the outer housing 18. The outer housing 18, and thus the interior cavity, has an open top configured to be selectively covered by the lid 20. Each of the front wall 18*a*, the back wall 18*b*, the left side wall 18*c*, and the right side wall 18*d* of the outer housing 18 extends vertically. The bottom wall 18*e* of the outer housing 18 extends horizontally. In an exemplary embodiment, each of the front wall 18*a*, the back wall 18*b*, the left side wall 18*c*, the right side wall 18*d*, and the bottom wall 18*e* have a thickness in a range of about 2.5 to about 3.5 mm. In some variations, the thickness of any of the walls described herein can be greater than 3.5 mm. For example, the thickness of any of the walls can be between about 2.5 mm and about 11 mm.

The insulated container 10 includes an upper housing 32 and a lower housing 34 each configured to be disposed within the outer housing 18 such that the upper and lower housings 32, 34 are contained within the outer housing 18. The upper housing 32 has the main chamber 14 therein. The lower housing 34 has the drawer chamber 16 therein. The upper and lower housings 32, 34 are separate housings from one another, which facilitates the independence of the main and drawer chambers 14, 16 discussed herein. The upper and lower housings 32, 34 being separate housings from one another also allows the upper and lower housings 32, 34 to be separately molded, as discussed further below.

The upper housing 32 has a front wall 32*a*, a back wall 32*b*, a left side wall 32*c*, a right side wall 32*d*, and a bottom wall 32*c*. The front wall 32*a*, the back wall 32*b*, the left side wall 32*c*, the right side wall 32*d*, and the bottom wall 32*e* define the main chamber 14. The upper housing 32, and thus the main chamber 14, has an open top configured to be selectively covered by the lid 20. Each of the front wall 32*a*, the back wall 32*b*, the left side wall 32*c*, and the right side wall 32*d* of the upper housing 32 extends vertically and is substantially planar. A person skilled in the art will appreciate that an element may not be precisely planar but nevertheless considered to be substantially planar for any number of reasons, such as manufacturing tolerances or sensitivity of measurement equipment. The bottom wall 32*e* of the upper housing 32 extends horizontally and is substantially planar. In an exemplary embodiment, each of the front wall 32*a*, the back wall 32*b*, the left side wall 32*c*, and the right side wall 32*d* have a thickness in a range of about 2.5 to about 3.5 mm. A person skilled in the art will appreciate that a value may not be precisely at a certain value but nevertheless considered to be about that value for any number of reasons, such as manufacturing tolerances or sensitivity of measurement equipment.

The thickness of the bottom wall 32*e* (illustrated in FIG. 12B as 32*t*) can be equal to or greater than a thickness of any other sidewall of the upper housing 32. For example, the thickness of the bottom wall 32*e* can be between about 2.5 mm and about 11 mm, about 5 mm and about 10 mm, about 2.5 mm and about 8.5 mm, about 7 mm and about 11 mm, or about 7 mm and about 8 mm. In an exemplary variation, the thickness of the bottom wall 32*e* can be between about 7 mm and about 11 mm. The thickness of the bottom wall 32*e* includes a height of one or more ribs that extend along side one or more pores 32*p*, as described in further detail below and with reference to FIGS. 11, 12A, and 12B. The thickness of the bottom wall 32*e* can vary. For example, a first portion of the bottom wall 32*e* can have a first thickness and a second portion of the bottom wall 32*e* can have a second thickness. In an exemplary embodiment, the first thickness is about 10.3 mm and the second thickness is about 7.7 mm. The second portion having the second thickness can be adjacent to a drain 44, which will be described further below in reference to FIG. 4. The varying thickness of the bottom wall 32*e* facilitates a slanted (e.g., sloped) upper surface thereof, such that any liquids in contact with the bottom wall 32*e* flow towards the drain 44. The bottom surface of the bottom wall 32, including the outer surfaces of the pores 32*p* and surfaces of any channels defined thereby, is parallel to a bottom wall of the insulated container.

The bottom wall 32*e* can have a length and a width. The length can be between about 100 mm and about 1000 mm, about 300 mm and about 800 mm, or about 500 mm and about 600 mm. In an exemplary variation, the length is about 549 mm. The width can be between about 100 mm and about 1000 mm, about 100 mm and about 500 mm, or about 200 mm and about 300 mm. In an exemplary variation, the width is about 278 mm. A surface area can be calculated based on the length and width of the bottom wall 32*e*. For example, the surface area of the bottom wall 32*c* can be between about 0.05 square meters and about 1 square meter, about 0.1 square meters and about 0.5 square meters, or about 0.1 square meters and about 0.2 square meters. In an exemplary variation, the surface area of the bottom wall 32*e* can be about 0.151 square meters. A person skilled in the art will appreciate that a value may not be precisely at a certain value but nevertheless considered to be about that value for any number of reasons, such as manufacturing tolerances or sensitivity of measurement equipment.

In an exemplary embodiment, the upper housing 32 (e.g., the front wall 32*a*, the back wall 32*b*, the left side wall 32*c*, the right side wall 32*d*, and the bottom wall 32*c*) is formed of polypropylene. In an exemplary embodiment, the upper housing 32 is rigid, such as when formed of polypropylene, which may help provide structural integrity to the insulated container 10.

The main chamber 14 defined by the upper housing 32 is a single cavity. The insulated container 10 includes a first divider wall 36 disposed in the main chamber 14 that divides the single cavity of the main chamber 14 into first and second compartments 14*a*, 14*b*. Dividing the main chamber 14 into multiple compartments may improve user experience by allowing item(s) in the main chamber 14 to be more easily located. The first divider wall 36 extends vertically and is substantially planar. The first divider wall 36 is centered laterally in the main chamber 14 so as to divide the main chamber 14 substantially in half such that each of the first and second compartments 14*a*, 14*b* are substantially the same size.

The first divider wall 36 can either be removably disposed in the upper housing 32 or can be non-removably disposed in the upper housing 32. The first divider wall 36 is a separate member from the upper housing 32 in this illustrated embodiment, which may facilitate molding of the upper housing 32, as discussed further below. In some embodiments, the first divider wall 36 is formed integrally with the upper housing 32.

The lower housing 34 has a back wall 34*b*, a left side wall 34*c*, a right side wall 34*d*, and a bottom wall 34*c*. The back wall 34*b*, the left side wall 34*c*, the right side wall 34*d*, and the bottom wall 34*c* define the drawer chamber 16. Each of the back wall 34*b*, the left side wall 34*c*, and the right side wall 34*d* of the lower housing 34 extends vertically and is substantially planar. The bottom wall 34*c* of the lower housing 34 extends horizontally and is substantially planar. In an exemplary embodiment, each of the back wall 34*b*, the left side wall 34*c*, the right side wall 34*d*, and the bottom wall 34*c* have a thickness in a range of about 2.5 to about 3.5 mm.

In an exemplary embodiment, the lower housing 34 (e.g., the back wall 34*b*, the left side wall 34*c*, the right side wall 34*d*, and the bottom wall 34*c*) is formed of polypropylene. In an exemplary embodiment, the lower housing 34 is rigid, such as when formed of polypropylene, which may help provide structural integrity to the insulated container 10.

The lower housing 34 has an open top. With the lower housing 34 attached to the upper housing 32, the bottom wall 32*e* of the upper housing 32 defines a top of the drawer chamber 16, as shown in FIGS. 4-7. The bottom wall 32*e* is non-porous such that liquid or other material cannot enter the drawer chamber 16 (or the drawer 12 therein) from the main chamber 14 through the bottom wall 32*c*. The bottom wall 32*e* is configured to allow the cooling agent in the main chamber 14 to cool the one or more items contained in the drawer chamber 16. e.g., in the drawer 12 received in the drawer chamber 16. The bottom wall 32*e* being formed of polypropylene and having a thickness in a range of about 2.5 to about 11 mm allows the bottom wall 32*e* to be thick enough to provide durability and thin enough to provide effective cooling therethrough from the main chamber 14 to the drawer chamber 16, e.g., to allow a typical cooling agent in the main chamber 14 to cool the drawer chamber 16 (and thus the drawer 12 therein) to below about 40° F.

The bottom wall 32*e* can, as in this illustrated embodiment, be configured to be strong enough that the bottom wall 32*c* resists deflecting downward into the drawer chamber 16, even under the weight of the cooling agent and items located in the main chamber 14. In some embodiments, the bottom wall 32*c* can, as in this illustrated embodiment, be configured to be strong enough, in combination with the load-bearing strength of second divider wall 38, that the bottom wall 32*e* resists deflecting downward into the drawer chamber 16, even under the weight of the cooling agent and items located in the main chamber 14. Being formed from a rigid material, such as when formed of polypropylene, is configured to help provide strength to the bottom wall 32*c*. Additionally, with the bottom wall 32*e* being formed of polypropylene, instead of a metal, the conductive properties of polypropylene are configured to, if the drawer 12 is opened, help prevent the bottom wall 32*e* from rapidly heating from warm or hot air in the drawer chamber 16 and/or the drawer 12 and conducting warm energy to the main chamber 14 from the drawer chamber 16. The bottom wall 32*e* being formed of polypropylene may also prevent the bottom wall 32*e* from rapidly heating from warm or hot air in the main chamber 14 is the lid 20 is opened, and thus help prevent conducting warm energy to the drawer chamber 16 from the main chamber 14, but the bottom wall 32*e* is less susceptible to rapid heating if the lid 20 is opened than if the drawer 12 is opened because of the cooling agent located in the main chamber 14 and because gravity tends to settle the cooling agent on or toward the bottom wall 32*c*. Accordingly, the insulated container can be made of a material having thermal properties suitable for the heat transfer described herein. For example, the bottom wall 32*e* can have a thermal conductivity between about 0.1 W/m K and about 0.5 W/m K, about 0.2 W/m K and about 0.3 W/m K, or about 0.3 W/m K or less. In an exemplary variation, the bottom wall 32*c* can have a thermal conductivity of about 0.2 W/m K.

The structural rigidity of the bottom wall 32*e*, or any other wall described herein, can be quantified using physical tests and/or computational analysis. For example, finite element analysis can be used to calculate one or more of a deformation magnitude, von Mises stress, plastic strain, and any other structural characteristic. In an exemplary variation, the bottom wall 32*c*, which can be integrally formed with one or more of the front wall 32*a*, the back wall 32*b*, the left side wall 32*c*, the right side wall 32*d*, can be formed of polypropylene. Polypropylene typically has a density of about 900 kg/m3, an clastic modulus of about 1000 MPa, a Poisson's ratio of about 0.4, a yield strength of about 22 MPa, and an elongation at failure of about 200%. Structural tests can be performed based on a variety of use cases. The performance of the insulated containers described herein, including the bottom wall 32*e* or any other bottom wall in accordance with the description provided herein, can be evaluated under a static load condition and/or a dynamic load condition. For example, a static force, such as a force due to a plurality of cans, a fluid, or any other object positioned within the main chamber 14, can be applied to a top surface of the bottom wall 32*e*. The force can be between about 0.01 kPa and about 5 kPa, about 0.5 kPa and about 3 kPa, or about 1 kPa and about 2 kPa. The bottom wall 32*e* can be configured to elastically and/or inelastically deform without failing (e.g., rupturing, breaking, forming a hole therethrough). The amount of deformation can be characterized using Equation 1:

$$DF = \frac{D_{max,wall}}{t_{wall}} \qquad \text{Equation 1}$$

In Equation 1, a deformation factor (DF) is calculated based on a maximum deformation of the bottom wall 32*c*, $D_{max,wall}$, and a thickness of the bottom wall 32*e*, $t_{wall}$. A relatively higher DF value can indicate a greater amount of deflection per unit thickness, and a relatively lower DF value can indicate a lesser amount of deflection per unit thickness. The insulated containers described herein are configured to have an optimal DF value (e.g., below a DF value of about 5) while maintaining a relatively low mass so that the user can easily maneuver the insulated container and optimal thermal conductivity properties to facilitate cooling of one or more objects contained therein without transferring heat to an external environment.

Figure 5:
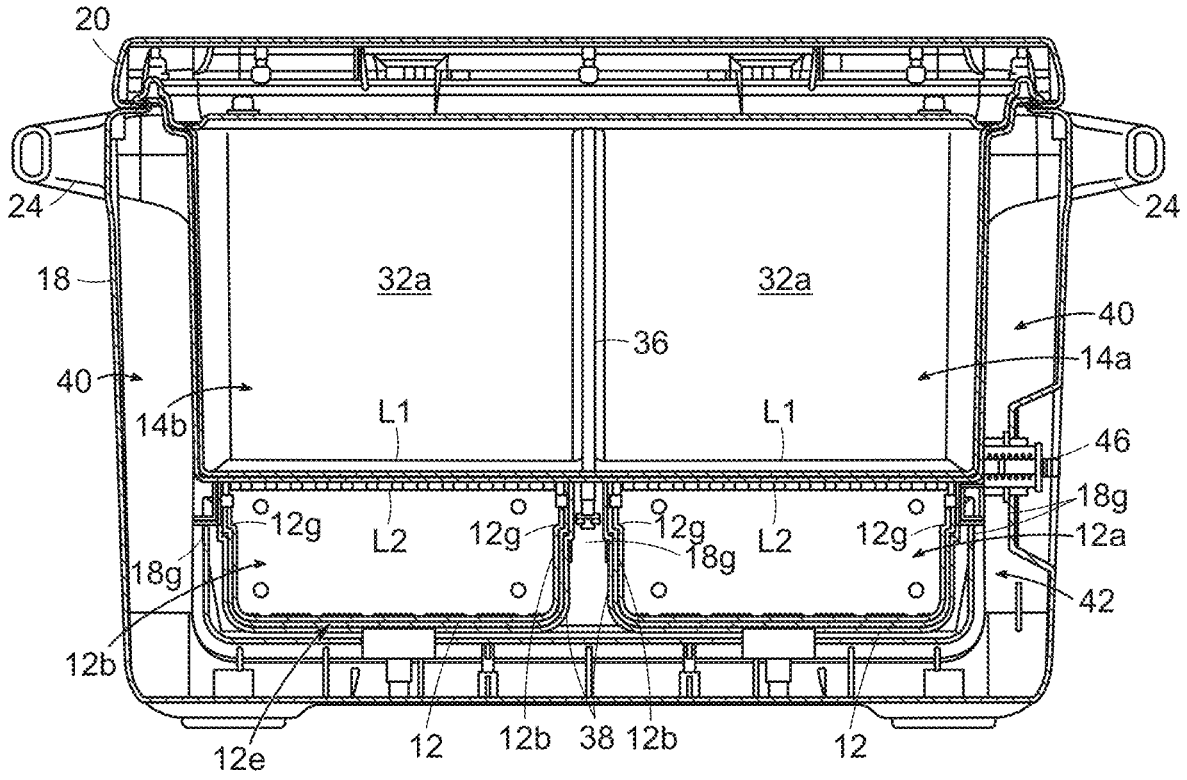
FIG. 5 is a back side cross-sectional view of the insulated container of FIG. 1.
Figure 7:
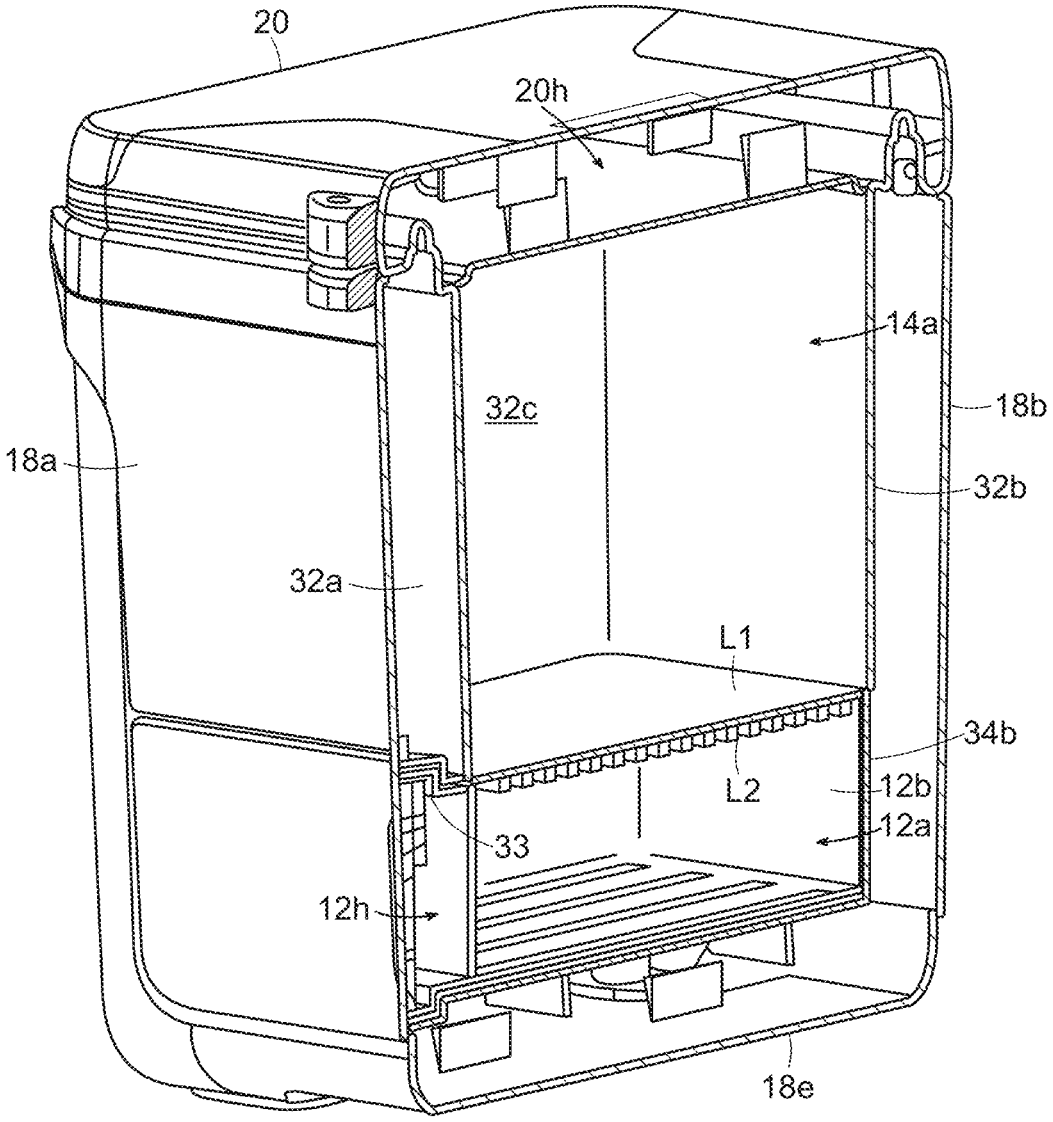
FIG. 7 is a yet another perspective cross-sectional view of the insulated container of FIG. 1.
Figure 11:
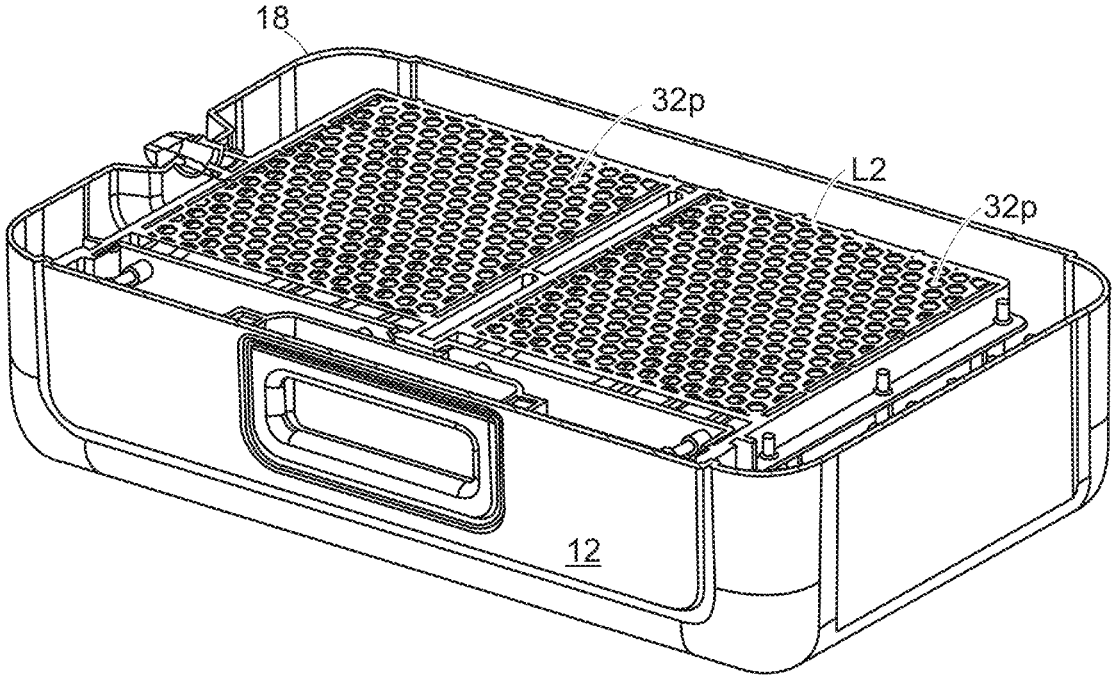
FIG. 11 is a yet another perspective cross-sectional view of the insulated container of FIG. 1.
Figure 12A:
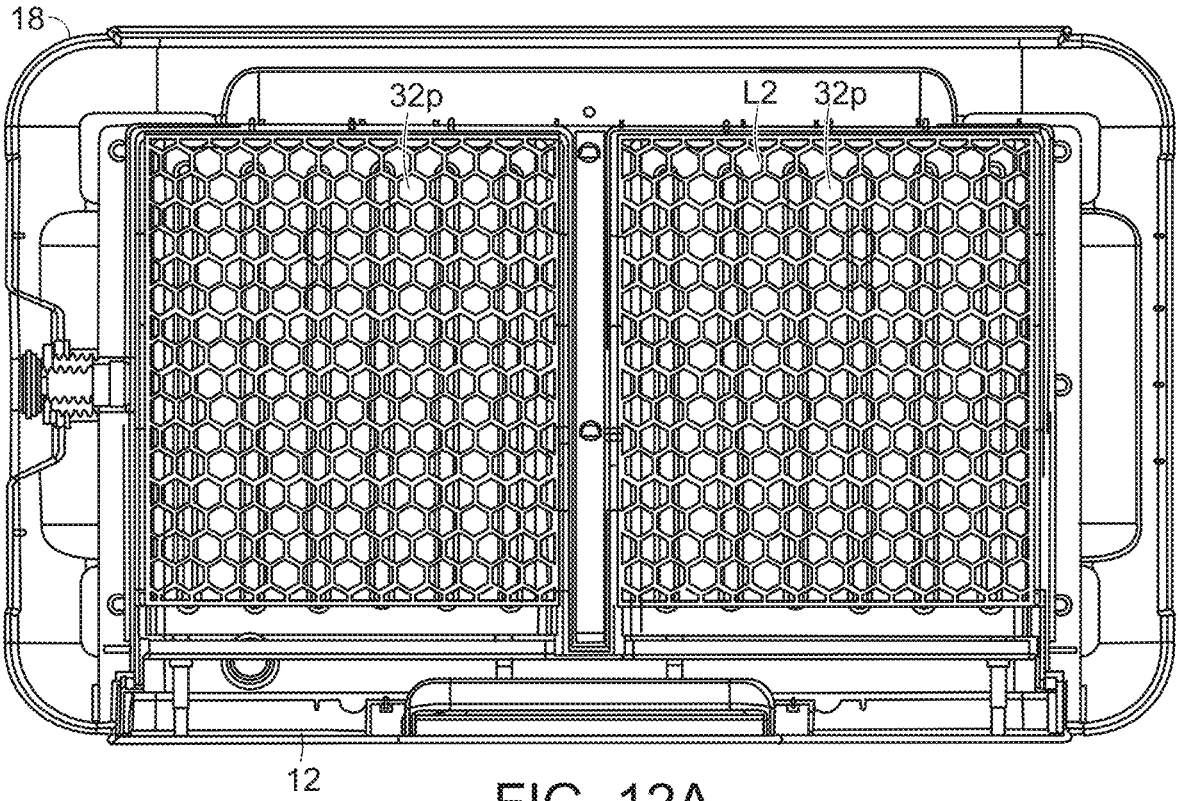
FIG. 12A is another top side cross-sectional view of the insulated container of FIG. 1.
Figure 12B:
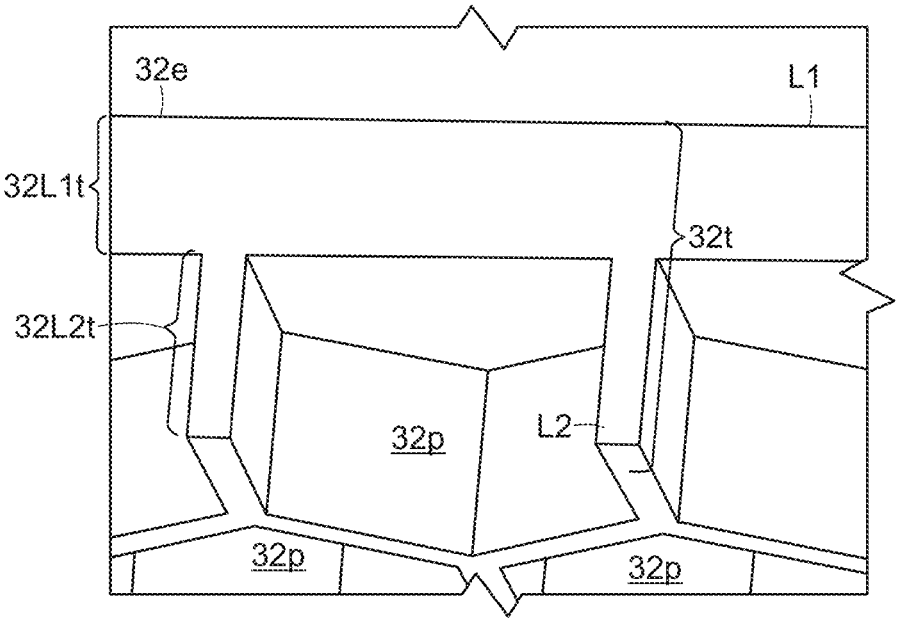
FIG. 12B is a partial perspective side cross-sectional view of the insulated container of FIG. 1.

As in this illustrated embodiment, the bottom wall 32*e* can include a plurality of layers. The layers in this illustrated embodiment includes a first layer L1, which may be referred to as a top surface, and a second layer L2, which may be referred to as a bottom surface, disposed vertically below the first layer L1, as shown in FIGS. 5-7. The first layer L1, which may also be referred to as a floor, defines a top of the bottom wall 32*e* and faces the main chamber 14. The second layer L2 defines a bottom of the bottom wall 32*c* and faces the drawer chamber 16 (and thus also the drawer 12 received in the drawer chamber 16). The first layer L1 of the bottom wall 32*c* is a non-porous member. The second layer L2 of the bottom wall 32*e* is a porous member having a plurality of pores 32*p* formed therein, as shown in FIGS. 11, 12A, and 12B. Because the bottom wall 32*e* is non-porous by including the non-porous first layer L1, liquid and other matter in the main chamber 14 cannot pass into the drawer chamber 16 (or the drawer 12 received in the drawer chamber 16) through the bottom wall 32*e*. The non-porous first layer L1 being located vertically above the porous second layer L2 helps prevent any liquid or other matter in the main chamber 14 from collecting in or passing through the pores 32*p*. In other words, the non-porous first layer L1 acts as a barrier to the porous second layer L2. The layers L1, L2 of the bottom wall 32*c* can be manufactured as a single piece, such that the layers L1, L2 cannot be separated.

Each of the pores 32*p* in this illustrated embodiment has a hexagonal cross-sectional shape. Some of the pores 32*p* along edges of the second layer L2 may have truncated hexagonal shapes depending on a size and shape of the hexagonal shapes and a size and shape of the bottom wall 32*c*. The bottom wall 32*e* thus includes a plurality of hexagonal ribs that define a hexagonal rib structure in a honeycomb pattern, as shown in FIGS. 11, 12A, and 12B. Each of the pores 32*p* thus define a channel (e.g., groove, depression, cavity) therein and/or between adjacent pores 32*p*. Therefore, an outer surface of each pore 32*p* extends beyond an outer surface of the respective channel. The hexagonal rib structure may increase durability of the bottom layer 32*c* and reduce vertical deflecting of the bottom wall 32*e* downward under a load of the cooling agent and the item(s) in the main chamber 14 without having to increase overall thickness of the bottom wall 32*c* above about 11 mm, thereby reducing overall weight of the insulated container 10 and overall cost of the insulated container 10. Although the pores 32*p* each have a hexagonal shape in this illustrated embodiment, other cross-sectional shapes may be used, e.g., rectangular, pentagonal, octagonal, etc. The hexagonal shape can have a variety of dimensions. In some variations, each pore can have a length between about 5 mm and about 20 mm, such as about 14 mm. Each pore can have a width between about 0.5 mm and about 2 mm, such as about 1 mm. Each pore can have a height between about 2 mm and about 10 mm.

The thickness of the bottom wall 32*e* described herein (and illustrated in FIG. 12B as 32*t*) includes the pore depth 32L2*t* (which may be referred to as a rib height). The thickness 32*t* can range from about 7 mm to about 11 mm. For example, the overall thickness can range from 7.7 mm to 10.3 mm. In the exemplary embodiment of the bottom wall 32*e* that includes a varying thickness, the pore depth 32L2*t* also varies. The pore height 32L2*t* can range from about 4 mm to about 8 mm. For example, the first portion of the bottom wall 32*e* having the first thickness includes a first pore depth and the second portion of the bottom wall 32*e* having the second thickness includes a second pore depth. The first pore depth is about 7.3 mm and the second pore depth is about 4.7 mm. The pores 32*p* positioned between the first and second portions can have a gradually decreasing height, such that the pores 32*p* decrease at a constant rate from the first height to the second height. In the exemplary embodiment of the bottom wall 32*e* with a varying thickness, a thickness 32L1*t* of the layer L1 remains constant. In particular, the thickness 32L1*t* of the layer L1 (e.g., a distance between a top surface of the layer L1, which is substantially smooth, and the surface of the channels defined by the pores 32*p*) can range from about 2.5 mm to about 3 mm. For example, the thickness 32L1*t* of the layer L1 can be 2.9 mm. Therefore, a first thickness that includes the first pore depth is about 10.3 mm and a second thickness that includes the second pore depth is about 7.7 mm. Accordingly, the first and second thicknesses, and any thickness between, is greater than the distance between the top surface of the layer L1 and the surface of the channels. Advantageously, the thicknesses being a larger amplitude than the distance facilitates increased structural rigidity of the bottom wall 32*e* while minimizing mass. In particular, the ratio of the thicknesses to the distance described herein facilitates greater resistance to deformation per unit mass than a solid material, such as the solid material that extends along the distance between the top surface of the layer L1 and the surface of the channels. In other words, a variation where the thickness is equal to, or less than, the distance, as defined herein, would have relatively greater deformation and/or relatively larger mass than the embodiments described herein. Additionally, the change in thickness of the bottom wall 32*c* is attributable to changes in the pore depth. Accordingly, the pore depth described herein can affect the DF value, such as by providing structural rigidity to the bottom wall 32*c* without adding significant mass, which may otherwise make it difficult for a user to maneuver the insulated container and/or negatively impact the heat transfer characteristics between the upper and lower housings 32, 34.

Bottom wall deflection testing, under a modelled force of 224 N applied to a bottom wall from within a main chamber (defined by an upper housing formed of polypropylene), has shown that the bottom wall deflects vertically downward less when the bottom wall includes a hexagonal rib structure as a second layer similar to the second layer L2 of the bottom wall 32*e* than when the bottom wall does not include a hexagonal rib structure. Further examples of deflection testing are provided with reference to FIGS. 27A-42B.

The lower housing 34, and thus the drawer chamber 16, has an open front in which the drawer 12 is configured to be received. In some embodiments, the drawer 12 is removably received in the drawer chamber 16 such that the drawer 12 can be removed from the drawer chamber 12, which may facilitate cleaning of the drawer 12. In some embodiments, the drawer is non-removably received in the drawer chamber 16, which may help prevent loss of and/or damage to the drawer 12.

The drawer chamber 16 defined by the lower housing 34 is a single cavity configured to receive the drawer 12 therein. The drawer 12 is configured to move between a closed configuration, in which the drawer chamber 16 is sealed closed, and an open configuration, in which the drawer chamber 16 is not sealed closed and any item(s) removably contained in the drawer 12 are accessible to a user. The drawer 12 in this illustrated embodiment includes first and second compartments 12*a*, 12*b* that are separate from one another. The drawer 12 having multiple compartments may improve user experience by allowing item(s) in the drawer 12 to be more easily located and/or may help lessen shifting of item(s) in the drawer 12 during transit of the insulated container 10. In other embodiments, the drawer 12 can have a single compartment or can have more than two compartments.

In an exemplary embodiment, the drawer 12 is formed of polypropylene. In an exemplary embodiment, the drawer 12 is rigid, such as when formed of polypropylene, which may help provide structural integrity to the drawer 12 and to the insulated container 10 with the drawer 12 coupled thereto.

The back wall 34*b* of the lower housing 34 is not a planar member extending vertically in a single plane like each of the left side wall 34*c*, the right side wall 34*d*, and the bottom wall 34*c* of the lower housing 34. Instead, the back wall 34*b* of the lower housing 34 has a U-shaped vertical extension formed therein that defines a second divider wall 38 that extends vertically, as shown in FIGS. 4, 5, 13, and 14. The second divider wall 38 is centered laterally. The second divider wall 38 is located below and can, as in this illustrated embodiments, be vertically aligned with the first divider wall 36. The second divider wall 38 being vertically aligned with the first divider wall 36 may help provide durability and strength to the insulated container 10, for example, by providing load-bearing support to the bottom wall 32*c*. In some variations, the second divider wall 38 can extend across a portion of a width of the bottom wall 32*e*. For example, the second divider wall 38 can extend up to about 0.25 of the bottom wall width, up to about 0.5 of the bottom wall width, up to about 0.75 of the bottom wall width, the entire width of the bottom wall width, or between about 0.25 and about 0.75 of the bottom wall width. In an exemplary variation, the second divider wall 38 extends across, and thus directly supports, about 0.5 of the bottom wall width. In another exemplary variation, the second divider wall 38 extends across, and thus directly supports, the entire bottom wall width.

Figure 14:
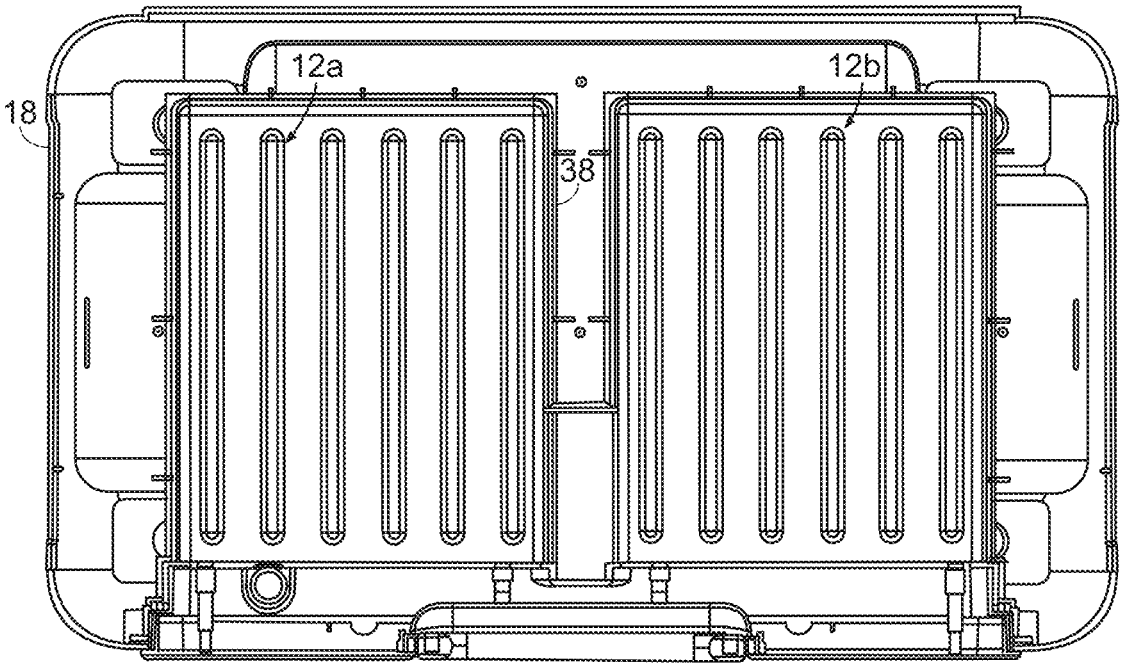
FIG. 14 is another top side cross-sectional view of the insulated container of FIG. 1.

The first divider wall 36 extends a complete distance from the back wall 32*b* of the upper housing 32 to the front wall 32*a* of the upper housing 32. Conversely, in this illustrated embodiment, the second divider wall 38 extends a partial distance from back to front, as shown in FIGS. 13 and 14. In an exemplary embodiment, the partial distance is about a half distance from back to front.

The bottom wall deflection testing described above has shown that the second divider wall extending a complete distance from back to front, a so-called "full divider," provides very little additional benefit in terms of deflection. Thus, the second divider wall 38 extending about a half distance from back to front, a so-called "half divider," may provide reduced deflection as compared to no second divider wall being present while allowing for less material to be used in formed the lower housing 34, and thus allowing for a lower cost of the lower housing 34.

To account for the presence of the second divider wall 38, a back wall 12*b* of the drawer 12 is not a planar member extending vertically in a single plane like each of the drawer's left side wall 12*c*, the right side wall 12*d*, and the bottom wall 12*c*. Instead, the back wall 12*b* of the drawer 12 has a U-shaped vertical extension formed therein having a shape and size corresponding to the second divider wall 38, as shown in FIGS. 5, 6, 13, and 14. With the drawer 12 fully slid into the drawer chamber 16, a back-facing surface of the drawer 12 defined by the back wall 12*b* is configured to abut a front-facing surface of the second vertical substantially planar divider wall 38. FIGS. 13 and 14 show the abutting of these surfaces.

Figure 4:
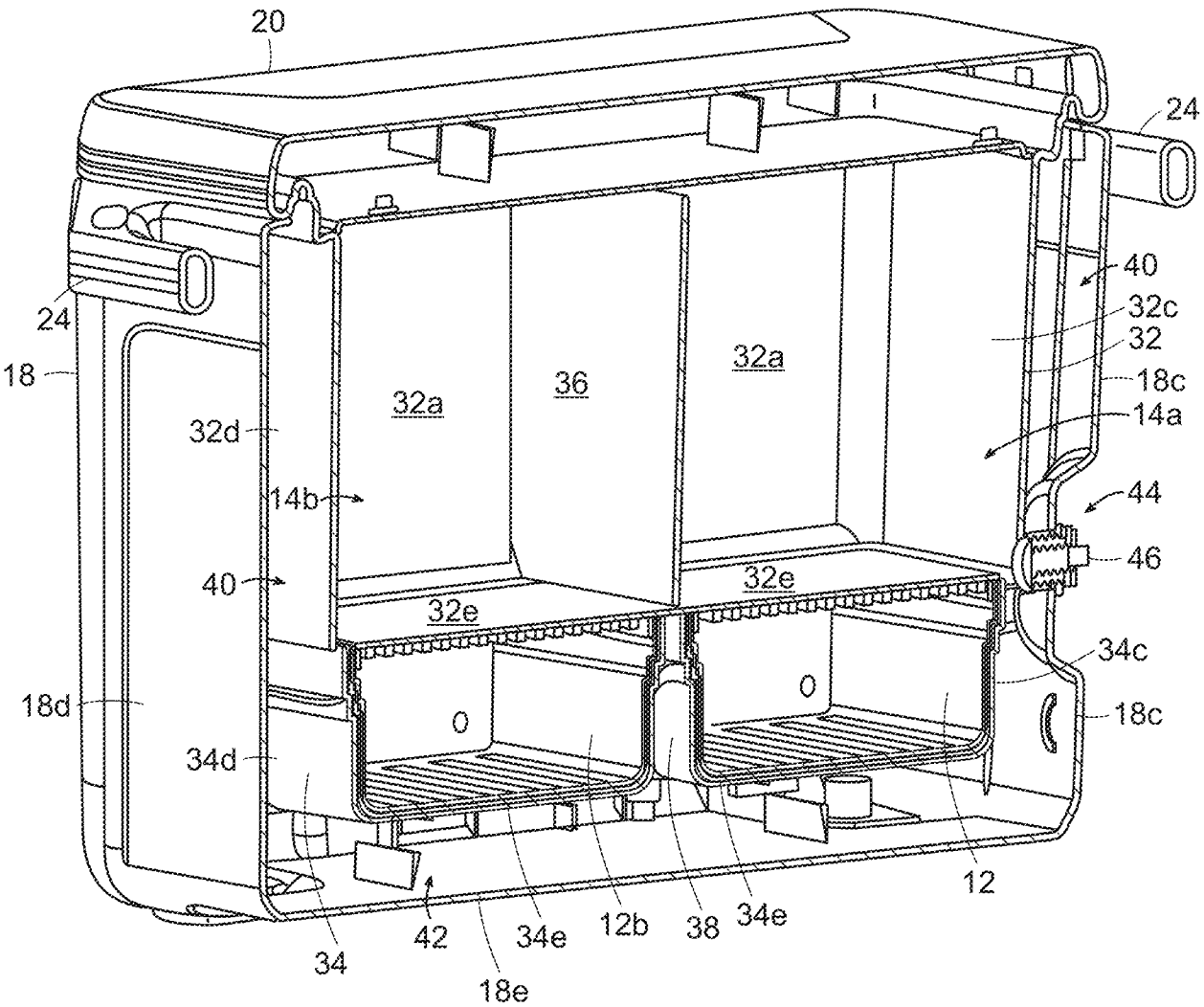
FIG. 4 is a perspective cross-sectional view of the insulated container of FIG. 1.

As mentioned above, the upper and lower housings 32, 34 are configured to be non-removably attached to one another and to be contained within the outer housing 18. With the upper and lower housings 32, 34 in the outer housing 18, a first space 40 is defined between the outer housing 18 and the upper housing 32, e.g., between an interior surface of the outer housing 18 and an exterior surface of the upper housing 32, and a second space 42 is defined between outer housing 18 and the lower housing 34, e.g., between the interior space of the outer housing 18 and an exterior surface of the lower housing 34. As shown in FIGS. 4-6, the first and second spaces 40, 42 are continuous with one another since the upper and lower housings 32, 34 are attached to one another.

The first space 40 is configured to be filled with an insulating material configured to insulate the main chamber 14, and the second space 42 is configured to be filled with an insulating material configured to insulate the drawer chamber 16 and thus also the drawer 12 received therein. In an exemplary embodiment, the insulating material is the same throughout the insulating container 10, e.g., polyurethane foam or other insulating material.

The first space 40 extends around the four vertically-extending sides of the upper housing 32 (the front wall 32*a*, the back wall 32*b*, the left side wall 32*c*, and the right side wall 32*d*). The lid 20 has a hollow interior 20*h*, as shown in FIGS. 6 and 7, that is configured to be filled with the insulating material. The main chamber 14 is thus configured to be insulated around its perimeter by the insulating material in the first space 40 and along its top by the insulating material in the lid's hollow interior 20*h*.

The second space 42 extends around the three vertically-extending sides of the lower housing 34 (the back wall 34*b*, the left side wall 34*c*, and the right side wall 32*d*) and below the bottom wall 34*c* of the lower housing 34. The drawer 12 has a hollow front space 12*h*, as shown in FIGS. 6, 7, and 13, that is configured to be filled with the insulating material. The drawer chamber 16, and therefore the drawer 12 received in the drawer chamber 16, is thus configured to be insulated along its back and left and right sides by the insulating material in the second space 42 and along its front by the insulating material in the drawer's hollow interior 12*h*.

The insulated container 10 includes a drain 44 configured to facilitate draining of liquid (e.g., water from melted ice, spilled beverage, etc.) from the main chamber 14. As shown in FIG. 4, the drain 44 is in fluid communication with the main chamber 14. The drain 44 is configured to be selectively opened and closed by a user, e.g., by removing a plug 46 sealing the drain 44 closed. With the drain 44 closed, liquid in the main chamber cannot exit out of the main chamber 14 through the drain 44 With the drain 44 open, liquid can exit out of the main chamber 14, and thus out of the insulated container 10, through the drain 44. The drain 44 is formed in a left side of the insulated container 10 in this illustrated embodiment, e.g., extends through the left side wall 18*c* of the outer housing 18, but can be located elsewhere. Also, the insulated container 10 includes only one drain 44 in this illustrated embodiment but can include multiple drains. In some embodiments, the drain 44 is omitted.

The insulated container 10 includes a drawer lock 48 configured to lock the drawer 12 in the closed configuration. The drawer lock 48 is configured to move between, e.g., be manually moved by a user between, a locked configuration, in which the drawer 12 is locked in the closed configuration, and an unlocked configuration, in which the drawer 12 is allowed to be moved, e.g., be manually moved by a user, from the closed configuration to the open configuration. The drawer 12 can thus be prevented from opening accidentally, which may help prevent any contents of the drawer 12 from spilling out (e.g., during transit of the insulated container 10, if the insulated container 10 is dropped accidentally, etc.) and may help prevent the drawer 12 from accidentally being unsealed and thus increasing in temperature. FIGS. 1, 2, 6, and 8 show the drawer lock 48 in the unlocked configuration.

The drawer 12 can, as in this illustrated embodiment include a handle 12*n* configured to be handheld by a user to facilitate opening and closing of the drawer 12. The handle 12*n* in this illustrated embodiment includes a ring pivotally coupled at a top thereof to the outer housing 18. Under the force of gravity the handle 12*n* is urged to be seated in a first depression 50 formed in a front exterior surface of the drawer 12. The handle 12*n* being seated in the first depression 50 can help keep the handle 12*n* out of the way when not in use. The handle 12*n* can have configurations other than a ring, such as a depression formed in the front exterior surface of the drawer 12 and defining a hand or finger hold therein, a knob, etc.

The drawer lock 48 is configured to move vertically between the unlocked and locked configurations. The drawer lock 48 in the unlocked configuration is located vertically above the drawer lock in the locked configuration. In the locked configuration, the drawer lock 48 is seated at least partially in a second depression 52 formed in the front exterior surface of the drawer 12. In the unlocked configuration, the drawer lock 48 is not seated in the second depression 52.

FIGS. 16-19 illustrate another embodiment of an insulated container 100 that includes a drawer 102. The insulated container 100 in this illustrated embodiment is generally configured and used similar to the insulated container 10 of FIGS. 1-15, e.g., includes a drawer 102 having two compartments, a drawer handle 102*n*, a main chamber 104, a drawer chamber (obscured in the figures), an outer housing 108, a lid 120, lock holes 120*h* of the lid 120, locks holes 108*h* of the outer housing 108, a lid lock 121, opposed side handles 124, a front handle 130, an upper housing 132, a lower housing (obscured in the figures), a vertically-extending divider wall (obscured in the figures) of the lower housing, insulating material (obscured in the figures), a drain 144, and a vertically-movable drawer lock 148.

Figure 16:
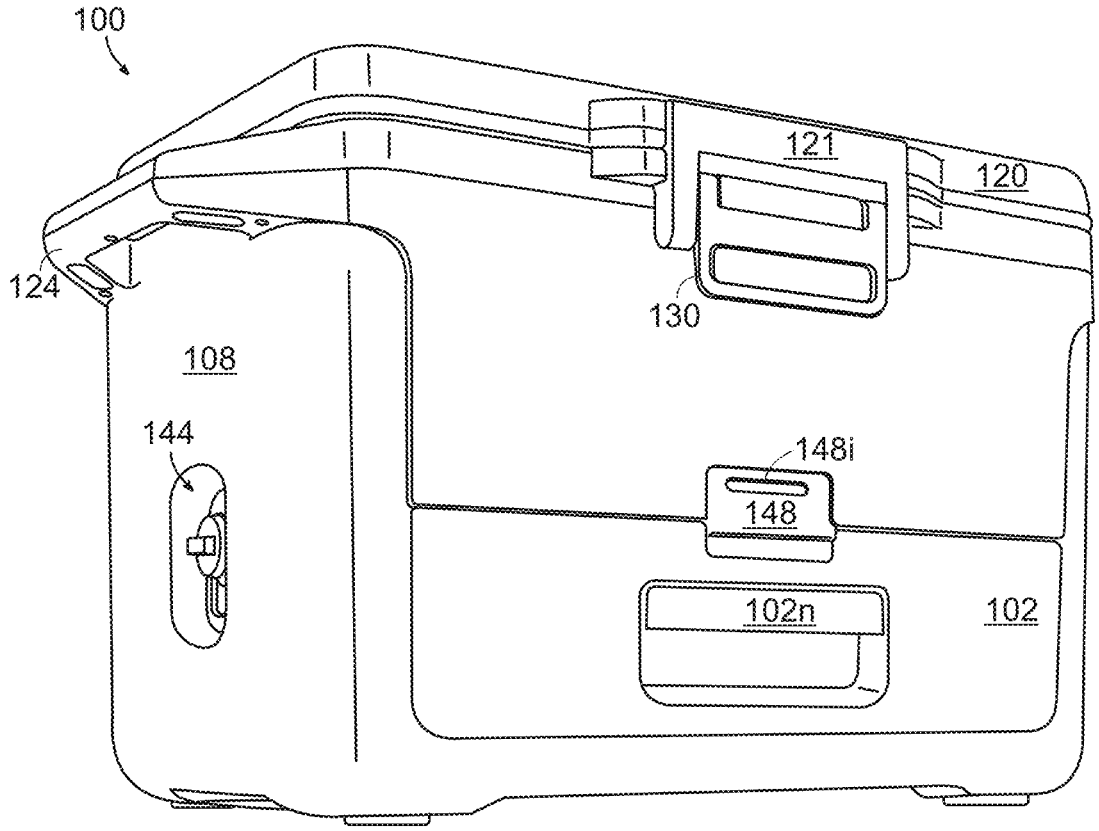
FIG. 16 is a perspective view of another embodiment of an insulated container.
Figure 17:
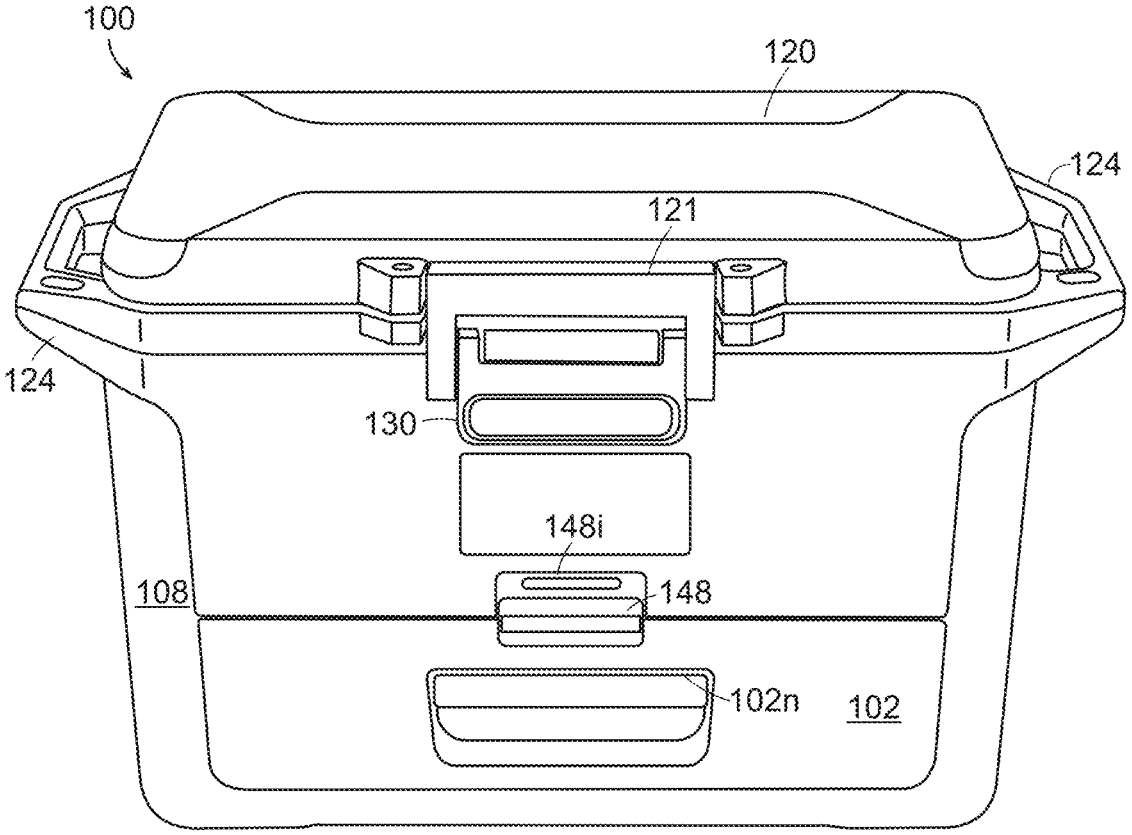
FIG. 17 is another perspective view of the insulated container of FIG. 16.
Figure 18:
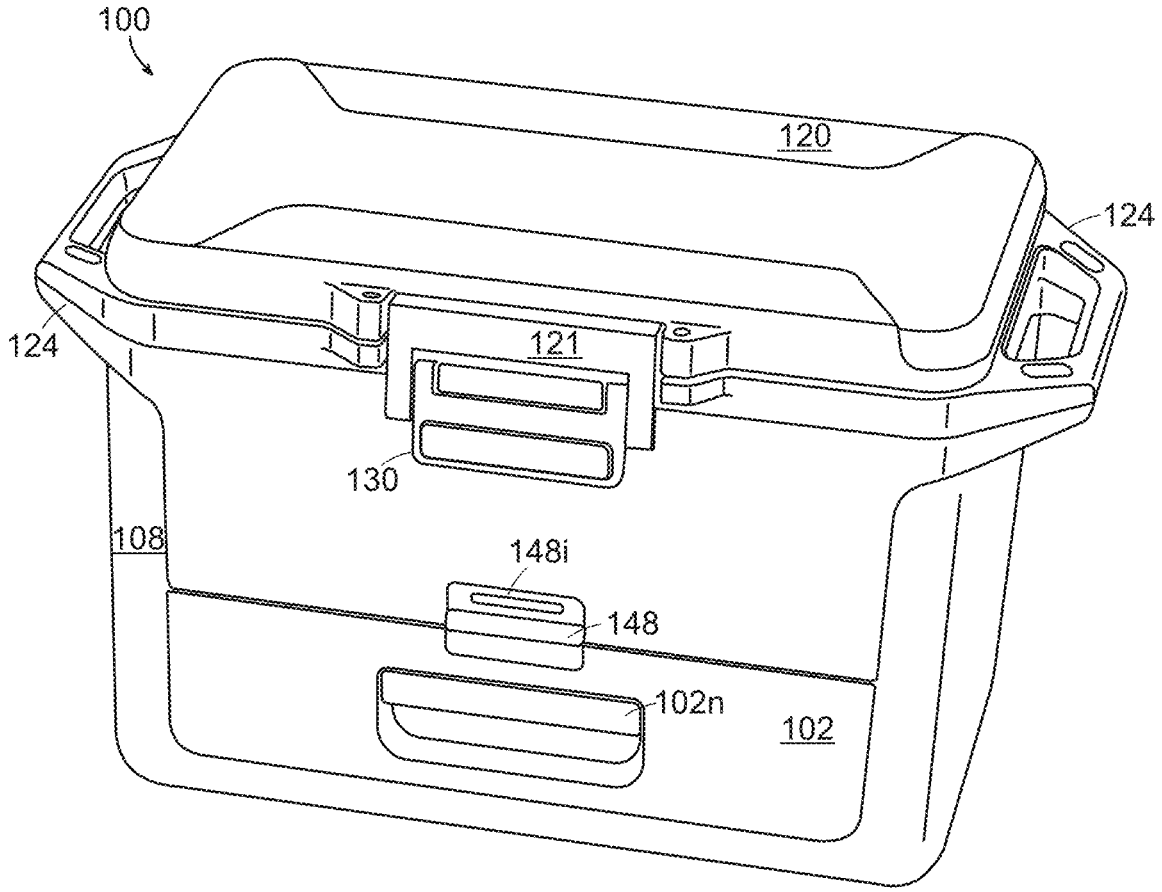
FIG. 18 is yet another perspective view of the insulated container of FIG. 16.
Figure 19:
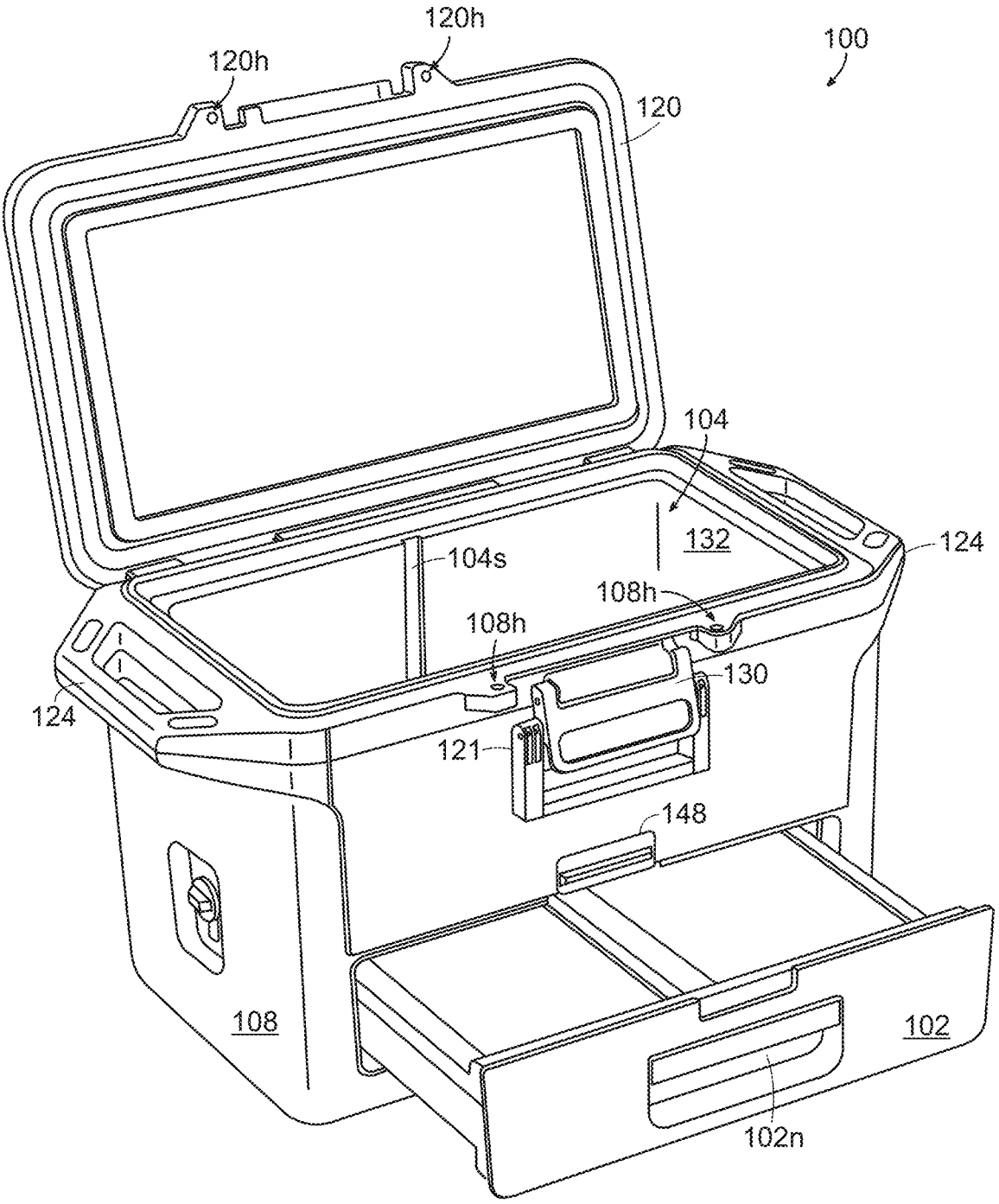
FIG. 19 is a perspective view of the insulated container of FIG. 16 with a lid open and a drawer open.

FIGS. 16-18 show each of the lid 120 and the drawer 102 closed, and FIG. 19 shows each of the lid 120 and the drawer 102 open. FIGS. 16-18 each show the lid lock 121 in the locked configuration, and FIG. 19 shows the lid lock 121 in the unlocked configuration. FIGS. 16-18 each show the drawer lock 148 in the locked configuration, and FIG. 19 shows the drawer lock 148 in the unlocked configuration. The drawer lock 148 in this illustrated embodiment includes an indicator 148*i* configured to indicate whether the drawer lock 148 is locked. The indicator 148*i* can have a variety of configurations, e.g., a color, text, a symbol, a light, etc. In this illustrated embodiment, the indicator 148*i* includes an area of the outer housing 108 in a first color that is configured to be visible with the drawer lock 148 in the locked configuration and that is configured to not be visible with the drawer lock 148 in the unlocked configuration. The first color is a different color than a color of the outer housing 108 at least in an area immediately surrounding the first color. The indicator 148*i* is therefore visible in FIGS. 16-18 and is not visible in FIG. 19.

The drawer handle 102*n* in this illustrated embodiment includes a depression formed in the front exterior surface of the drawer 102 and defining a hand or finger hold therein.

In this illustrated embodiment, the insulated container 100 does not include a vertically-extending divider wall in the main chamber 104. However, the main chamber 104 has a slot 104*s* formed therein in which a vertically-extending divider wall similar to the first divider wall 36 can be selectively received.

Figure 20:
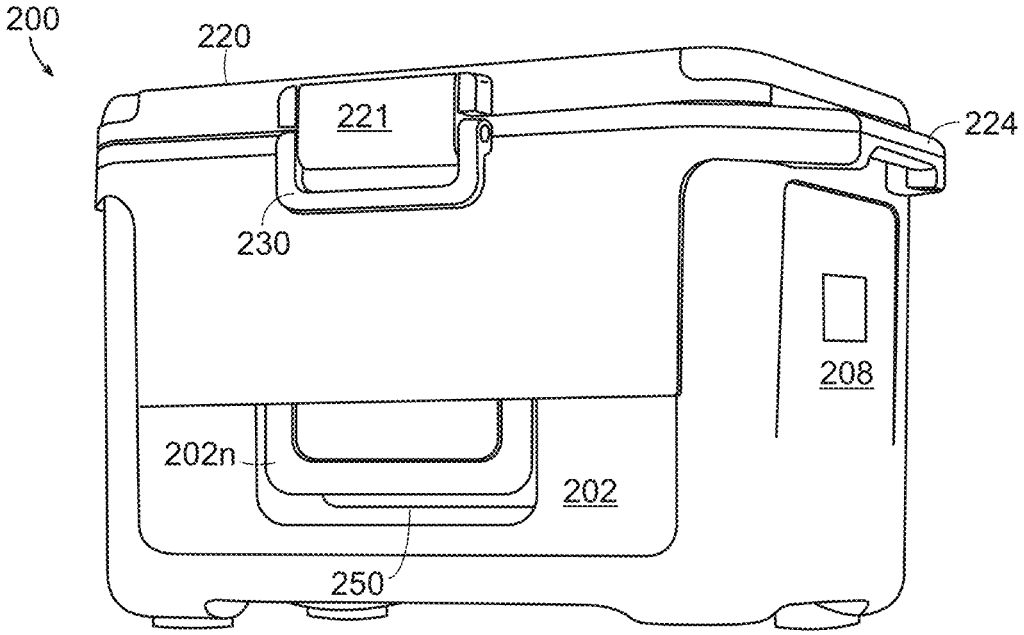
FIG. 20 is a perspective view of another embodiment of an insulated container.
Figure 21:
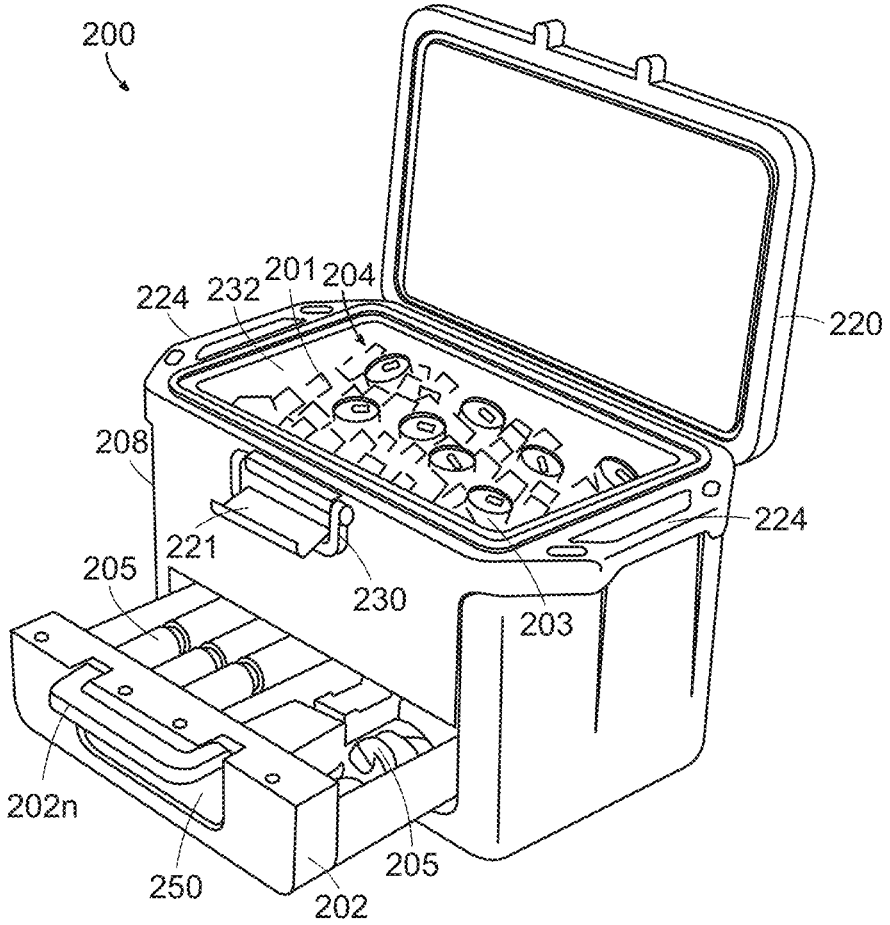
FIG. 21 is a perspective view of the insulated container of FIG. 20 with a lid open and a drawer open.

FIGS. 20 and 21 illustrate another embodiment of an insulated container 200 that includes a drawer 202. The insulated container 200 in this illustrated embodiment is generally configured and used similar to the insulated container 10 of FIGS. 1-15, e.g., includes a drawer 202 having two compartments, a drawer handle 202*n*, a main chamber 204, a drawer chamber (obscured in the figures), an outer housing 208, a lid 220, a lid lock 221, opposed side handles 224, a front handle 230, an upper housing 232, a lower housing (obscured in the figures), a vertically-extending divider wall (obscured in the figures) of the lower housing, a drawer lock, and insulating material (obscured in the figures).

Figure 22:
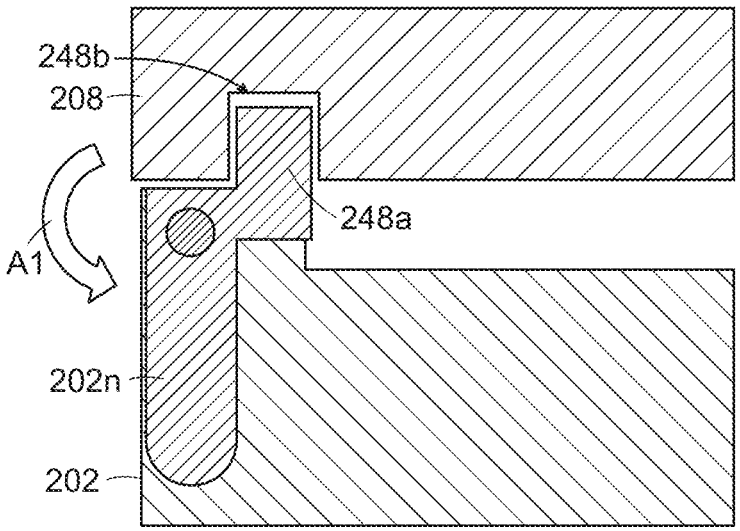
FIG. 22 is a schematic view of a drawer lock of the insulated container of FIG. 20 with the drawer lock in a locked configuration.
Figure 23:
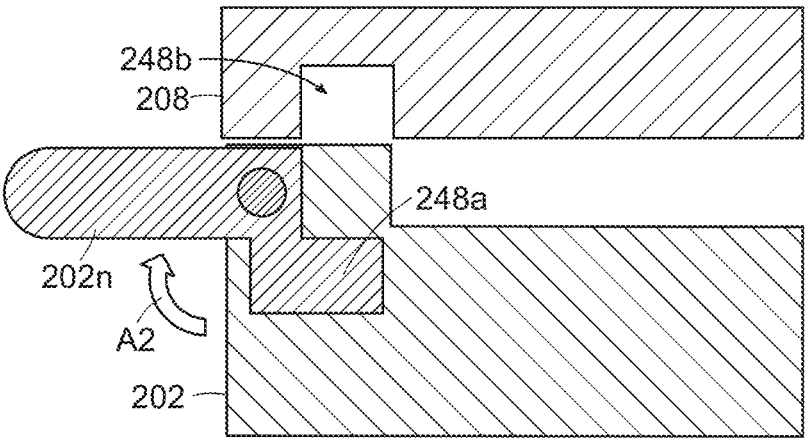
FIG. 23 is a schematic view of the drawer lock of FIG. 22 with the drawer lock in an unlocked configuration.

FIG. 20 shows each of the lid 220 and the drawer 202 closed, and FIG. 21 shows each of the lid 220 and the drawer 202 open. FIGS. 20 and 22 show the drawer lock in the locked configuration, and FIGS. 21 and 23 show the drawer lock in the unlocked configuration. The drawer lock in this illustrated embodiment includes a protrusion 248*a* extending from the drawer handle 202*n* and a first depression 248*b* formed in the outer housing 208. As shown in FIGS. 22 and 23, the drawer handle 202*n* is pivotally attached to the outer housing 208. The drawer handle 202*n* is configured to rotate in a first direction, e.g., counterclockwise as shown by an arrow A1 in FIG. 22, to move the drawer lock from the unlocked configuration to the locked configuration. With the drawer lock in the locked configuration, the protrusion 248*a* is seated in the first depression 248*b* and the drawer handle 202*n* is seated in a second depression 250 formed in a front exterior surface of the drawer 202. The protrusion 248*a* being seated in the first depression 248*b* prevents the drawer 202 from sliding or being pulled out of the outer housing 208. The drawer handle 202*n* is configured to rotate in a second, opposite direction, e.g., clockwise as shown by an arrow A2 in FIG. 23, to move the drawer lock from the locked configuration to the unlocked configuration. With the drawer lock in the unlocked configuration, the protrusion 248*a* is not seated in the first depression 248*b* and the drawer handle 202*n* is not seated in the second depression 250. The drawer 202 is thus free to slide or be pulled out of the outer housing 208.

Figure 24:
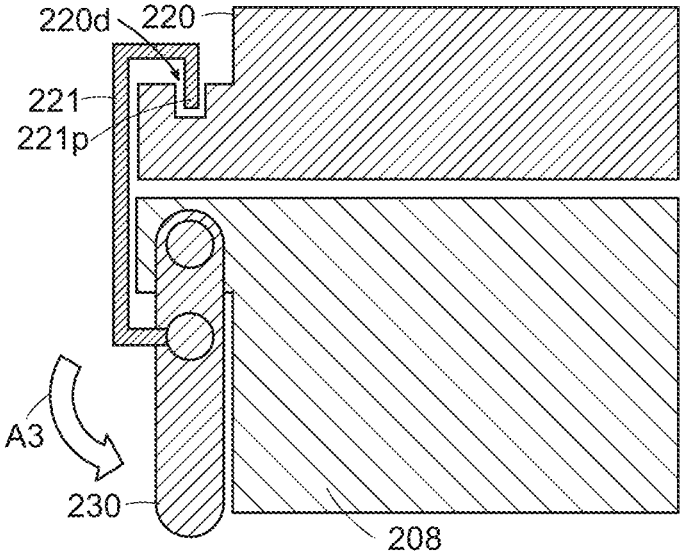
FIG. 24 is a schematic view of a lid lock of the insulated container of FIG. 20 with the lid lock in a locked configuration.
Figure 25:
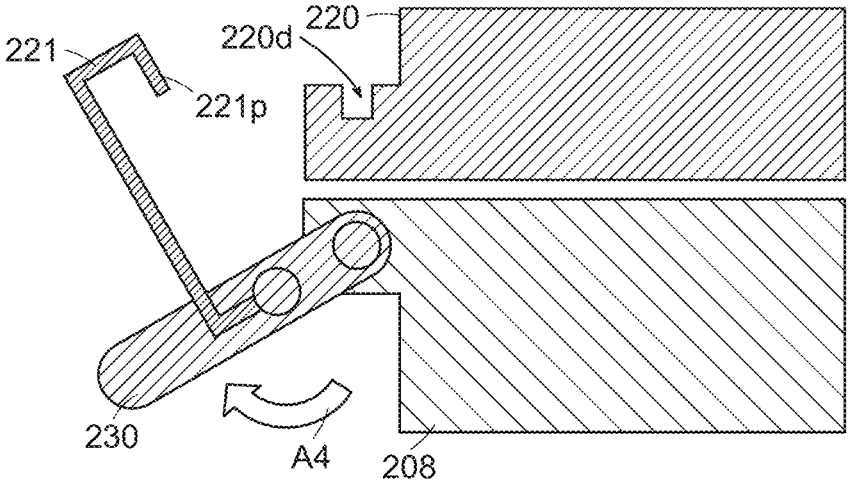
FIG. 25 is a schematic view of the lid lock of FIG. 24 with the lid lock in an unlocked configuration.

FIGS. 20 and 24 shows the lid lock 221 in the locked configuration, and FIGS. 21 and 25 show the lid lock 221 in the unlocked configuration. The lid lock 221 in this illustrated embodiment is configured to be selectively seated in a third depression 220*d* formed in the lid 220. As shown in FIGS. 24 and 25, the lid lock 221 is pivotally attached to the front handle 230, and the front handle 230 is pivotally attached to the outer housing 208. The front handle 230 is configured to rotate in a first direction, e.g., counterclockwise as shown by an arrow A3 in FIG. 24, to move the lid lock 221 from the unlocked configuration to the locked configuration. With the lid lock 221 in the locked configuration, a lip 221*p* of the lid lock 221 is seated in the third depression 220*d*. The lip 221*p* being seated in the third depression 220*d* prevents the lid 220 from opening. The front handle 230 is configured to rotate in a second, opposite direction, e.g., clockwise as shown by an arrow A4 in FIG. 25, to move the lid lock 221 from the locked configuration to the unlocked configuration. With the lid lock 221 in the unlocked configuration, the lip 221*p* is not seated in the third depression 220*d*. The lid 220 is thus free to be opened.

In this illustrated embodiment, the insulated container 200 does not include a vertically-extending divider wall in the main chamber 204. However, the main chamber 204 can have a slot therein similar to the slot 104*s* of FIG. 19.

A cooling agent 201 in the form of ice is shown in the main chamber 204 of the insulated container 200, although another type of cooling agent can be used instead of or in addition to ice. FIG. 21 also illustrates examples of one or more first items 203 contained in the main chamber 204 as metal beverage cans and examples of one or more second items 205 contained in the drawer 202 as metal beverage cans and plastic containers holding food.

Figure 26:
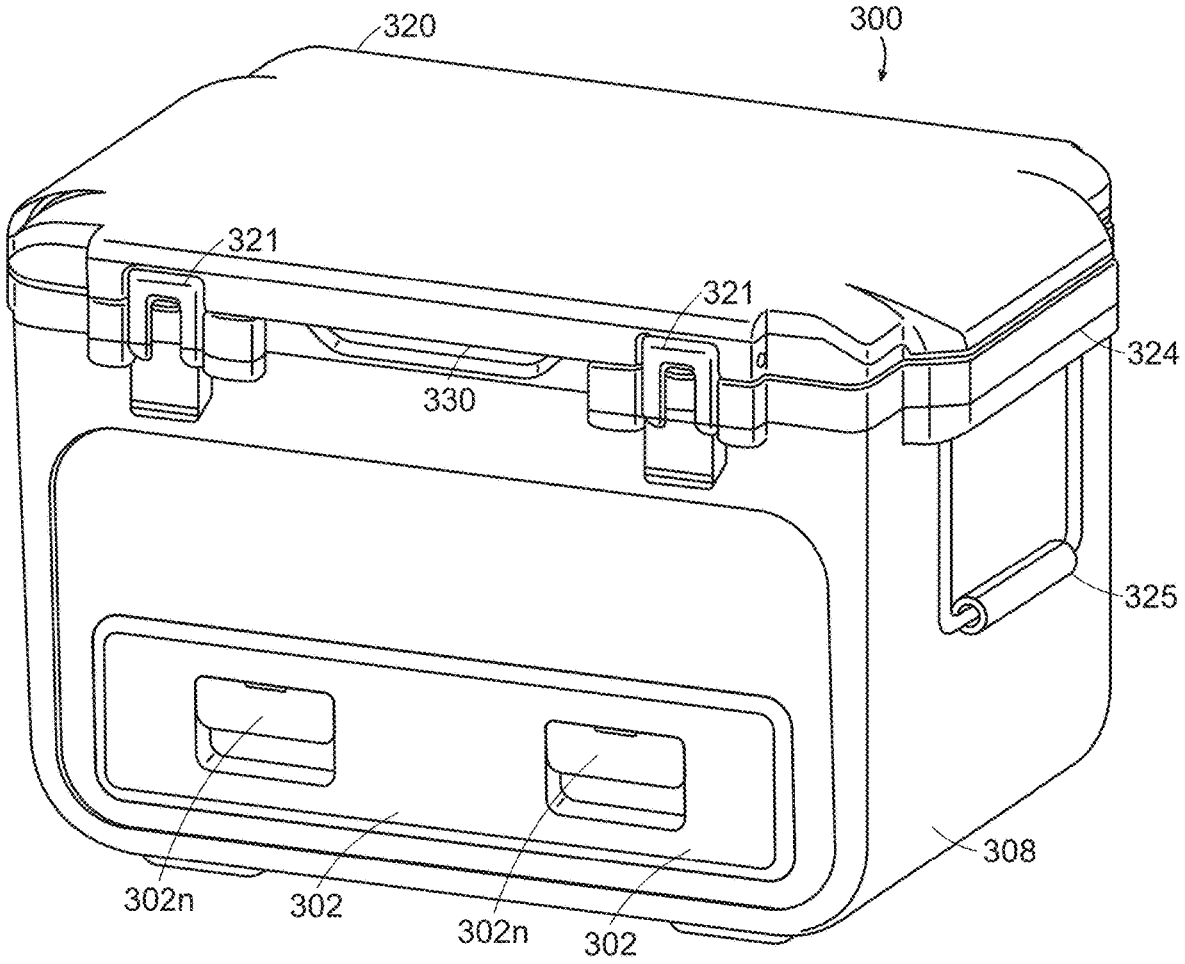
FIG. 26 is a perspective view of another embodiment of an insulated container.

FIG. 26 illustrates another embodiment of an insulated container 300 that includes a drawer 302. The insulated container 300 in this illustrated embodiment is generally configured and used similar to the insulated container 10 of FIGS. 1-15, e.g., includes a drawer 302, a main chamber (obscured in FIG. 26), a drawer chamber (obscured in FIG. 26), an outer housing 308, a lid 320, a lid lock 321, opposed side handles 324 (one of the handles 324 is obscured in FIG. 26), a front handle 330, an upper housing (obscured in FIG. 26), a lower housing (obscured in FIG. 26), a vertically-extending divider wall (obscured in FIG. 26) of the lower housing, a vertically-extending divider wall (obscured in FIG. 26) of the upper housing, and insulating material (obscured in FIG. 26). FIG. 26 shows each of the lid 320 and the drawer 302 closed.

The drawer 302 in this illustrated embodiment includes first and second drawers that are configured to be opened and closed independent of one another. The drawer 302 thus defines two compartments but in two separate drawers instead of in a single drawer like the drawers 12, 102, 202 discussed above. Each of the two drawers includes its own handle 302*n*. The insulated container 300 includes a plurality of drawers instead of a single drawer may help maintain coolness in a closed one of the drawers with the other of the drawers being open. A single drawer like the drawers 12, 102, 202 discussed above may be easier and/or more cost effective to manufacture, such as using injection molding as discussed further below. Each of the drawers of FIG. 26 can be formed using injection molding but as separate elements instead of a single element like the drawers 12, 102, 202 discussed above.

The lid lock 321 in this illustrated embodiment includes first and second lid locks instead of a single lid lock like the lid locks 21, 121, 221 discussed above. Having more than one lid lock provides redundancy in case of lid lock failure. However, having more than one lid lock requires more user action than a single lid lock since more than one lid lock must be unlocked before the lid can be opened.

The handles 324 in this illustrated embodiment each include a pivotal handhold 325, similar to the strap, rope, or other member discussed above, engaged with at least one opening of each handle 324, similar to the openings 26 of FIG. 15 discussed above.

The front handle 330 in this illustrated embodiment includes a depression formed in the front exterior surface of the drawer outer housing 308 and defining a hand or finger hold therein.

An insulated container as described herein, e.g., the insulated container 10 of FIGS. 1-5, the insulated container 100 of FIGS. 16-19, the insulated container 200 of FIGS. 20 and 21, and the insulated container 300 of FIG. 26, can be manufactured in any of a variety of ways. In an exemplary embodiment, an insulating container as described herein is formed using injection molding.

Figure 7A:
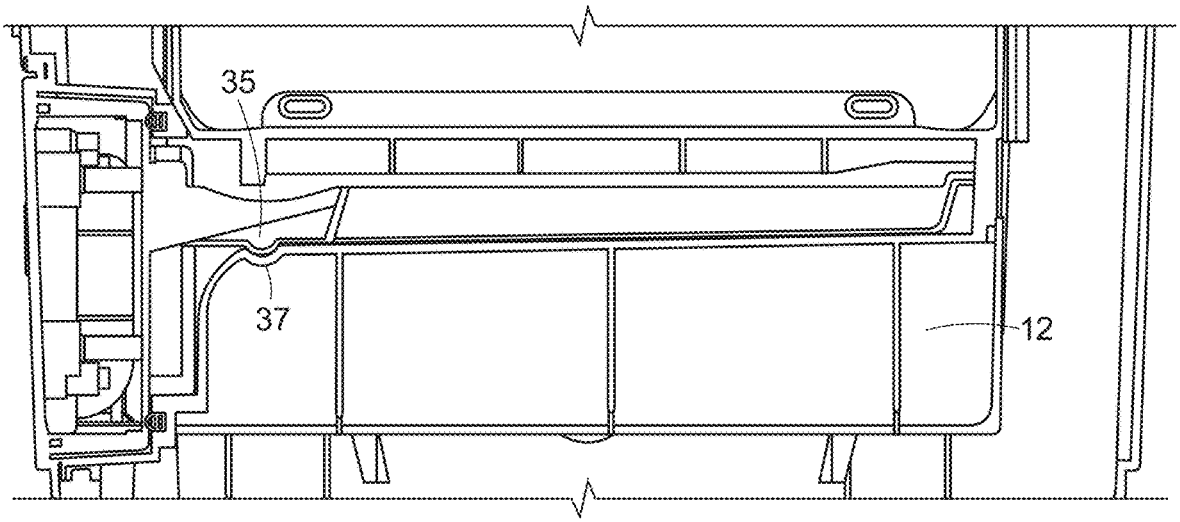
FIG. 7A is a partial side cross-sectional view of the insulated container of FIG. 1.
Figure 8:
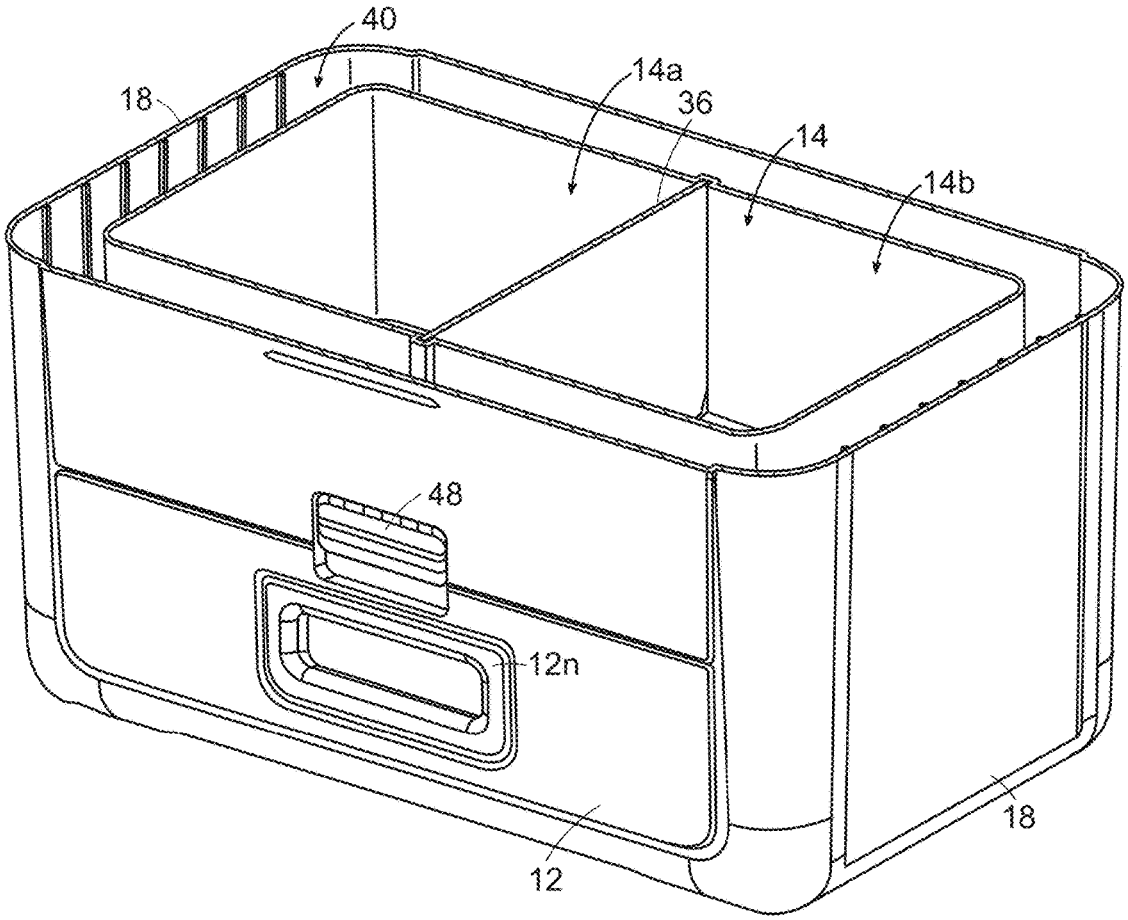
FIG. 8 is still another perspective cross-sectional view of the insulated container of FIG. 1.
Figure 9:
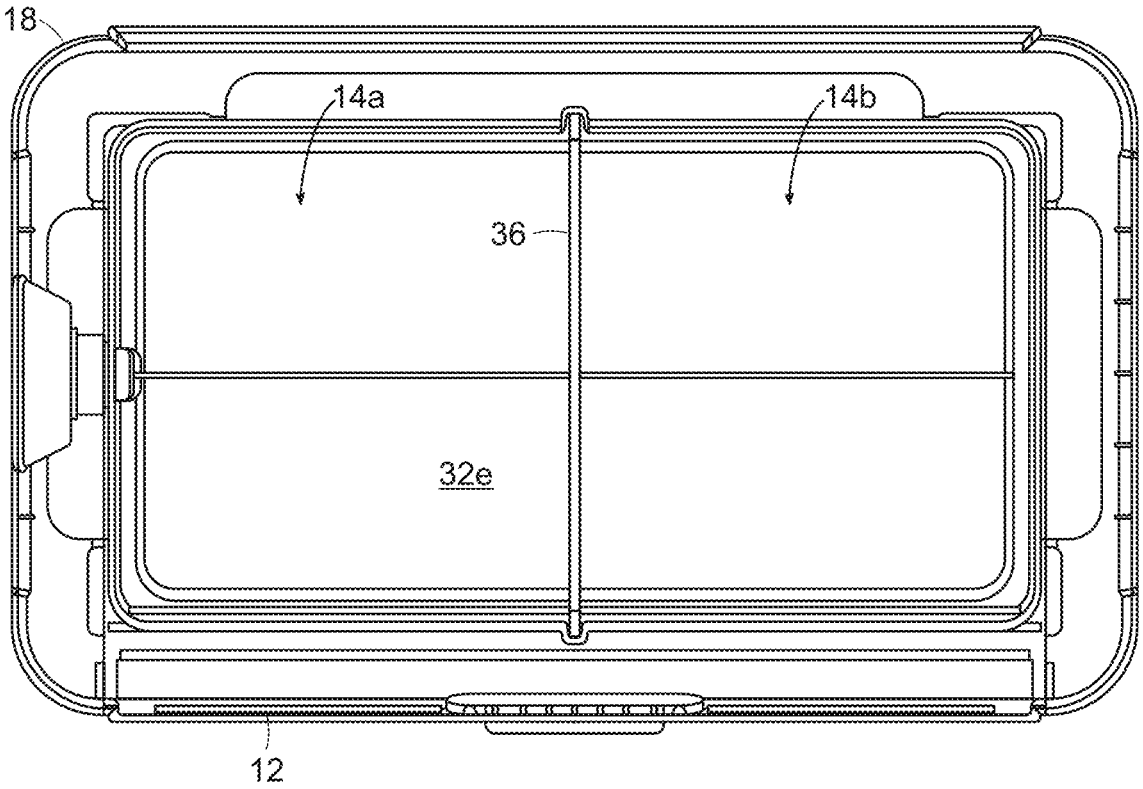
FIG. 9 is a top side cross-sectional view of the insulated container of FIG. 1.
Figure 10:
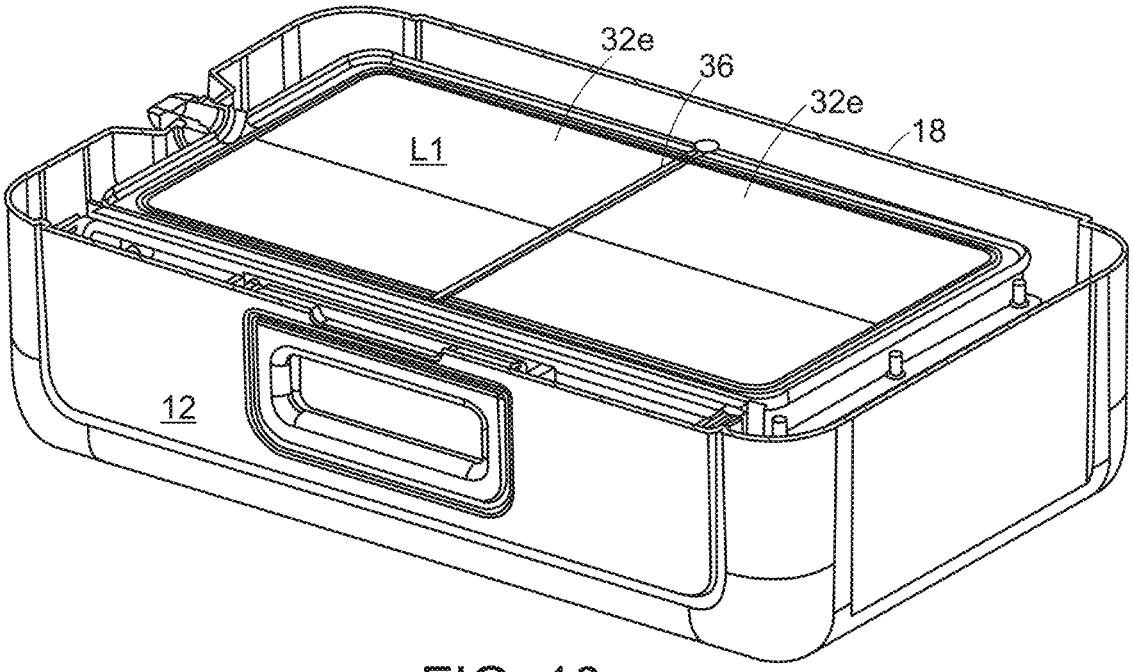
FIG. 10 is another perspective cross-sectional view of the insulated container of FIG. 1.

Using injection molding to manufacture the insulated container may allow for finer details and tolerance control than other manufacturing methods, such as rotomolding (also referred to as rotational molding). For example, a bottom surface of an upper housing including a hexagonal rib structure as discussed above is possible to form using injection molding but would not be possible to form with as much fine detail and as much tolerance control using other manufacturing methods, such as rotomolding. Having a detailed hexagonal rib structure that allows for a very small manufacturing tolerance may help ensure that the hexagonal rib structure provides the durability and thermal effects discussed herein. For another example, a vertically-extending divider wall of a lower housing and a drawer having a corresponding shape configured to abut the lower housing's vertically-extending divider wall is possible to form using injection molding but would not be possible to form with as much fine detail and as much tolerance control using other manufacturing methods, such as rotomolding. Having a detailed vertically-extending divider wall of a lower housing and a drawer having a corresponding shape that allows for a very small manufacturing tolerance may help ensure that the drawer abuts the vertically-extending divider wall so as to minimize any thermal loss from within the drawer. For yet another example, guidance rail features of a drawer are configured to aid in opening and closing the drawer, as will be appreciated by a person skilled in the art. The drawer's guidance rail features, e.g., guidance rail features 12*g* on a side of the drawer as in the illustrated embodiment of FIG. 5, are configured to slide in corresponding guidance rail features of an outer housing, e.g., guidance rail features 18*g* of the outer housing 18 as shown in FIG. 5. Forming the drawer's and the lower housing's guidance rail features with the detail and tolerance control of injection molding may help ensure secure mating of the guidance rail features so as to minimize any thermal loss from within the drawer and/or may help smooth sliding of the drawer in and out of the lower housing's drawer chamber. For another example, forming a lid and an outer housing with injection molding may help ensure that a lid lock securely locks the lid in a closed configuration to maintain a complete seal of a main chamber within the outer housing (e.g., within an upper housing disposed within the outer housing) because of the fine detail and manufacturing control allowed by injection molding. For still another example, forming a drawer and an outer housing with injection molding may help ensure that a drawer lock securely locks the drawer in a closed configuration to maintain a complete seal of the drawer because of the fine detail and manufacturing control allowed by injection molding. For yet another example, forming an outer housing with injection molding may allow for a channel to be formed in the outer housing that is configured to seat therein a sealing gasket configured to help seal a closed drawer. The channel is also configured for detents to be mounted therein configured to engage corresponding indentations of a closed drawer and thereby help keep the drawer closed. The fine detail and tolerance control allowed by injection molding may help ensure that the sealing gasket seats securely therein to form as complete a seal as possible and may help ensure that the detents are of proper size and shape to engage the drawer. FIGS. 7 and 7A illustrate one embodiment of a scaling gasket 33, detents 35, and indentations 37.

Using injection molding to manufacture the insulated container may allow for individual components of the insulated container to be formed separately. Forming components separately may improve overall structural integrity of each individual component and thus overall structural integrity of the fully assembled insulated container. Forming components separately may improve cooling performance since a singular member does not have seams, joints, or other connection areas that would exist if the singular member was instead formed of two or more parts connected together. For example, forming an upper housing as a singular member may improve cooling performance since there are not seams, joints, or other connection areas in the upper housing through which coolness provided by a cooling agent in the main chamber can escape. For example, forming a drawer as a singular member may improve cooling performance since there are not seams, joints, or other connection areas in the drawer through which coolness in the drawer chamber can escape. Forming components separately may help prevent leaks since a singular member does not have seams, joints, or other connection areas where leaks are most likely to develop. For example, forming an upper housing as a singular member may help prevent melted ice from leaking out of the main chamber. For another example, forming a drawer as a singular member may help prevent liquid spilled out of a bottle in a first compartment of the drawer from leaking into a second compartment of the drawer or out of the drawer at all.

In general, an injection molding process includes injecting a molten material into a mold and then allowing the material to cool and harden in the mold. Injection molding is a relatively high pressure process since a compressive force is applied to the mold during the cooling and hardening process to help keep the mold closed. Also, the mold is still during the cooling and hardening process.

In general, a rotomolding process includes filling a mold with a material and heating the filled mold (e.g., in an oven) while the filled mold rotates. The filled mold is then removed from heat and allowed to cool so the material in the mold cools and hardens in the mold. Rotomolding is a relatively low pressure process since a compressive force is not applied to the mold during the rotating or cooling stages of rotomolding.

As discussed above, an insulated container can include an upper housing, a lower housing, an outer housing, a lid, and a drawer. In an exemplary embodiment, each of the upper housing, the lower housing, the outer housing, the lid, and the drawer are formed with injection molding. The material of the upper housing, the lower housing, the outer housing, the lid, and the drawer is polypropylene in an exemplary embodiment, although other materials are possible. Polypropylene has a high enough flow rate to be used in injection molding while also providing the rigidity needed for structural integrity of the insulated cooler. In some embodiments, a ultraviolet (UV) resistant material can be used to form at least the outer housing and/or can be used as a coating on the outer housing, which may help improve insulating properties of the insulated container.

Each of the upper housing, the lower housing, the outer housing, the lid, and the drawer is separately formed with injection molding so as to each be a singular member. After being formed, the upper housing, the lower housing, the outer housing, the lid, and the drawer are assembled along with other components of the insulated container, e.g., vertically-extending divider wall in the main chamber of the upper housing, insulating material, etc. The upper housing, the lower housing, the outer housing, the lid, and the drawer can be made in any order, and assembly of one or more of the upper housing, the lower housing, the outer housing, the lid, and the drawer may begin before one or more other components of the insulated container have been made.

In an exemplary embodiment, assembly of the insulated container includes fixedly securing the upper and lower housings together such that a bottom wall of the upper housing defines a top wall of a drawer chamber defined by the lower housing and such that the bottom wall separates the drawer chamber from a main chamber defined by the upper housing. As discussed above, with the upper and lower housings disposed in the outer housing, space is defined between the outer housing and the upper and lower housings. The assembly of the insulated container also includes filling the space with an insulating material. The insulating material is polyurethane foam in an exemplary embodiment, but other materials are possible. Further, in an exemplary embodiment, the same insulating material is used throughout the insulated container, but in some embodiments, an insulated container can include two or more different insulating materials.

Assembly of the insulated container also including coupling the drawer to the lower housing, e.g., disposed in the drawer in the drawer chamber. In an exemplary embodiment, the drawer is coupled to the lower housing after the lower housing has been fixedly secured to the upper housing and disposed in the outer housing and after insulating material has filled space defined between the outer housing and the upper and lower housings. A front space of the drawer is also filled with insulating material, as discussed above, which, in an exemplary embodiment, occurs prior to the drawer being coupled to the lower housing.

Assembly of the insulated container also including coupling the lid to the upper housing. In an exemplary embodiment, the lid is coupled to the upper housing after the upper housing has been fixedly secured to the lower housing and disposed in the outer housing and after insulating material has filled space defined between the outer housing and the upper and lower housings. The lid is also filled with insulating material, as discussed above, which, in an exemplary embodiment, occurs prior to the lid being coupled to the upper housing.

For insulated containers that include a removable vertically-extending divider wall in the main chamber, assembly of the insulated container also including disposing the vertically-extending divider wall in the main chamber. In an exemplary embodiment, the vertically-extending divider wall is disposed in the main chamber after the upper housing has been fixedly secured to the lower housing and disposed in the outer housing and after insulating material has filled space defined between the outer housing and the upper and lower housings.

EXAMPLES

The insulated containers described herein can be configured to contain one or more objects. For example, one or more objects, such as food, drinks, and/or containers thereof, can be contained in a main chamber of an insulated container and/or one or more objects can be contained in a drawer chamber of the insulated container. Furthermore, the insulated containers can experience one or more of a static load and a dynamic load (e.g., drops) during use. The one or more dynamic loads can occur when the one or more objects are contained within the insulated container. The insulated container described herein, such as but not limited to the insulated container 10 of FIG. 1, insulated container 100 of FIG. 16, insulated container 200 of FIG. 20, or the insulated container 300 of FIG. 26, can withstand the one or more static loads and dynamic loads without failing. In particular, the insulated containers can plastically deform without elongating to failure. The examples described herein provide data associated with structural testing of at least a portion of an insulated container in accordance with the descriptions provided herein. The examples provided should not be construed as limiting the insulated container in any way and are only intended to provide data associated with illustrative embodiments.

Example 1

Figure 27A:
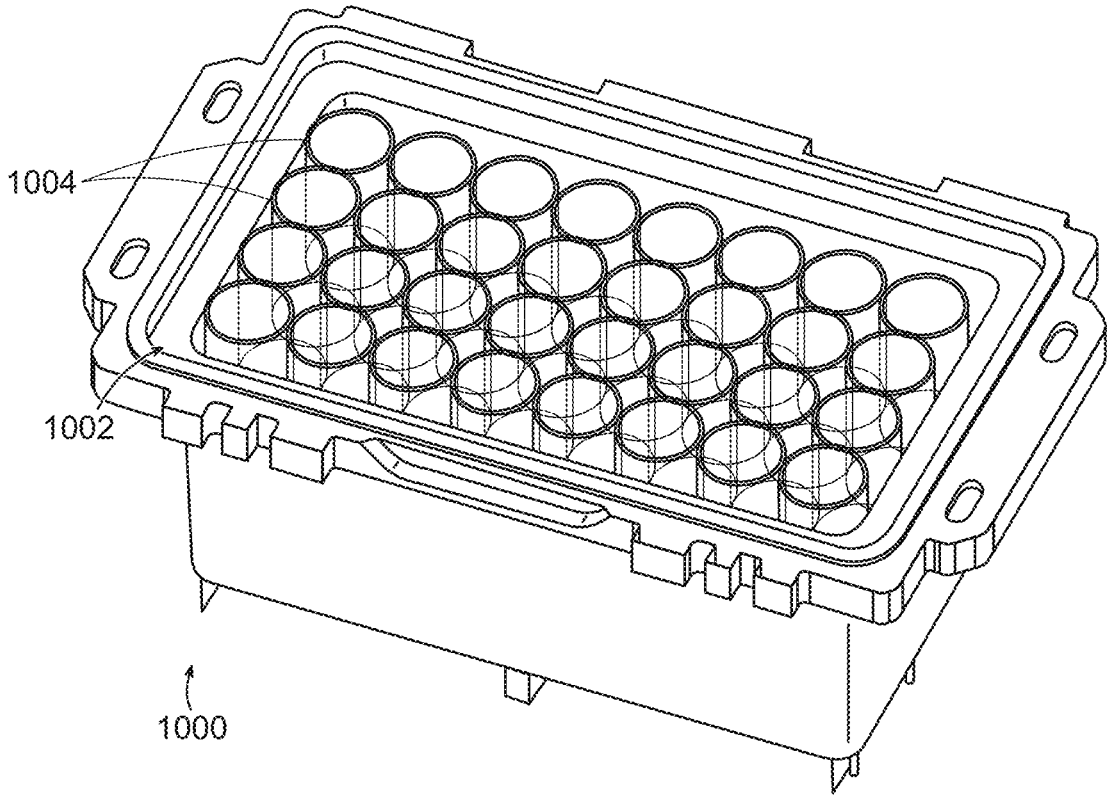
FIG. 27A is a perspective view of an exemplary embodiment of an upper housing of an insulated container.
Figure 27B:
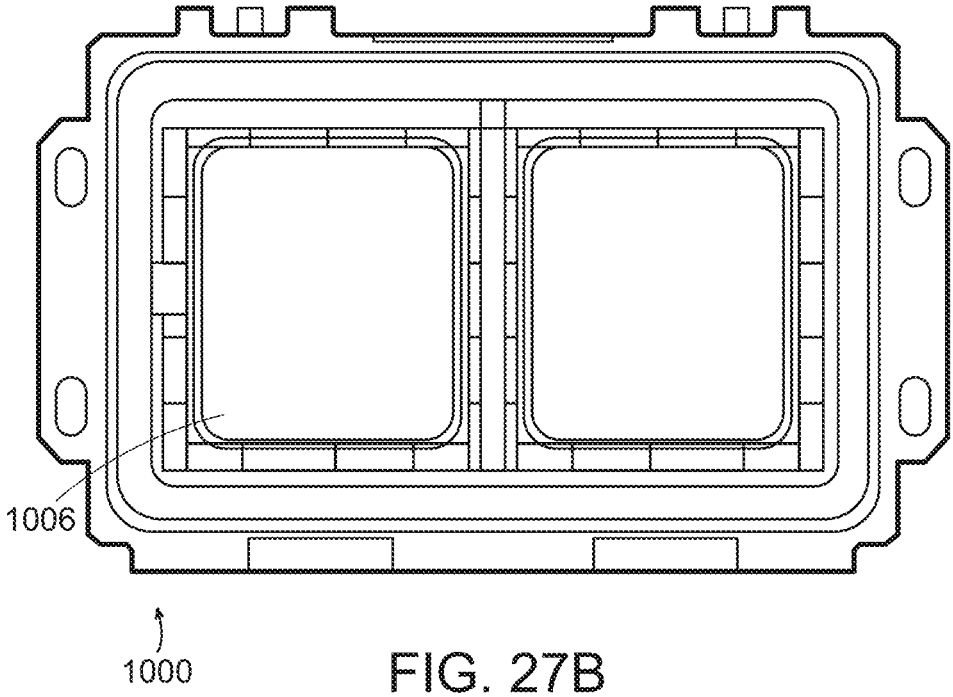
FIG. 27B is a bottom view of a first variation of the upper housing of FIG. 27A.
Figure 27C:
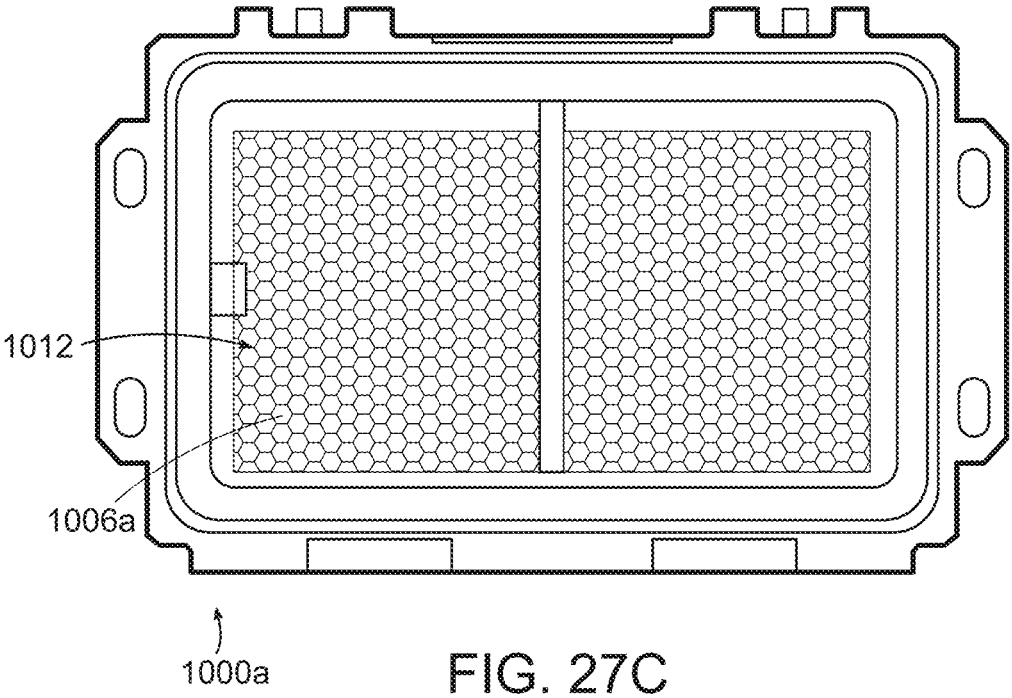
FIG. 27C is a bottom view of a second variation of the upper housing of FIG. 27A.

An exemplary embodiment of an insulated container in accordance with the description provided was analyzed for static and dynamic conditions when loaded with one or more objects. The analysis was performed using a finite element analysis technique based on a finite element mesh. For example, as shown in FIGS. 27A-27C, an upper housing 1000 of an insulated container were analyzed when loaded with a plurality of cans 1004. The plurality of cans 1004 were positioned within a main chamber 1002 of the upper housing 1000. The description of the upper housing 1000 is similar to the description provided with reference to the upper housing 32 shown in FIGS. 4-6, the upper housing 232 shown in FIGS. 20-21, or any other upper housing described herein. The plurality of cans 1004 were positioned on a top surface of a bottom wall 1006 of the upper housing 1000. The description of the bottom wall 1006 is similar to the description provided with reference to the bottom wall 32*e*, or any other bottom wall described herein. The plurality of cans 1004 was assumed to apply a force of about 224 N to the top surface of the bottom wall 1006. As shown in FIG. 27B, a bottom surface of the bottom wall 1006 is substantially smooth. In contrast, an upper housing 1000*a* was also included in the analysis and, as shown in FIG. 27C, a bottom surface of a bottom wall 1006*a* thereof includes a plurality of hexagonal ribs 1012. The insulated containers 1000, 1000*a* and respective bottom walls 1006, 1006*a* are substantially identical aside from the inclusion of the plurality of hexagonal ribs 1012 in the bottom wall 1006*a*.

Figure 28A:
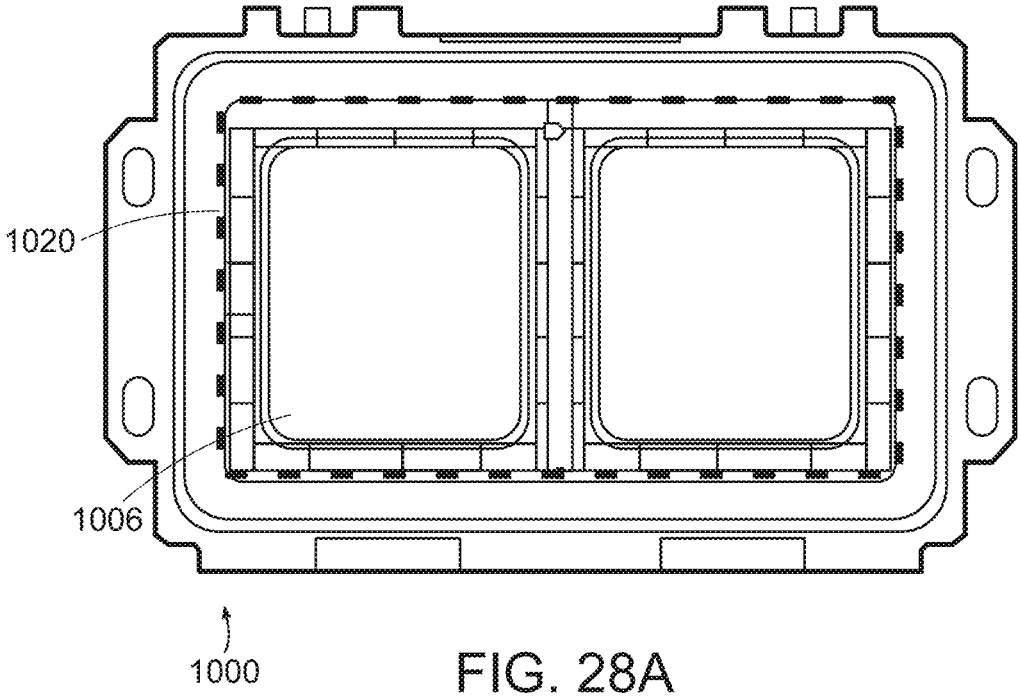
FIG. 28A is a bottom view of a support configuration of the upper housing of FIG. 27A.
Figure 28B:
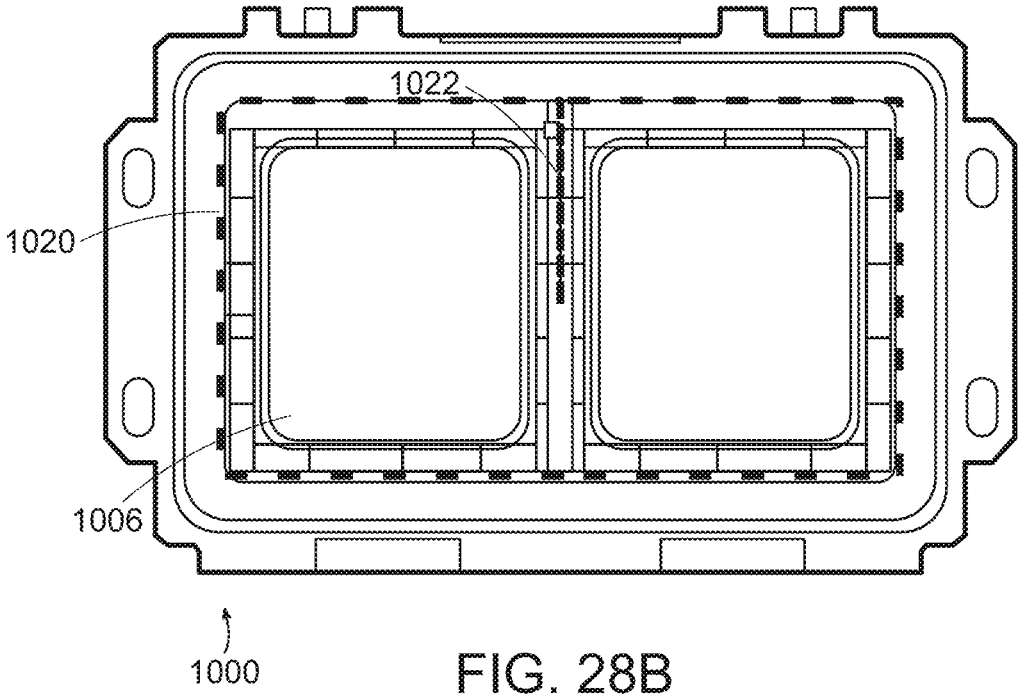
FIG. 28B is a bottom view of another support configuration of the upper housing of FIG. 27A.
Figure 28C:
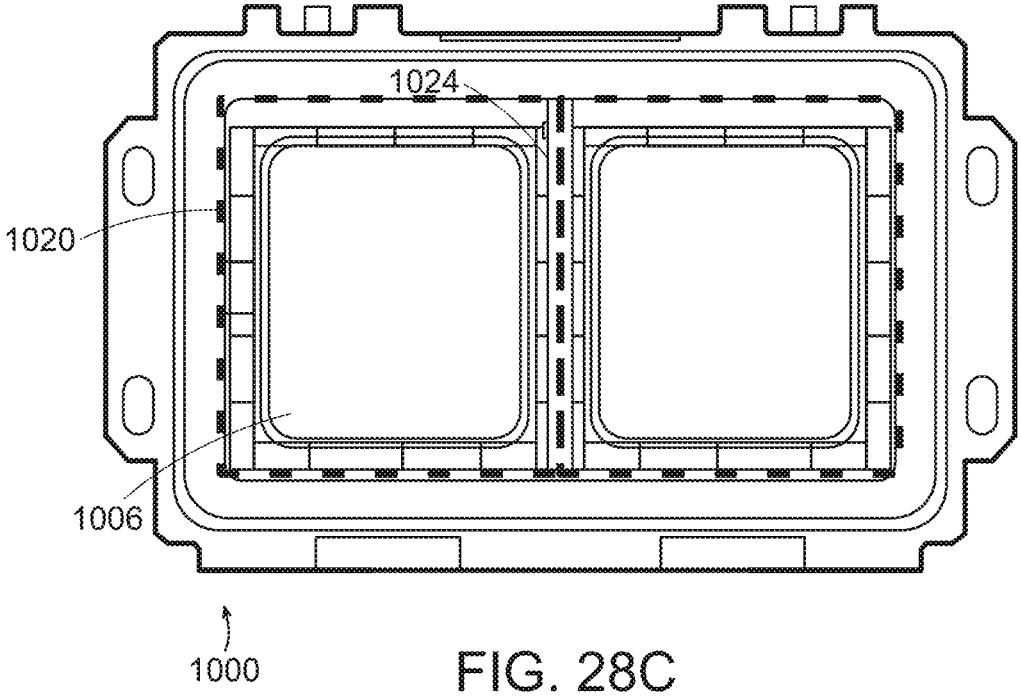
FIG. 28C is a bottom view of yet another support configuration of the upper housing of FIG. 27A.

The analysis assumed portions of the upper housings 1000, 1000*a* were supported. In particular, three configurations of support are shown in FIGS. 28A-28C. In a first configuration shown in FIG. 28A, a perimeter support 1020 extends around a perimeter of the bottom wall 1006, such that the perimeter of the bottom wall 1006 would not move or otherwise deflect. The perimeter support 1020 could be a drawer chamber (not shown) of a lower housing (not shown). In a second configuration shown in FIG. 28B, the bottom wall 1006 was supported by the perimeter support 1020 in addition to a first central support 1022 that extended along about half of a width of the bottom wall 1006. In a third configuration shown in FIG. 28C, the bottom wall 1006 was supported by the perimeter support 1020 in addition to a second central support 1024 that extended along the entire width of the bottom wall 1006. The first central support 1022 or the second central support 1024 could be positioned within a lower housing (not shown). While not shown, the bottom wall 1006*a* was supported in an identical manner for purposes of the analysis.

Figure 29A:
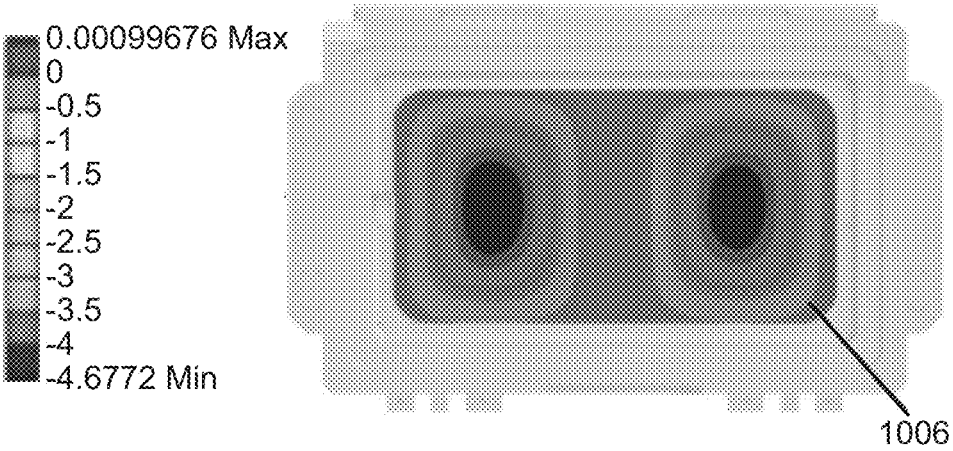
FIG. 29A is an illustrative plot of deformation of the upper housing of FIG. 27B.
Figure 29B:
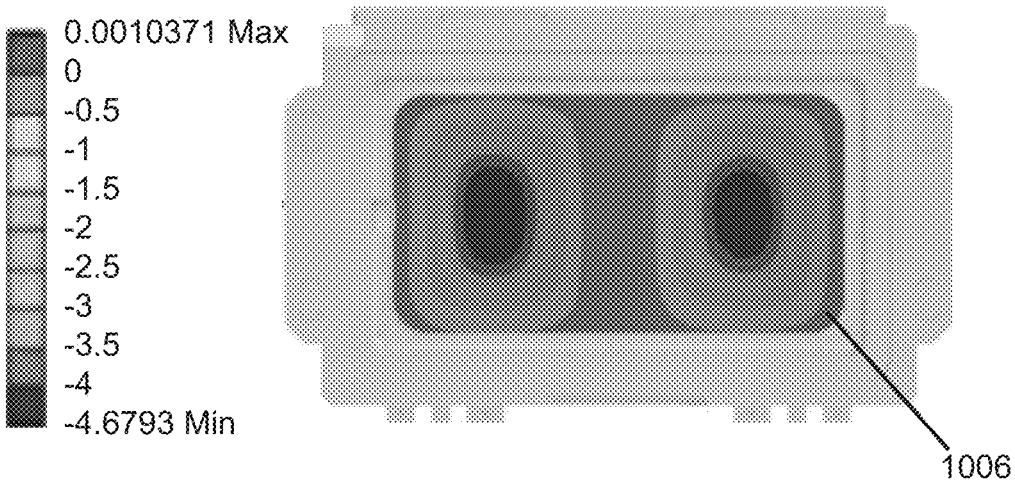
FIG. 29B is another illustrative plot of deformation of the upper housing of FIG. 27B.
Figure 29C:
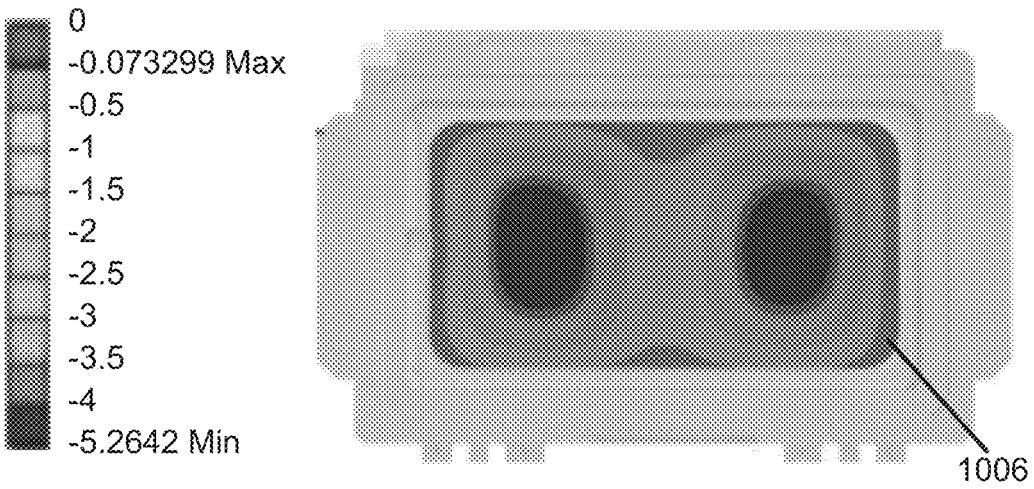
FIG. 29C is yet another illustrative plot of deformation of the upper housing of FIG. 27B.

Results of a static load analysis are shown in FIGS. 29A-30C. In the static load analysis, the upper housings 1000, 1000*a* in each of the three support configurations were analyzed for deflection and stresses of the bottom walls 1006, 1006*a* due to the plurality of cans 1020 while in a static condition (e.g., not moving). The results shown in FIGS. 29A-29C correspond to the upper housing 1000 with the bottom wall 1006. Furthermore, FIG. 29A corresponds to the third support configuration of FIG. 28C, FIG. 29B corresponds to the second support configuration of FIG. 28B, and FIG. 29C corresponds to the first support configuration of FIG. 28A. As shown, the third support configuration corresponded to a maximum deflection of 4.677 mm, the second support configuration corresponded to a maximum deflection of 4.679 mm, and the first support configuration corresponded to a maximum deflection of 5.264 mm. The bottom wall 1006 had a thickness of about 7.6 mm. Therefore, a deformation factor (DF) using Equation 1 can be calculated. The DF for the configuration of FIG. 29A is about 0.62, the DF for the configuration of FIG. 29B is about 0.62, and the DF for the configuration of FIG. 29C is about 0.69.

Figure 30A:
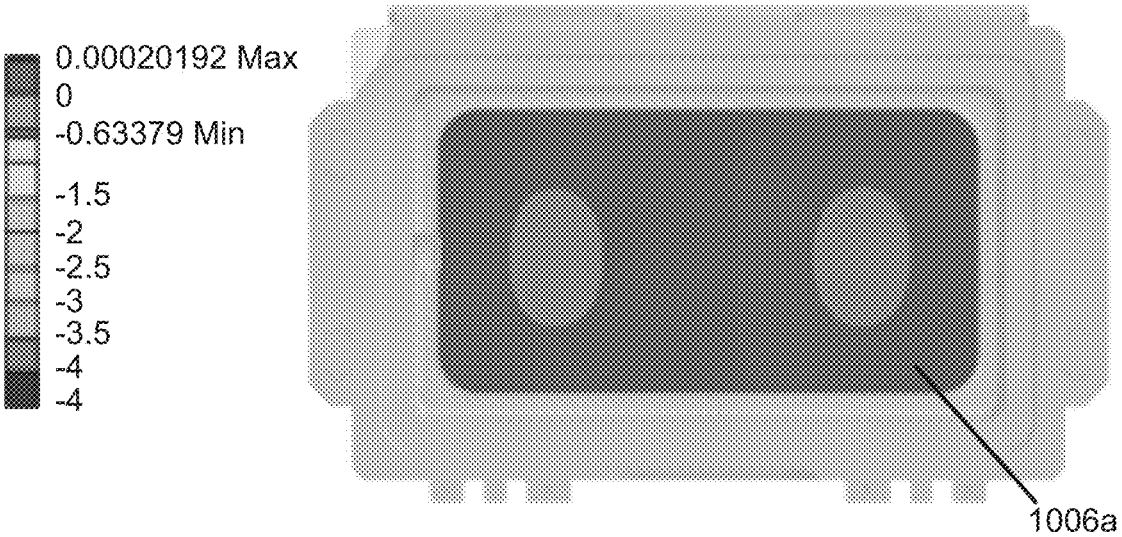
FIG. 30A is an illustrative plot of deformation of the upper housing of FIG. 27C.
Figure 30B:
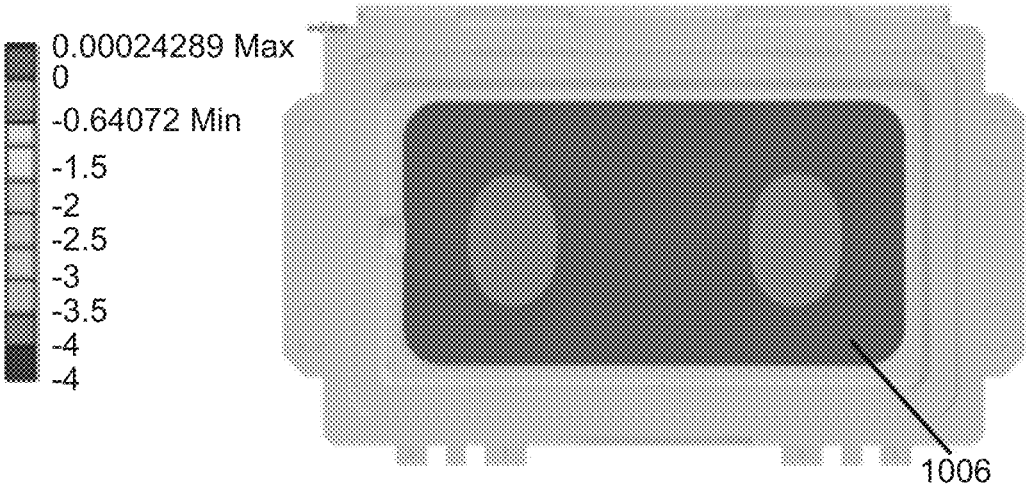
FIG. 30B is another illustrative plot of deformation of the upper housing of FIG. 27C.
Figure 30C:
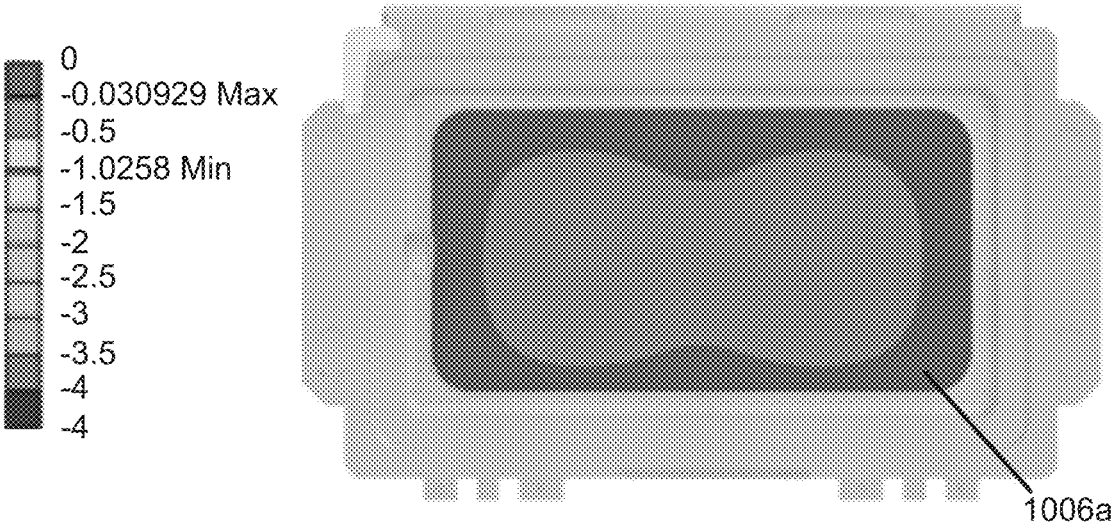
FIG. 30C is yet another illustrative plot of deformation of the upper housing of FIG. 27C.

In contrast, the results shown in FIGS. 30A-30C correspond to the upper housing 1000*a* with the bottom wall 1006*a*. FIG. 30A corresponds to the third support configuration of FIG. 28C, FIG. 30B corresponds to the second support configuration of FIG. 28B, and FIG. 30C corresponds to the first support configuration of FIG. 28A. As shown, the third support configuration corresponded to a maximum deflection of 0.633 mm, the second support configuration corresponded to a maximum deflection of 0.641 mm, and the first support configuration corresponded to a maximum deflection of 1.026 mm. Similar to the bottom wall 1006, the bottom wall 1006*a* had a thickness of about 7.6 mm and a DF can be calculated using Equation 1. The DF for the configuration of FIG. 30A is about 0.083, the DF for the configuration of FIG. 30B is about 0.084, and the DF for the configuration of FIG. 30C is about 0.14. The results show that the bottom wall 1006*a* deflected significantly less than the bottom wall 1000 under the same load conditions. Therefore, the inclusion of the plurality of ribs 1012 in the bottom wall 1006*a* of the upper housing 1000*a* effectively and significantly increased the structural rigidity of the bottom wall 1006*a*.

Figure 31A:
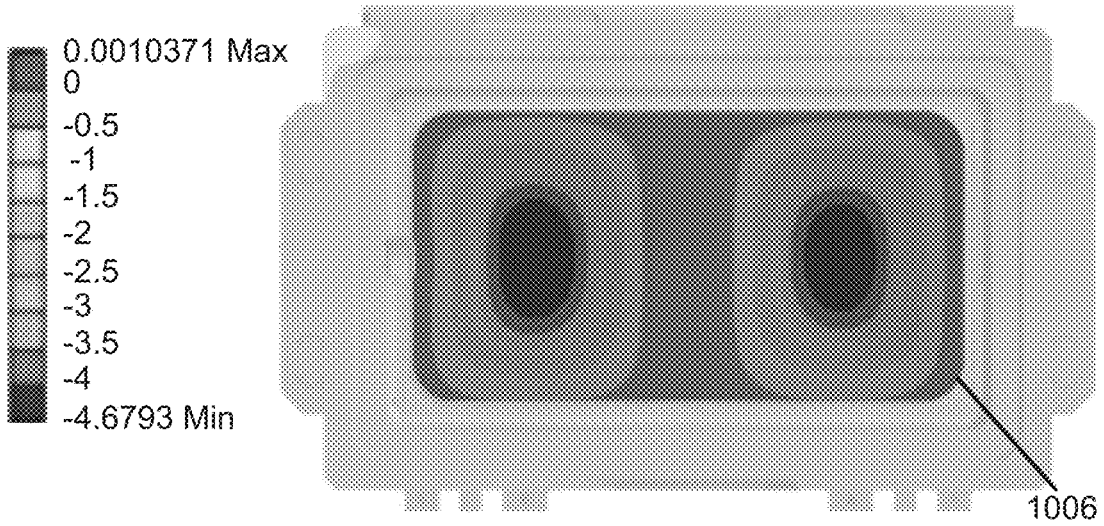
FIG. 31A is still another illustrative plot of deformation of the upper housing of FIG. 27B.
Figure 31B:
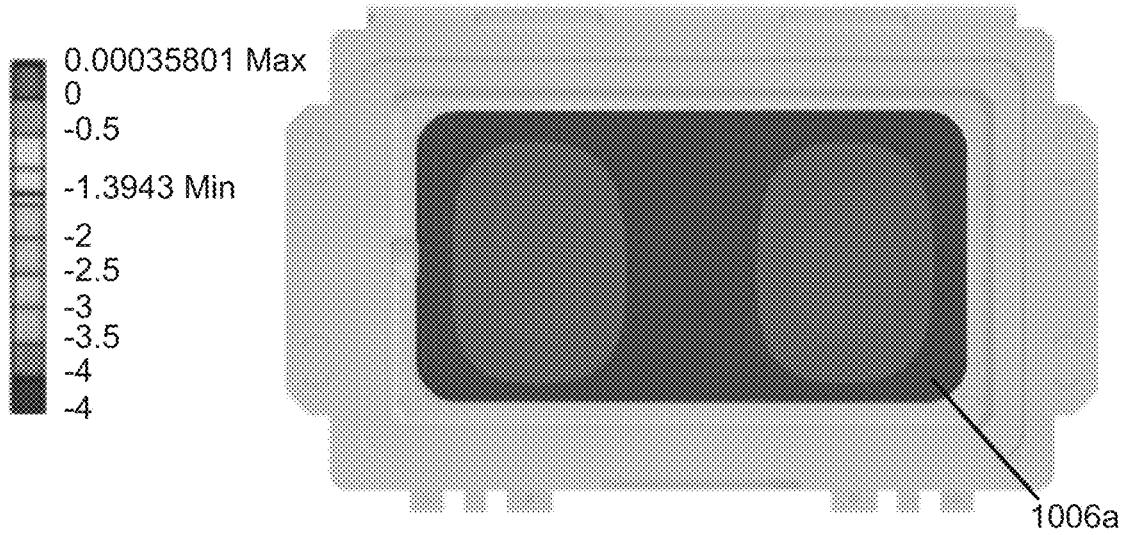
FIG. 31B is yet another illustrative plot of deformation of the upper housing of FIG. 27C.
Figure 31C:
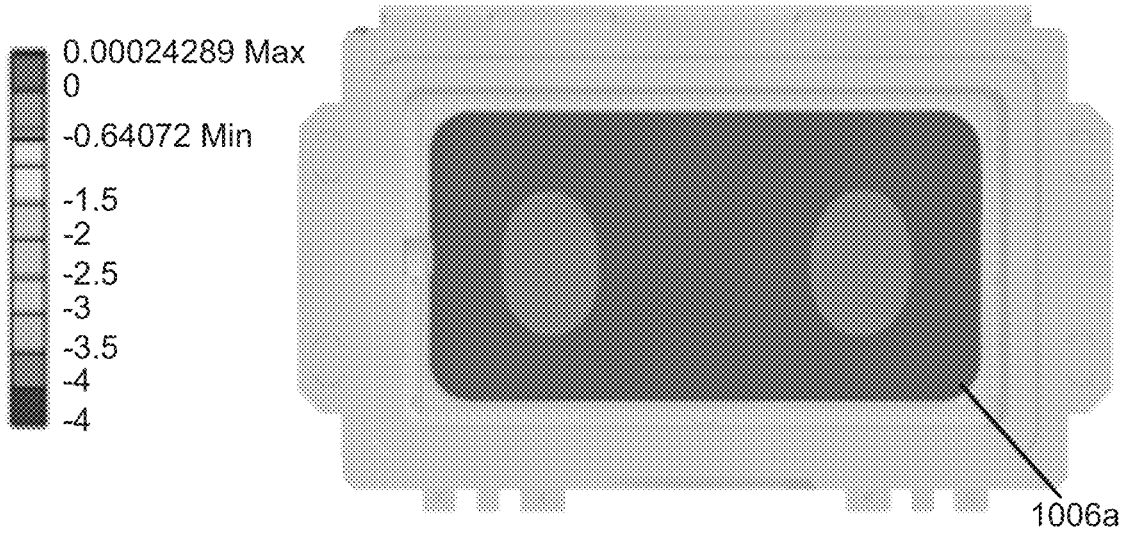
FIG. 31C is yet another illustrative plot of deformation of an illustrative variation of the upper housing of FIG. 27C.

Additionally, a dimension of the plurality of ribs 1020 was analyzed. In particular, a rib height of each rib of the plurality of ribs 1020 was altered to determine any effects thereof. Using the second support configuration corresponding to FIG. 28B, results for the bottom wall 1006 having a smooth surface are shown in FIG. 31A, a bottom wall having a first rib height of about 5.75 mm (for a thickness of about 8.75 mm) are shown in FIG. 31B, and a bottom wall having a second rib height of about 9.0 mm (for a thickness of about 11 mm) are shown in FIG. 31C. The variation having the first rib height had a measured maximum deflection of about 1.394 mm, for a DF of about 0.18, and the variation having the second rib height had a measured maximum deflection of about 0.641 mm, for a DF of about 0.058. The results show that the maximum deflection of the bottom wall decreases as the rib height increases.

Figure 32A:
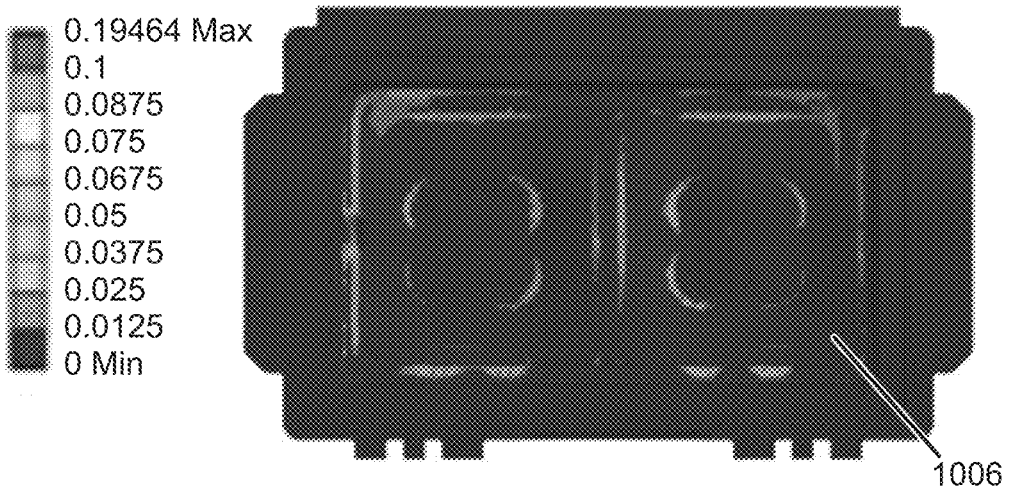
FIG. 32A is an illustrative plot of strain of the upper housing of FIG. 27B.
Figure 32B:
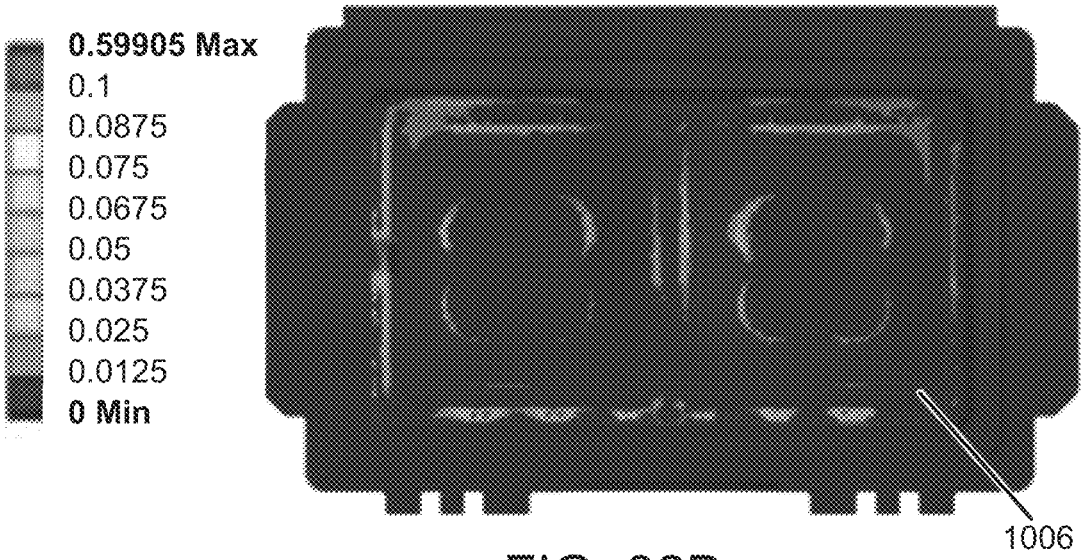
FIG. 32B is another illustrative plot of strain of the upper housing of FIG. 27B.
Figure 32C:
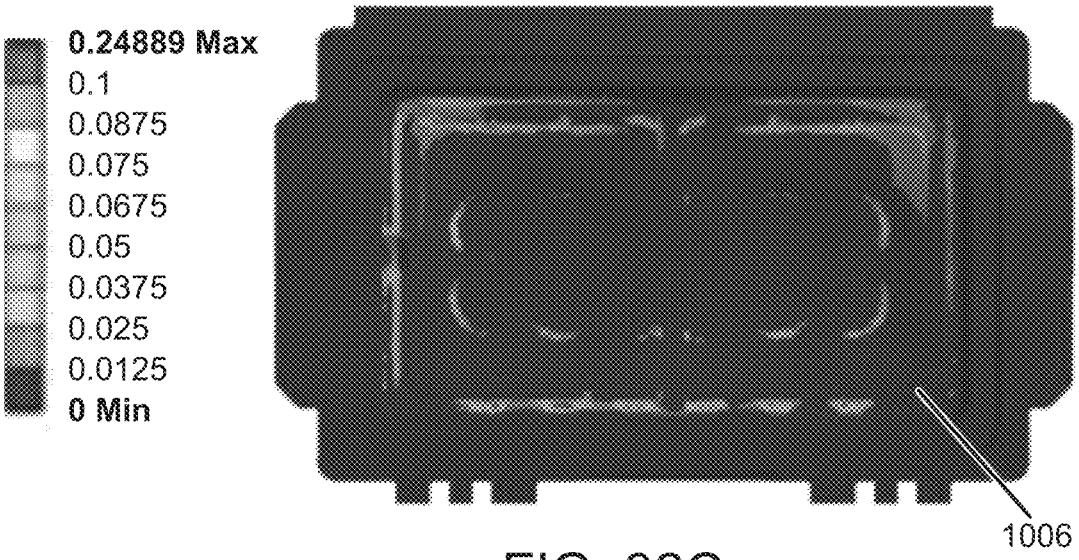
FIG. 32C is yet another illustrative plot of strain of the upper housing of FIG. 27B.
Figure 33A:
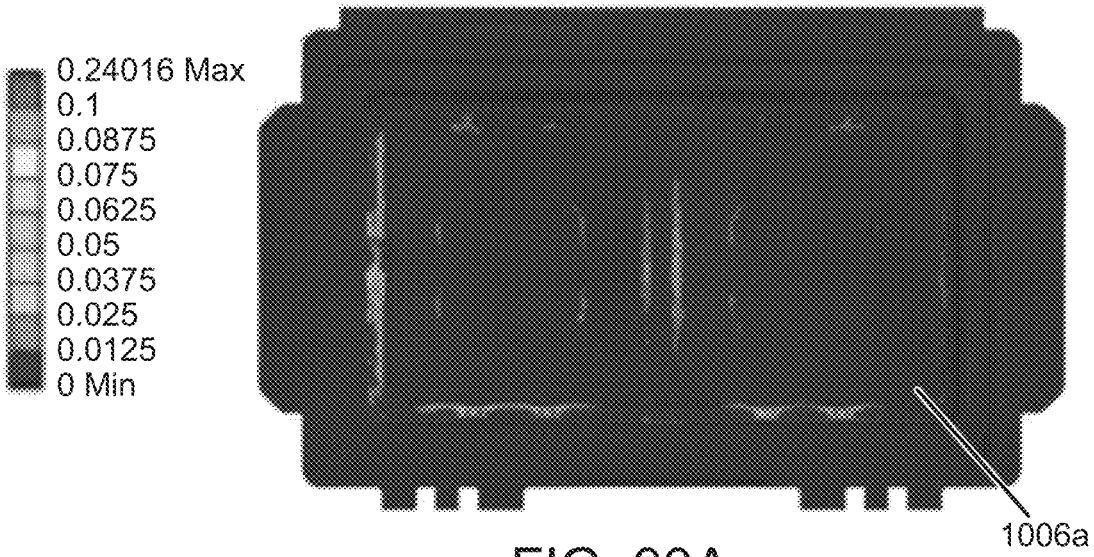
FIG. 33A is an illustrative plot of strain of the upper housing of FIG. 27C.
Figure 33B:
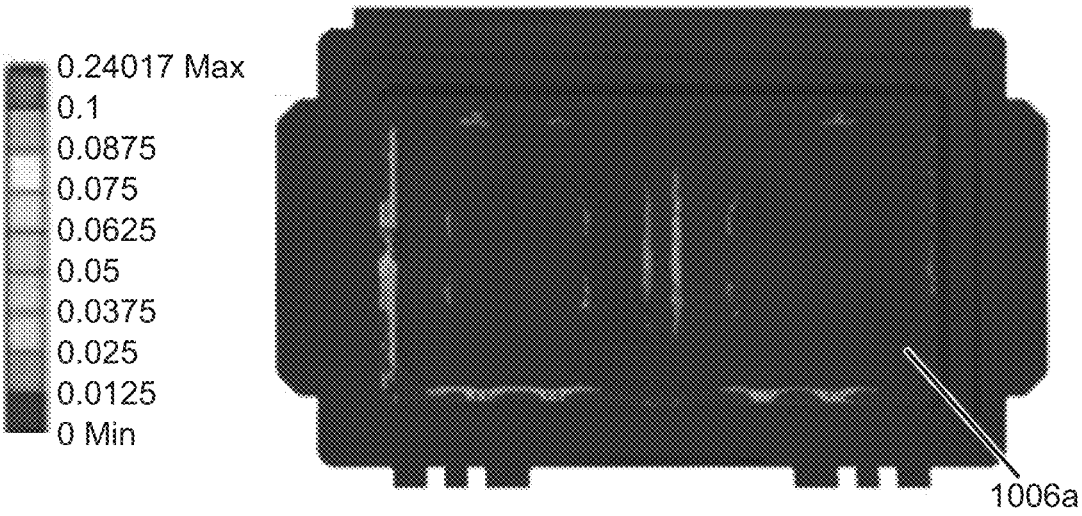
FIG. 33B is another illustrative plot of strain of the upper housing of FIG. 27C.
Figure 33C:
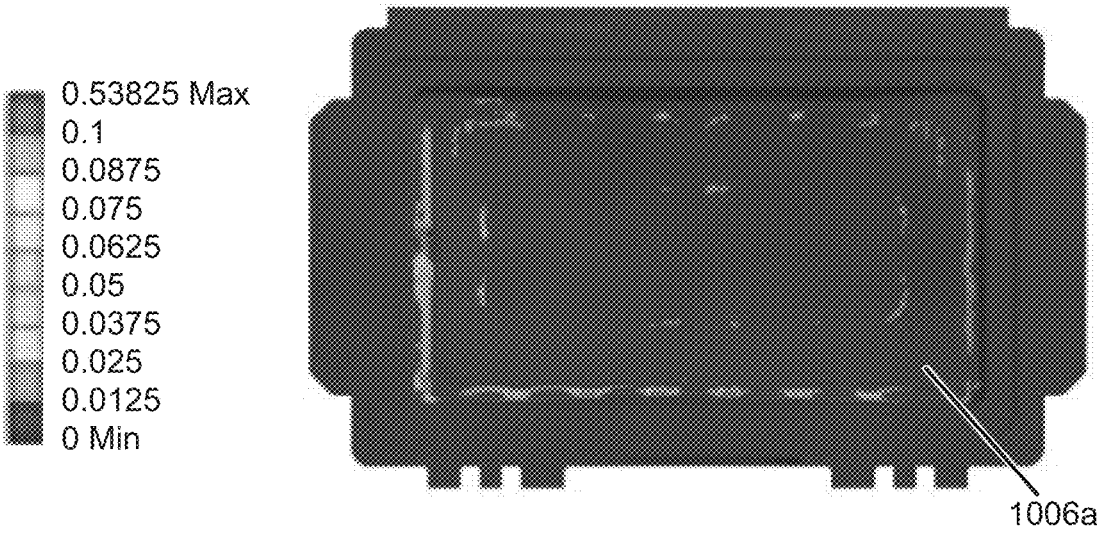
FIG. 33C is yet another illustrative plot of strain of the upper housing of FIG. 27C.

Results from a dynamic load analysis are shown in FIGS. 32A-33C. In particular, plastic strain analysis was performed assuming the upper housings 1000, 1000*a* were dropped from a predetermined height while containing the plurality of cans 1020. In this analysis, the predetermined height was about 1.3716 m (54 inches). FIGS. 32A-32C correspond to the upper housing 1000 and FIGS. 33A-33C correspond to the upper housing 1000*a*. Similar to the static analyses, the first, second, and third support configurations were analyzed for each upper housing 1000, 1000*a*. In particular, FIG. 32A corresponds to the third support configuration of FIG. 28C, FIG. 32B corresponds to the second support configuration of FIG. 28B, and FIG. 32C corresponds to the first support configuration of FIG. 28A. The maximum strain shown in FIG. 32A is 19%, the maximum strain shown in FIG. 32B is 59.9%, and the maximum strain shown in FIG. 32C is 24.9%. Regarding the upper housing 1000*a* with the plurality of ribs 1012, FIG. 33A corresponds to the third support configuration of FIG. 28C, FIG. 33B corresponds to the second support configuration of FIG. 28B, and FIG. 33C corresponds to the first support configuration of FIG. 28A. The maximum strain shown in FIG. 33A is 24%, the maximum strain shown in FIG. 33B is 24%, and the maximum strain shown in FIG. 33C is 53.8%. The results show that the maximum strain generally decreases as more support is provided to the bottom wall. Additionally, the results indicate that the maximum strain is generally lower with the inclusion of the hexagonal ribs.

Example 2

Figure 34A:
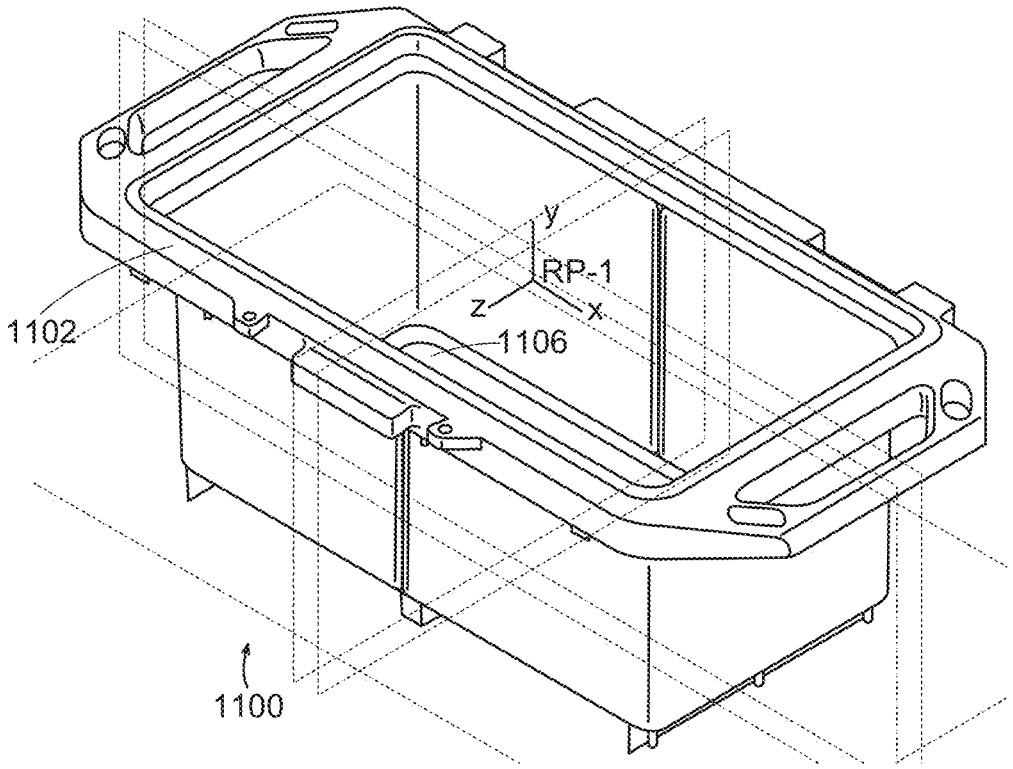
FIG. 34A is a perspective view of another exemplary embodiment of an upper housing of an insulated container.
Figure 34B:
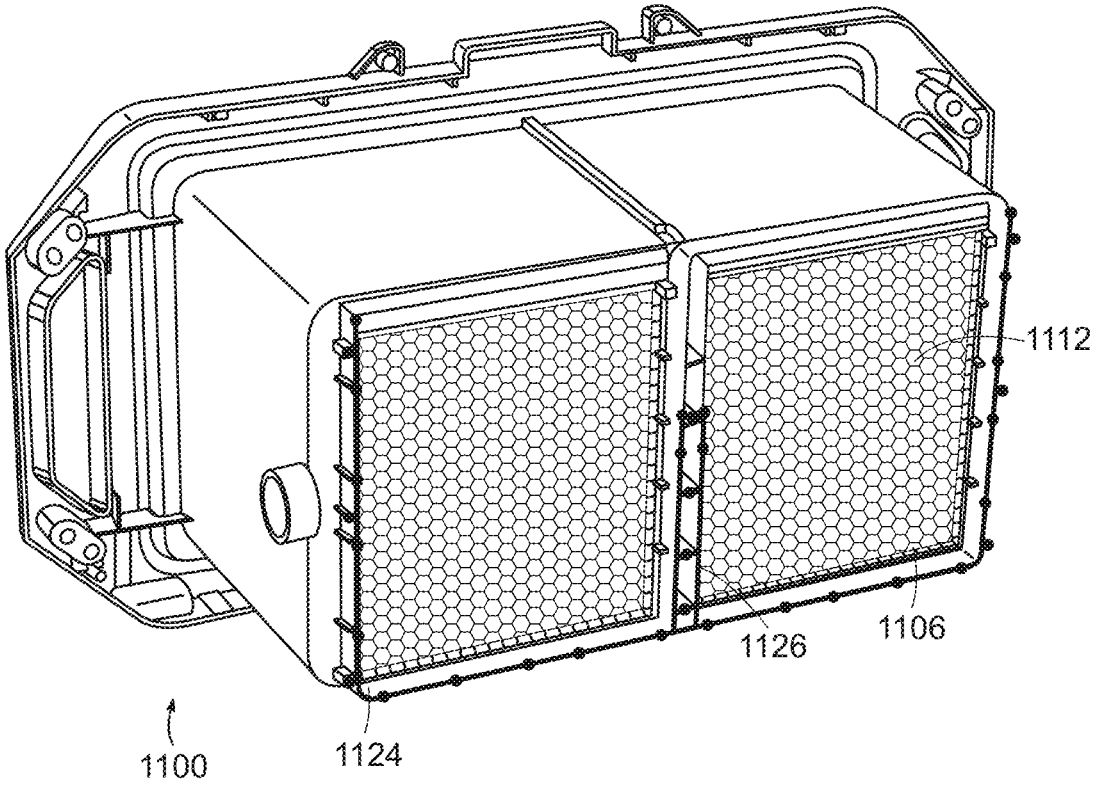
FIG. 34B is a bottom perspective view of the upper housing of FIG. 34A.

Another exemplary embodiment of an insulated container in accordance with the description provided was analyzed for static and dynamic conditions when loaded with one or more objects. The analysis was performed using a finite element analysis technique based on a finite element mesh. For example, as shown in FIGS. 34A-34C, an upper housing 1100 of an insulated container was analyzed when loaded with a plurality of cans (not shown) or a fluid (not shown). Similar to the upper housing 1000 described with reference to FIGS. 27A-33C, the upper housing 1100 has a main chamber 1102 and a bottom wall 1106. The analysis was performed assuming the entire force of the plurality of cans was spread across the bottom wall 1106. In particular, each can of the plurality of cans was assumed to have a mass of about 357 g and the plurality of cans included 64 cans. Therefore, the plurality of cans was assumed to apply a force of about 224 N to the top surface of the bottom wall 1106, which is equivalent to about 1.51 kPa.

The analysis assumed portions of the upper housing 1100 was supported. In particular, as shown in FIG. 34B, a perimeter support 1124 extends around at least a portion of a perimeter of the bottom wall 1106, such that the perimeter of the bottom wall 1106 would not move or otherwise deflect. The bottom wall 1106 was further supported by a central support 1126 that extended along about half of a width of the bottom wall 1106. The central support 1126 was positioned at a midpoint of a length of the bottom wall 1106, such that the bottom wall was evenly supported by the central support 1126. Additionally, as shown in FIG. 34C, an upper edge support 1122 supported an upper edge 1120 of the upper housing 1100.

Figure 35C:
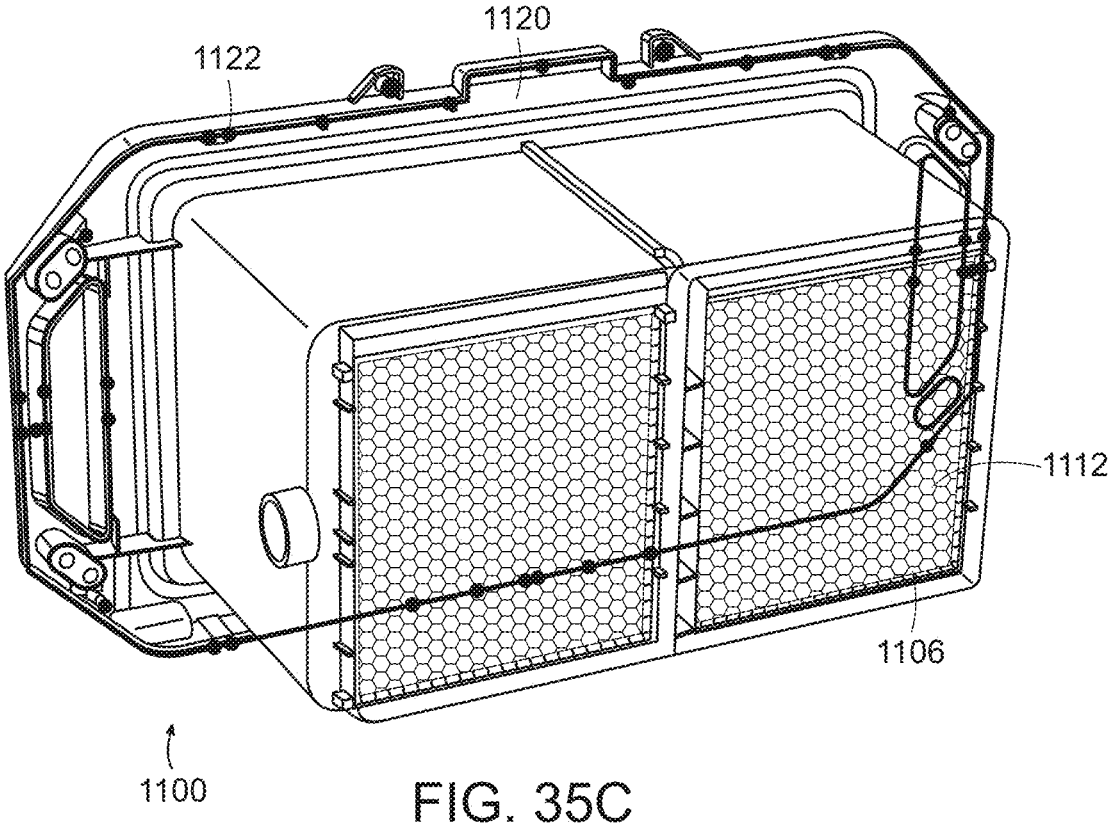
FIG. 35A is an illustrative plot of stress of the upper housing of FIG. 34A.
FIG. 35B is another illustrative plot of stress of the upper housing of FIG. 34A.
Figure 35A:
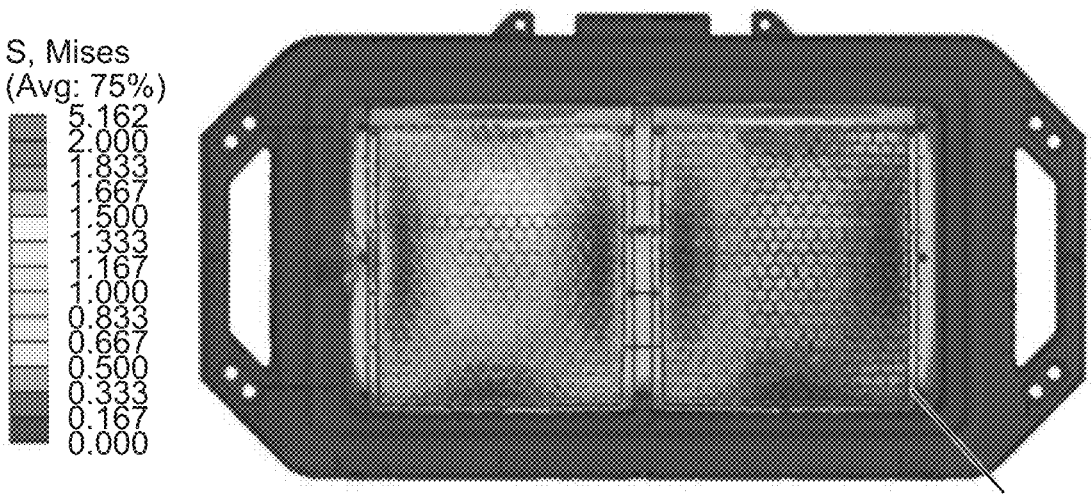
Figure 35B:
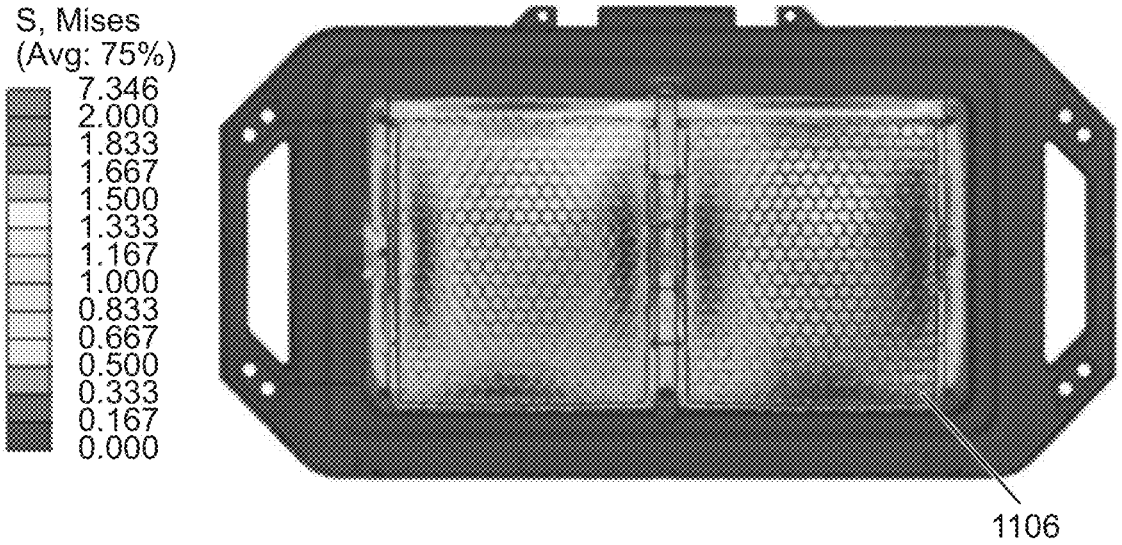

Results of a static load analysis are shown in FIGS. 35A-35B. In FIG. 35A, the plurality of cans was assumed to be evenly distributed across the bottom wall 1106. The resulting plot shows that the maximum von Mises stress was about 5.162 MPa, which is significantly below the 22 MPa yield stress of polypropylene. In FIG. 35B, the main chamber 1102 was completely filled with water. The resulting plot shows that the maximum von Mises stress was about 7.346 MPa, which is significantly below the 22 MPa yield stress of polypropylene. In both cases, the maximum von Mises stress corresponds to a safety factor of about 3 for such stationary loading conditions.

Figure 36A:
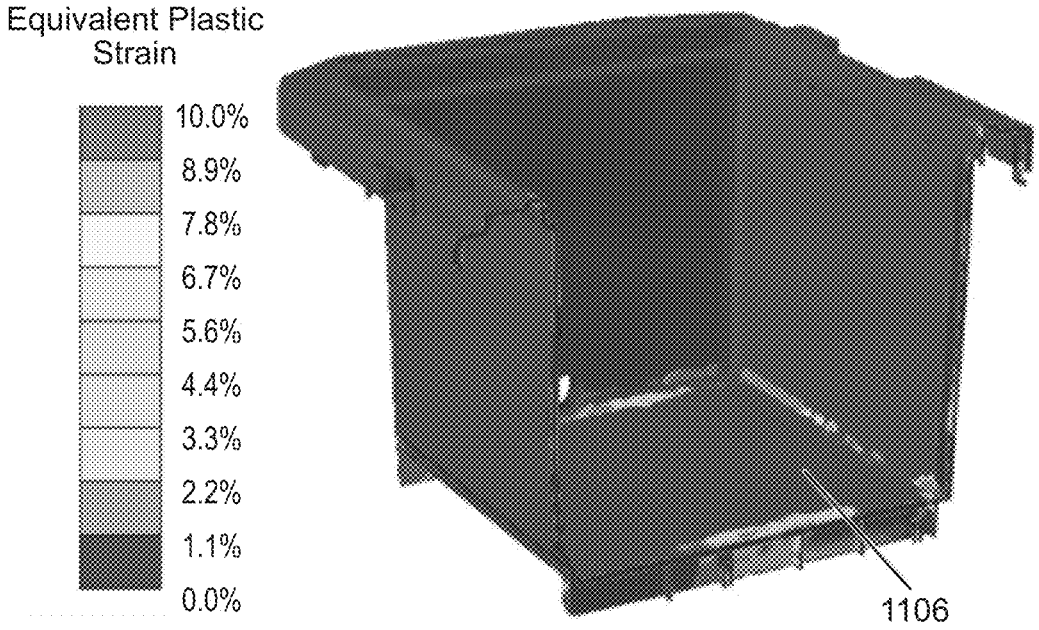
FIG. 36A is an illustrative plot of strain from a first dynamic load of the upper housing of FIG. 34A.
Figure 36B:
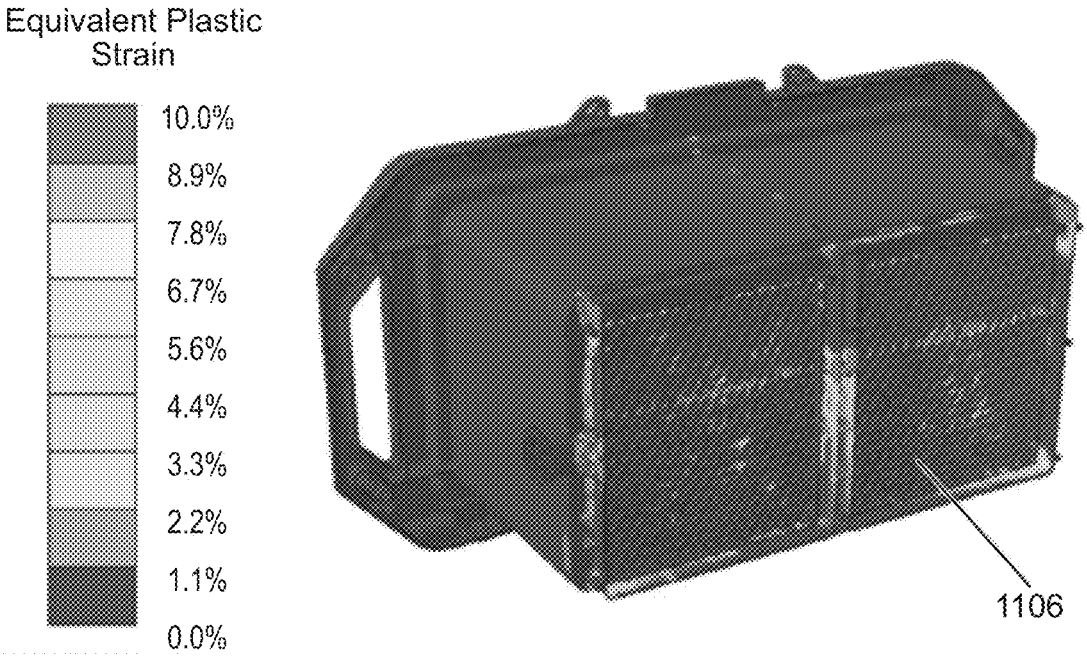
FIG. 36B is another illustrative plot of strain of the upper housing of FIG. 36A.
Figure 36C:
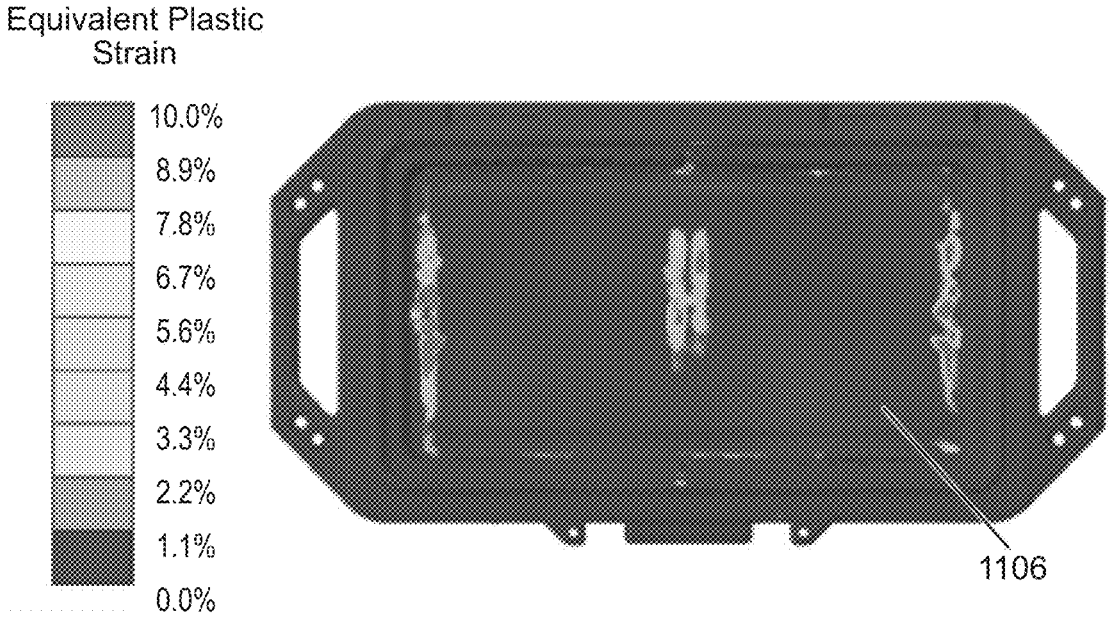
FIG. 36C is yet another illustrative plot of strain of the upper housing of FIG. 36A.

Results of a first dynamic load analysis are shown in FIGS. 36A-36C. Under the same support conditions described with reference to FIGS. 34B-34C, plastic strain analysis was performed assuming the upper housing 1100 was dropped from a first predetermined height while containing the plurality of cans. In this analysis, the predetermined height was about 0.762 m (30 inches). The peak equivalent plastic strain was about 10% and was concentrated along the perimeter support 1124 and central support 1126.

Figure 37A:
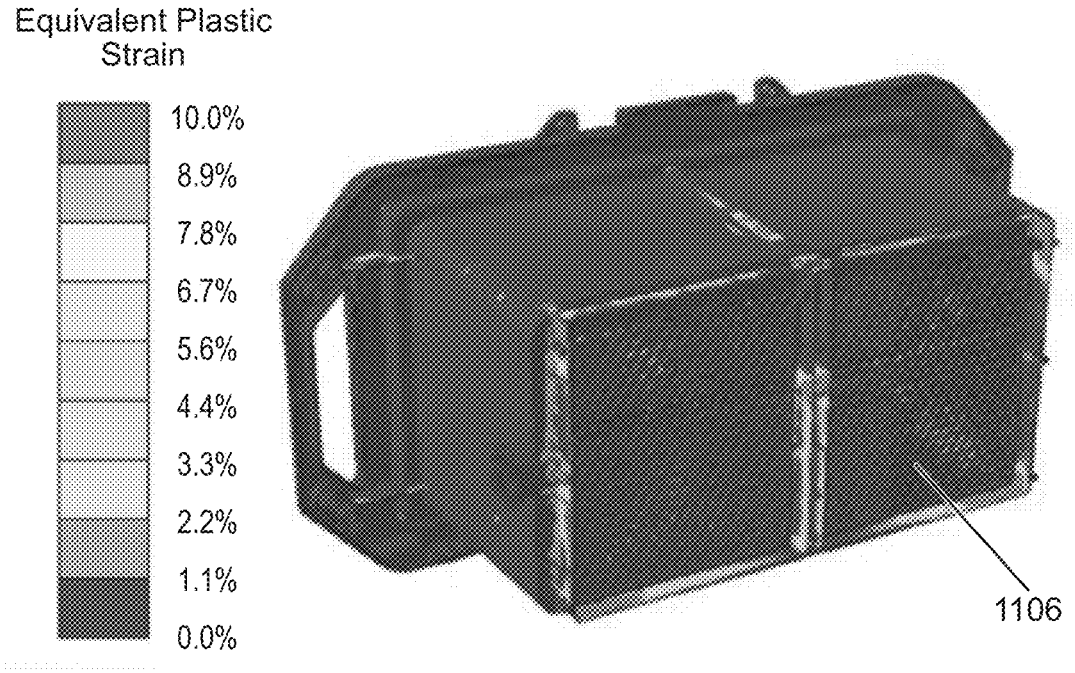
FIG. 37A is an illustrative plot of strain from a second dynamic load of the upper housing of FIG. 34A.
Figure 37B:
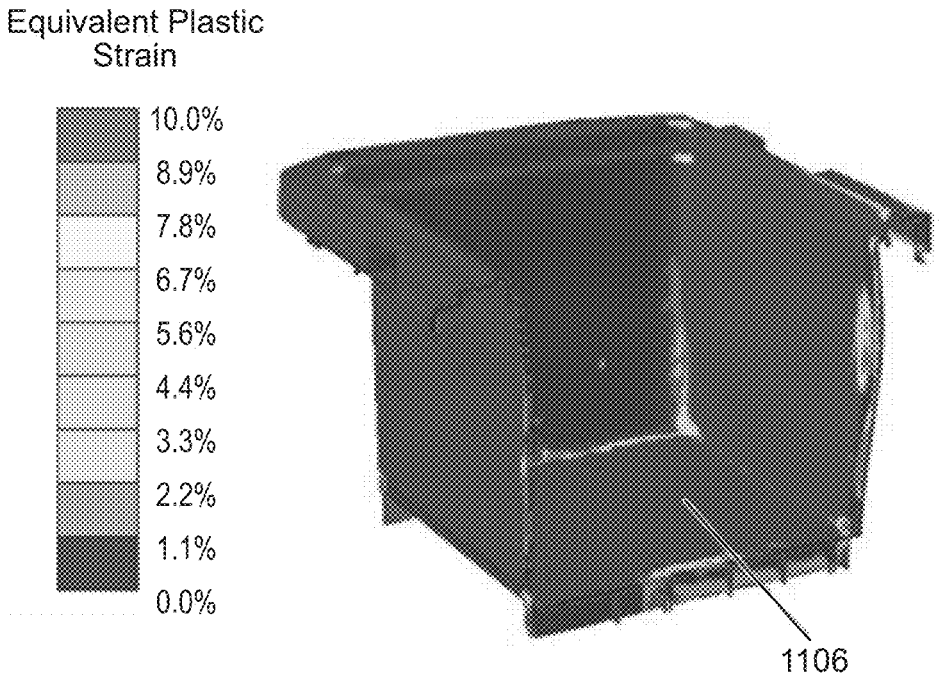
FIG. 37B is another illustrative plot of strain of the upper housing of FIG. 37A.
Figure 37C:
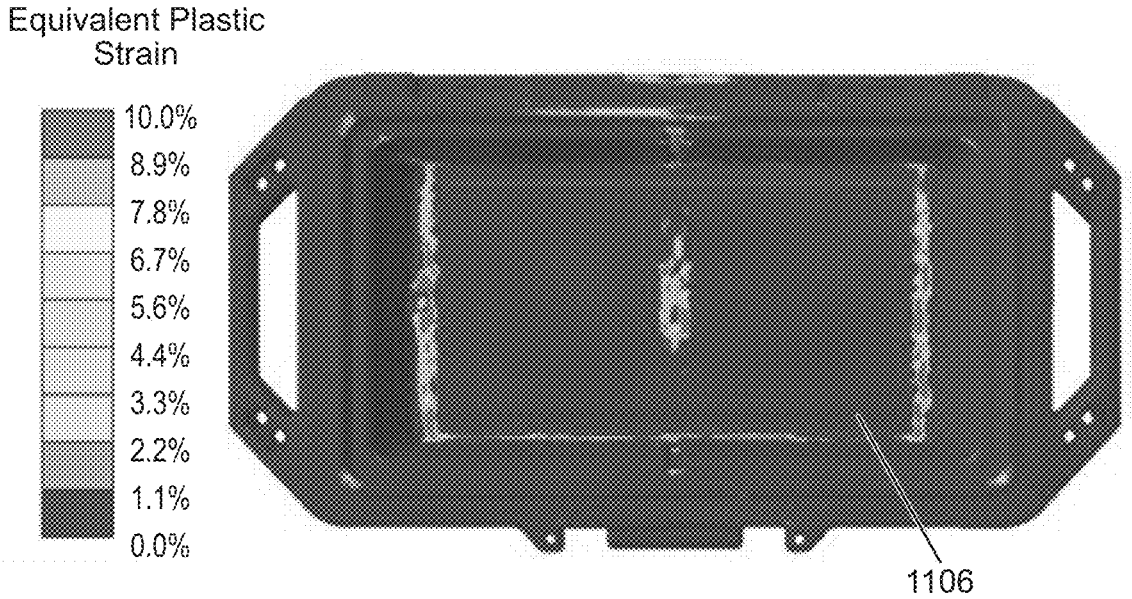
FIG. 37C is yet another illustrative plot of strain of the upper housing of FIG. 37A.

Results of a second dynamic load analysis are shown in FIGS. 37A-37C. Under the same support conditions described with reference to FIGS. 34B-34C, plastic strain analysis was performed assuming the upper housing 1100 was dropped from a second predetermined height while containing the plurality of cans. In this analysis, the predetermined height was about 1.3716 m (54 inches). The peak equivalent plastic strain was about 10% and was concentrated along the perimeter support 1124 and central support 1126.

Example 3

Figure 38A:
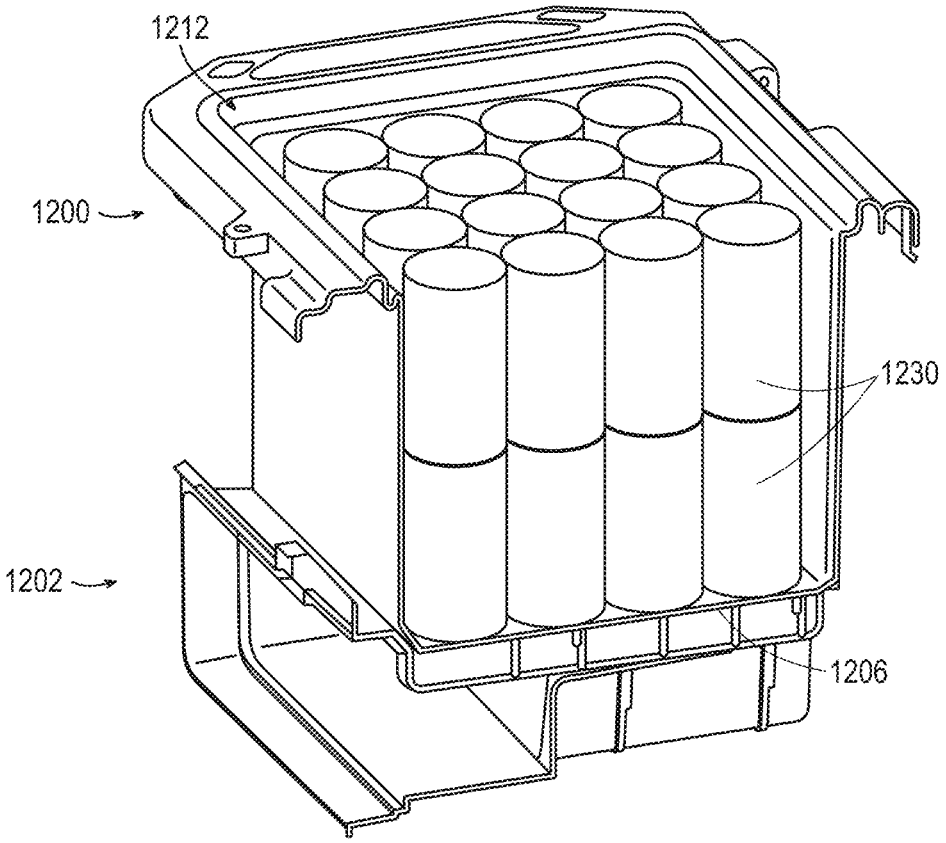
FIG. 38A is a perspective view of a cross-section of another exemplary embodiment of an upper housing and a lower housing of an insulated container.
Figure 38B:
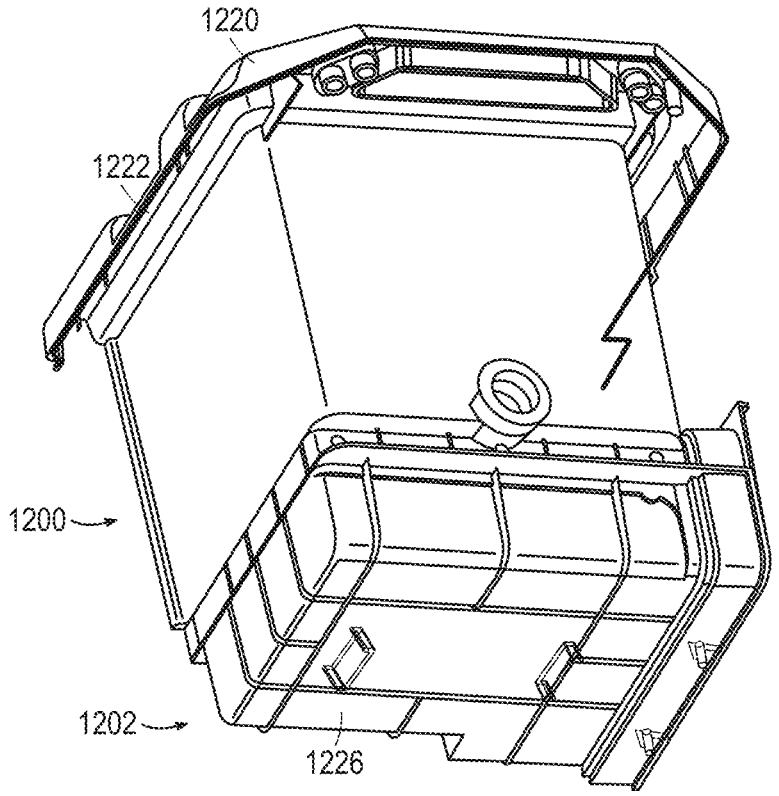
FIG. 38B is a bottom perspective view of upper and lower housings of FIG. 38A.
Figure 42B:
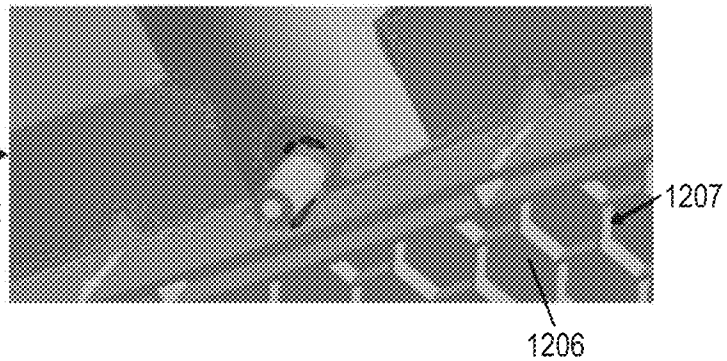
FIG. 42B is a magnified view of the illustrative plot of strain of FIG. 42A.
Figure 42A:
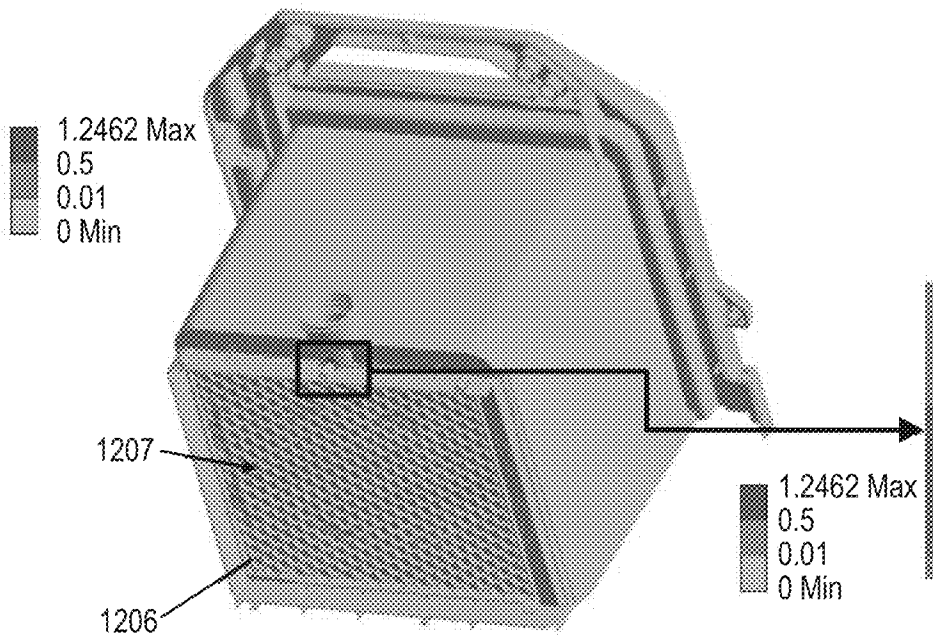
FIG. 42A is an illustrative plot of strain from the second dynamic load of the upper housing of FIG. 38A.

Still another exemplary embodiment of an insulated container in accordance with the description provided was analyzed for dynamic conditions when loaded with one or more objects. The analysis was performed using a finite element analysis technique based on a finite element mesh. For example, as shown in FIGS. 38A-38B, the analysis included an upper housing 1200 and a lower housing 1202. The description of the upper housing 1000 is similar to the description provided with reference to the upper housing 32, including the bottom wall 32*c*, shown in FIGS. 4-6, the upper housing 232 shown in FIGS. 20-21, or any other upper housing described herein. Similarly, the lower housing 1202 is similar to the description provided with reference to the lower housing 32 shown in FIGS. 4-6 or any other lower housing described herein. The analysis assumed that the lower housing 1202 was empty whereas the upper housing 1200 contained a plurality of cans 1230. The plurality of cans 1230 were positioned within a main chamber 1212 of the upper housing 1200. The plurality of cans 1230 were positioned on a top surface of a bottom wall 1206 of the upper housing 1200. The plurality of cans 1230 was assumed to apply a force of about 224 N to the top surface of the bottom wall 1206. The top surface of the bottom 1206 was substantially smooth whereas a bottom surface of the bottom wall 1206 included a plurality of ribs 1207, as shown in FIGS. 40A and 42A.

The analysis assumed portions of the upper housing 1200 and lower housing 1202 were supported. In particular, the upper housing 1200 and lower housing 1202 were not fixed together, but each was assumed to be fixed relative to an outer housing (not shown) of an insulated container. An upper edge 1220 of the upper housing 1200 was fixed along an upper edge support 1222 and the lower housing 1202 was fixed along a bottom support 1226 of a bottom surface of the lower housing 1202.

Figure 39:
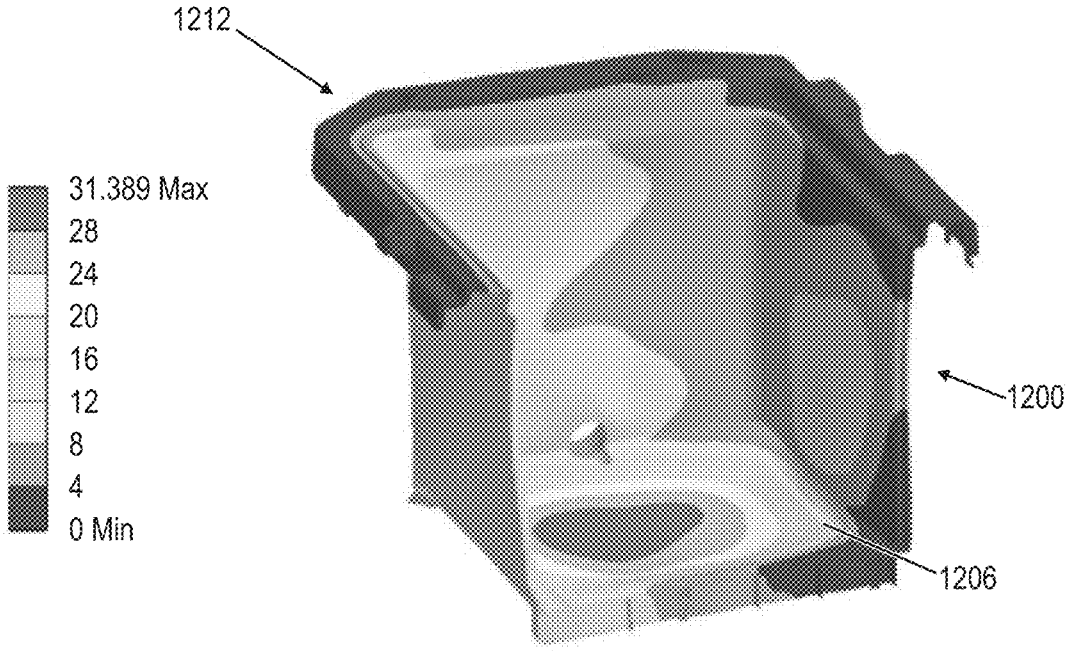
FIG. 39 is an illustrative plot of deformation from a first dynamic load of the upper housing of FIG. 38A.
Figures 40A, 40B, 40C:
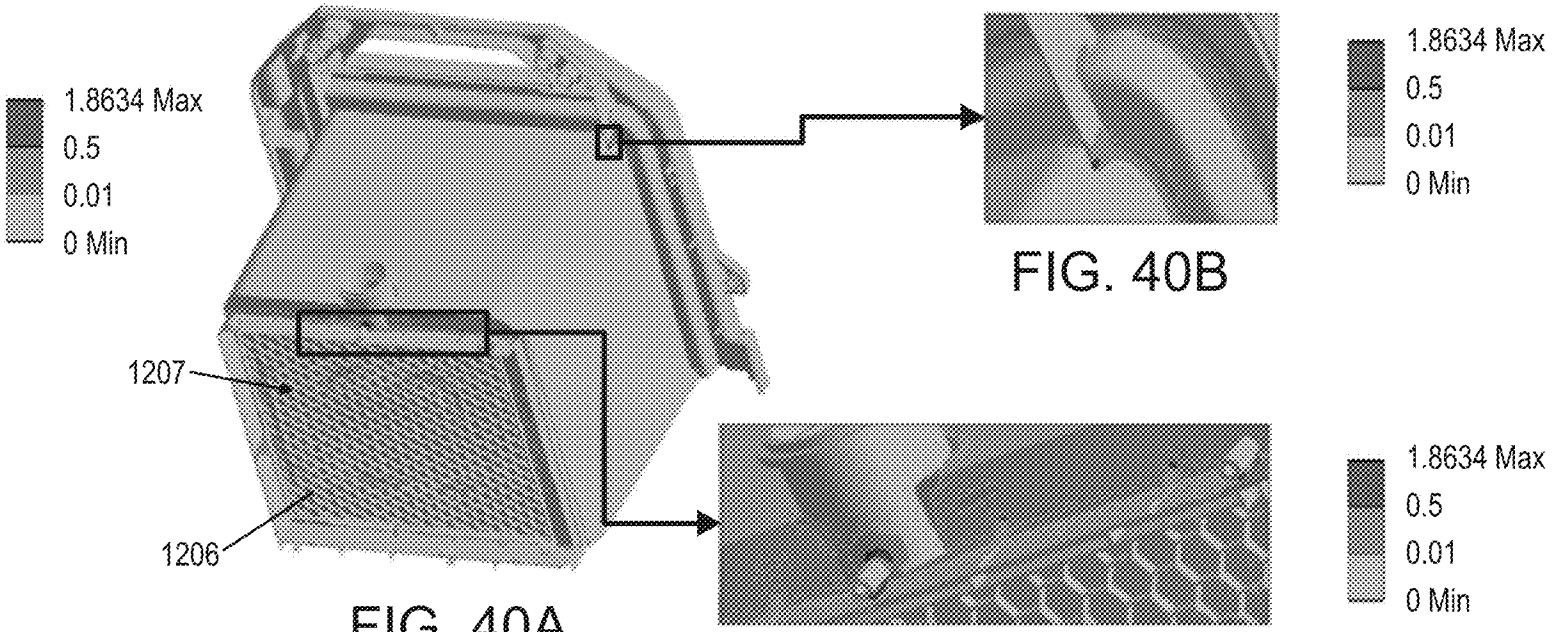
FIG. 40A is an illustrative plot of strain from a first dynamic load of the upper housing of FIG. 38A.
FIG. 40B is a magnified view of the illustrative plot of strain of FIG. 40A.
FIG. 40C is another magnified view of the illustrative plot of strain of FIG. 40A.

Results of a dynamic load analysis are shown in FIGS. 39 and 40A-40C. In a first dynamic load analysis, analysis was performed assuming the upper and lower housings 1200, 1202 were dropped from a first predetermined height while the upper housing 1200 contained the plurality of cans 1230. In this analysis, the first predetermined height was about 1.3716 m (54 inches). The maximum deformation of the bottom wall 1206, as shown in FIG. 39, was about 31.389 mm, for a DF of about 4.13. The maximum plastic strain, as shown in FIGS. 40A-40C, was about 186%. Plastic strains were developed in locations of the upper housing 1200 where stress reached or exceeded the material yield strength of the material. However, the plastic strains do not exceed the tensile elongation at failure, which is about 200% for polypropylene. Accordingly, the upper housing 1200 has sufficient structural integrity to withstand the forces (e.g., avoid failure) associated with the plurality of 1230 and the first predetermined height.

Figure 41:
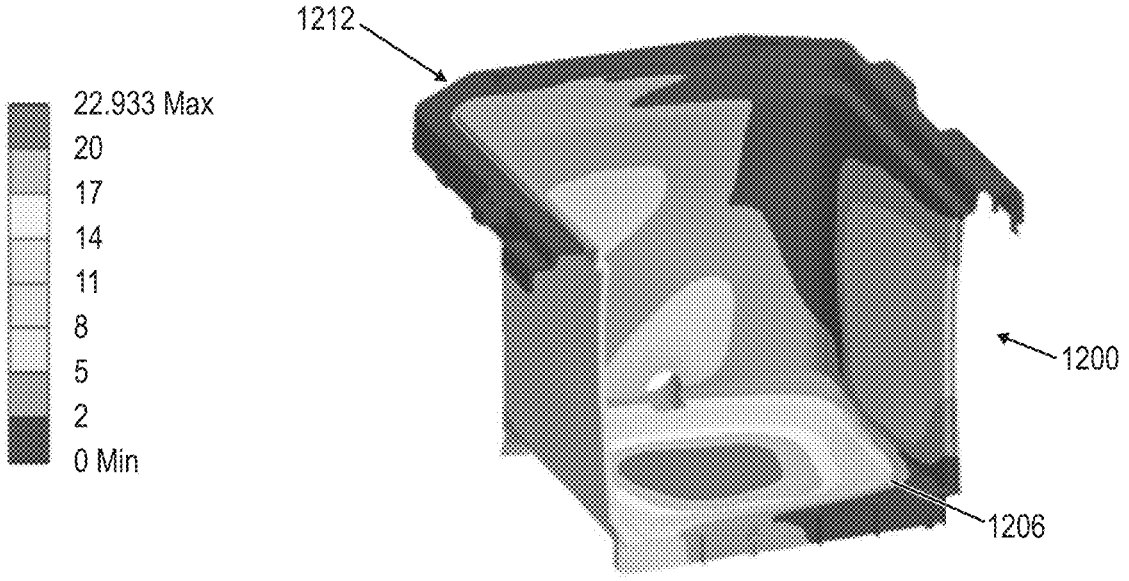
FIG. 41 is an illustrative plot of deformation from a second dynamic load of the upper housing of FIG. 38A.

In a second dynamic load analysis, analysis was performed assuming the upper and lower housings 1200, 1202 were dropped from a second predetermined height while the upper housing 1200 contained the plurality of cans 1230. In this analysis, the second predetermined height was about 0.762 m (30 inches). The maximum deformation of the bottom wall 1206, as shown in FIG. 41, was about 22.933 mm, for a DF of about 3.02. The maximum plastic strain, as shown in FIGS. 42A-42B, was about 125%. Plastic strains were developed in locations of the upper housing 1200 where stress reached or exceeded the material yield strength of the material. However, similar to the results of FIGS. 40A-40C, the plastic strains do not exceed the tensile elongation at failure, which is about 200% for polypropylene. Accordingly, the upper housing 1200 has sufficient structural integrity to withstand the forces (e.g., avoid failure) associated with the plurality of 1230 and the second predetermined height.

One skilled in the art will appreciate further features and advantages of the devices, systems, and methods based on the above-described embodiments. Accordingly, this disclosure is not to be limited by what has been particularly shown and described, except as indicated by the appended claims. All publications and references cited herein are expressly incorporated herein by reference in their entirety for all purposes.

The present disclosure has been described above by way of example only within the context of the overall disclosure provided herein. It will be appreciated that modifications within the spirit and scope of the claims may be made without departing from the overall scope of the present disclosure.

What is claimed is:

1. An insulated container, comprising:

an outer housing having an upper housing and a lower housing therein, the upper and lower housings being separated by a horizontal divider wall formed of a material having a thermal conductivity of about 0.3 W/m K or less, the horizontal divider wall being integrally formed with the upper housing and having:

a plurality of ribs along a bottom surface of the horizontal divider wall, a thickness between about 7 mm and about 11 mm, and a maximum deformation factor of 5 or less when the horizontal divider wall is subjected to a force of between about 1 kPa and about 2 kPa, wherein the deformation factor is determined by dividing a maximum deformation of the horizontal divider wall by the thickness.

2. The insulated container of claim 1, wherein the deformation factor is given by an equation:

$$DF = \frac{D_{max,wall}}{t_{wall}}$$

3. The insulated container of claim 1, wherein the horizontal divider wall has a total surface area between about 0.1 square meters and about 0.2 square meters.

4. The insulated container of claim 3, wherein the horizontal divider wall has a surface area of about 0.15 square meters.

5. The insulated container of claim 1, wherein the horizontal divider wall is formed of polypropylene.

6. The insulated container of claim 1 further comprising a vertical divider wall positioned within the lower housing and configured to support a central portion of the horizontal divider wall.

7. The insulated container of claim 6, wherein the vertical divider wall supports between about 0.25 and about 0.75 of a width of the horizontal divider wall in a first configuration.

8. The insulated container of claim 7, wherein the deformation factor is 1 or less in the first configuration.

9. The insulated container of claim 6, wherein the vertical divider wall supports an entire width of the horizontal divider wall in a second configuration.

10. The insulated container of claim 9, wherein the deformation factor is 1 or less in the second configuration.

11. An insulated container, comprising:

an outer housing having an upper housing and a lower housing therein, the upper and lower housings being separated by a horizontal divider wall formed of a material having a thermal conductivity of 0.3 W/m K or less, the horizontal divider wall being integrally formed with the upper housing and having:

a plurality of hexagonal ribs arranged in a honeycomb pattern along a bottom surface of the divider wall, a total surface area between about 0.1 square meters and about 0.2 square meters, and a maximum plastic strain value of 190% or less when the horizontal divider wall is subjected to a dynamic force of between about 1 kPa and about 2 kPa.

12. The insulated container of claim 11, wherein the maximum plastic strain is less than an elongation at failure value.

13. The insulated container of claim 12, wherein the elongation at failure value is a strain of about 200%.

14. The insulated container of claim 11, wherein the horizontal divider wall is formed of polypropylene.

15. The insulated container of claim 11 further comprising a vertical divider wall positioned within the lower housing and configured to support a central portion of the horizontal divider wall.

16. The insulated container of claim 15, wherein the vertical divider wall supports between about 0.25 and about 0.75 of a width of the horizontal divider wall in a first configuration.

17. The insulated container of claim 15, wherein the vertical divider wall supports an entire width of the horizontal divider wall in a second configuration.

18. The insulated container of claim 11, wherein the upper and lower housings are separable from one another.

19. The insulated container of claim 11, wherein the upper housing has a first plurality of walls that defines a main chamber configured to receive a cooling agent therein.

20. The insulated container of claim 11, wherein the lower housing has a second plurality of walls that defines a drawer chamber configured to receive a drawer therein.

* * * * *